US008153918B2

(12) United States Patent
Agronin et al.

(10) Patent No.: US 8,153,918 B2
(45) Date of Patent: Apr. 10, 2012

(54) AUTOMATIC LIGHT SWITCH WITH MANUAL OVERRIDE

(75) Inventors: Michael Agronin, Owings Mills, MD (US); David Campbell, Bel Air, MD (US); Marco Mattucci, Baltimore, MD (US); Scott Pollard, Baltimore, MD (US); David Logan Baker, Greene, RI (US); Daniel P. Smith, Portsmouth, RI (US); William J. Mussig, Seekonk, MA (US); Breck Andrew Petrillo, Warren, RI (US)

(73) Assignee: Black & Decker Inc., Newark, DE (US)

( * ) Notice: Subject to any disclaimer, the term of this patent is extended or adjusted under 35 U.S.C. 154(b) by 441 days.

(21) Appl. No.: 12/432,986

(22) Filed: Apr. 30, 2009

(65) Prior Publication Data

US 2009/0288937 A1 Nov. 26, 2009

Related U.S. Application Data

(63) Continuation-in-part of application No. 12/115,797, filed on May 6, 2008, now Pat. No. 7,608,793, which is a continuation of application No. 11/044,552, filed on Jan. 27, 2005, now Pat. No. 7,372,355.

(60) Provisional application No. 61/126,776, filed on May 7, 2008.

(51) Int. Cl.
*H01H 3/20* (2006.01)

(52) U.S. Cl. ..... 200/331

(58) Field of Classification Search ..... 200/331, 200/329–330, 33 R, 33 B
See application file for complete search history.

(56) References Cited

U.S. PATENT DOCUMENTS

| | | | |
|---|---|---|---|
| 2,078,147 | A | 4/1937 | Linde |
| 2,211,819 | A | 8/1940 | Innis |
| 2,515,932 | A | 7/1950 | Stang et al. |
| 2,524,215 | A | 10/1950 | Wegehoft |

(Continued)

FOREIGN PATENT DOCUMENTS

JP 59-049616 3/1984

OTHER PUBLICATIONS

Instruction Manual for Room GearTM , Lights OffTM Remote Control Light Switch, www.wildplanet.com, May 9, 2002.

*Primary Examiner* — Edwin A. Leon
*Assistant Examiner* — Vanessa Girardi
(74) *Attorney, Agent, or Firm* — Harness, Dickey & Pierce, P.L.C.

(57) ABSTRACT

An automatic switch control includes a wheel member having a cam member with a ramp surface. A first plunger mechanism has a first spring member that is operable to urge a first cam follower into sliding engagement with the ramp surface. A second plunger mechanism has a second spring member that is operable to urge a second cam follower into sliding engagement with the ramp surface. The second plunger mechanism is disposed on an opposite side of the toggle from the first plunger mechanism when the automatic switch control is installed over the switch. An electric motor is operable to rotate the cam member to position the first plunger mechanism in a retracted condition and to position the second plunger mechanism in an extended condition that is operable to move the toggle to the on position.

18 Claims, 24 Drawing Sheets

U.S. PATENT DOCUMENTS

| | | | |
|---|---|---|---|
| 2,578,632 | A | 12/1951 | Miller |
| 3,171,920 | A | 3/1965 | Klein et al. |
| 3,178,947 | A | 4/1965 | Keefe |
| 3,179,396 | A | 4/1965 | Bracken |
| 3,518,356 | A | 6/1970 | Friedman |
| 3,590,648 | A | 7/1971 | Gorman |
| 3,634,803 | A | 1/1972 | Willson et al. |
| 3,725,835 | A | 4/1973 | Hopkins et al. |
| 3,740,680 | A | 6/1973 | Schneidinger |
| 3,818,156 | A | 6/1974 | Augustyniak |
| 3,968,380 | A | 7/1976 | Jost et al. |
| 3,985,982 | A | 10/1976 | Schneidinger |
| 3,988,553 | A | 10/1976 | Astle |
| 4,007,404 | A | 2/1977 | Joste et al. |
| 4,015,139 | A | 3/1977 | Cleary et al. |
| 4,021,626 | A | 5/1977 | Becker |
| 4,164,635 | A | 8/1979 | Finch et al. |
| 4,360,739 | A | 11/1982 | Goldstein |
| 4,506,120 | A | 3/1985 | Fleischman |
| 4,508,943 | A | 4/1985 | Pfeiffer et al. |
| 4,524,252 | A | 6/1985 | Okazaki et al. |
| 4,544,988 | A | 10/1985 | Hochstein |
| 4,597,505 | A | 7/1986 | Mozley et al. |
| 4,645,942 | A | 2/1987 | Nilssen |
| 4,700,541 | A | 10/1987 | Gabriel et al. |
| 4,794,213 | A | 12/1988 | Wood |
| 4,825,686 | A | 5/1989 | Marsh |
| 4,835,413 | A | 5/1989 | Nilssen |
| 4,887,430 | A | 12/1989 | Kroll et al. |
| 4,912,376 | A | 3/1990 | Strick |
| 4,949,061 | A | 8/1990 | Kirma |
| 4,979,672 | A | 12/1990 | AbuJudom, II et al. |
| 5,015,930 | A | 5/1991 | Kikuta et al. |
| 5,071,064 | A | 12/1991 | AbuJudom, II et al. |
| 5,176,544 | A | 1/1993 | AbuJuom, II et al. |
| 5,206,775 | A | 4/1993 | Wilson |
| 5,306,957 | A | 4/1994 | Ellingham et al. |
| 5,397,869 | A | 3/1995 | Huen |
| 5,465,031 | A | 11/1995 | Nilssen |
| 5,603,141 | A | 2/1997 | Gledhill |
| 5,719,362 | A | 2/1998 | Gray, Jr. |
| 5,806,665 | A | 9/1998 | Houssian |
| 5,828,018 | A | 10/1998 | Cooper |
| 5,838,219 | A | 11/1998 | Du et al. |
| 5,949,616 | A | 9/1999 | Coon et al. |
| 5,955,796 | A | 9/1999 | Nilssen |
| 5,990,777 | A | 11/1999 | Whiteman, Jr. |
| 6,016,096 | A | 1/2000 | Barnes et al. |
| 6,036,330 | A | 3/2000 | Sanguedolce |
| 6,133,816 | A | 10/2000 | Barnes et al. |
| 6,218,995 | B1 | 4/2001 | Higgins et al. |
| 6,328,363 | B1 | 12/2001 | Larsen |
| 6,518,526 | B2 | 2/2003 | Hamada et al. |
| 6,710,274 | B2 | 3/2004 | Whetzel et al. |
| 6,714,106 | B1 | 3/2004 | Czarnecki |
| 6,861,601 | B2 | 3/2005 | Heien |
| 7,189,936 | B2 | 3/2007 | Gray, Jr. |
| 7,244,900 | B1 | 7/2007 | Gray, Jr. |
| 7,372,355 | B2 | 5/2008 | Agronin et al. |
| 2002/0104747 | A1* | 8/2002 | Turner et al. ..... 200/330 |
| 2002/0135476 | A1 | 9/2002 | McKinney, Jr. et al. |
| 2005/0194243 | A1 | 9/2005 | Prineppi |
| 2005/0242753 | A1 | 11/2005 | Morrison et al. |
| 2007/0193862 | A1 | 8/2007 | Blakeman |
| 2008/0047818 | A1 | 2/2008 | Holcomb |
| 2008/0202909 | A1 | 8/2008 | Agronin et al. |

* cited by examiner

AUTOMATIC LIGHT SWITCH WITH MANUAL OVERRIDE

CROSS-REFERENCE TO RELATED APPLICATION

This application claims the benefit of U.S. Provisional Application Ser. No. 61/126,776, filed on May 7, 2008, entitled AUTOMATIC LIGHT SWITCH AND RELATED METHOD. This application is also a continuation in part of U.S. patent application Ser. No. 12/115,797, filed on May 6, 2008, entitled REMOTE CONTROLLED WALL SWITCH ACTUATOR, which is a continuation of U.S. patent application Ser. No. 11/044,552, filed on Jan. 27, 2005 and now issued as U.S. Pat. No. 7,372,355 entitled REMOTE CONTROLLED WALL SWITCH ACTUATOR. The disclosure of the above applications are hereby incorporated by reference as is fully set forth herein.

FIELD

The present disclosure generally relates to an automatic switch control and more particularly relates to an automatic switch control and related method for automatically actuating a switch, while permitting motion of a toggle by the switch or manually by a user.

BACKGROUND

Modern consumers are increasingly aware of technological advancements relating to maintenance and operation of their homes and businesses. Increasingly popular advancements involve controlling various devices through automation. Automation allows the consumer to control the various devices without physically contacting any such device.

A conventional light switch for example can include a toggle that opens and closes a circuit of the light switch between a power source and a light fixture. When the toggle of the light switch is in an off position, the circuit between the power source and the light fixture is open and no electricity is delivered to the light fixture. When the toggle is in an on position, the switch closes the circuit and electricity is delivered to the light fixture. In between the off position and the on position, the toggle can define a transition area where when left in this area, the toggle will retreat to the closest of the off position or the on position due to a spring in the light switch. There is also a middle position in the transition area where the spring is unable to cause the retreat of the toggle. The toggle can also be moved to positions that are immediately adjacent to the middle position where electrical contact is just barely made and undesirably tease the electrical connection but the switch is still unable to cause the toggle to retreat to either the on position or the off position.

SUMMARY

This section provides a general summary of the disclosure and is not a comprehensive disclosure of its full scope or all of its features.

The present teachings generally include an automatic switch control that fits over a switch on a wall to move a toggle of the switch between an on position and an off position. The automatic switch control generally includes a housing and a wheel member rotatably supported by the housing. The wheel member has a cam member with a ramp surface. An electric motor is operable to rotate the wheel member about an axis of rotation that is generally perpendicular to the wall. A first plunger mechanism has a first spring member that is operable to urge a first cam follower into sliding engagement with the ramp surface. A second plunger mechanism has a second spring member that is operable to urge a second cam follower into sliding engagement with the ramp surface. The second plunger mechanism is disposed on an opposite side of the toggle from the first plunger mechanism when the automatic switch control is installed over the switch. The electric motor is operable to rotate the cam member to position the first plunger mechanism in a retracted condition and to position the second plunger mechanism in an extended condition that is operable to move the toggle to the on position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected examples and not all possible implementations, and are not intended to limit the scope of the present teachings.

Figure 26:
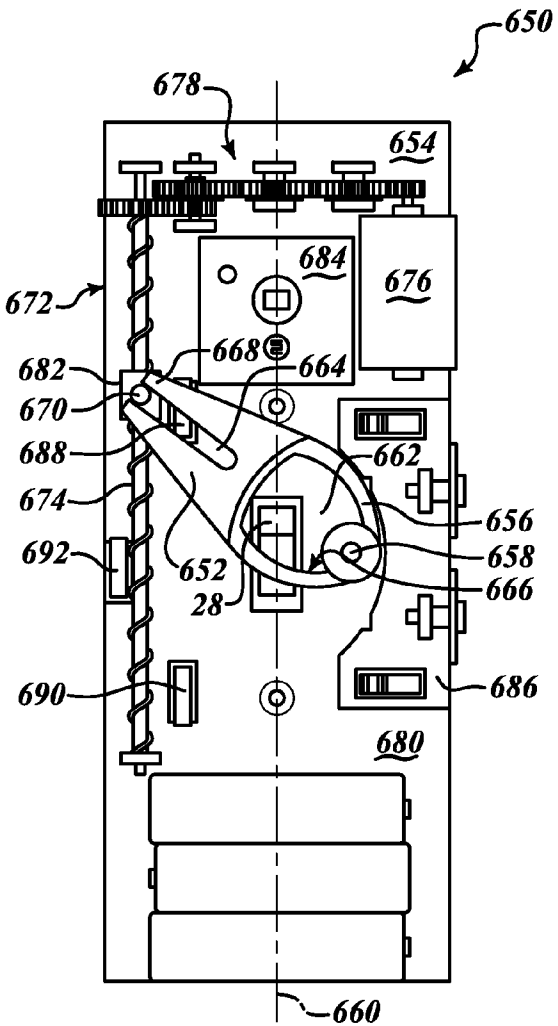
Figure 25:
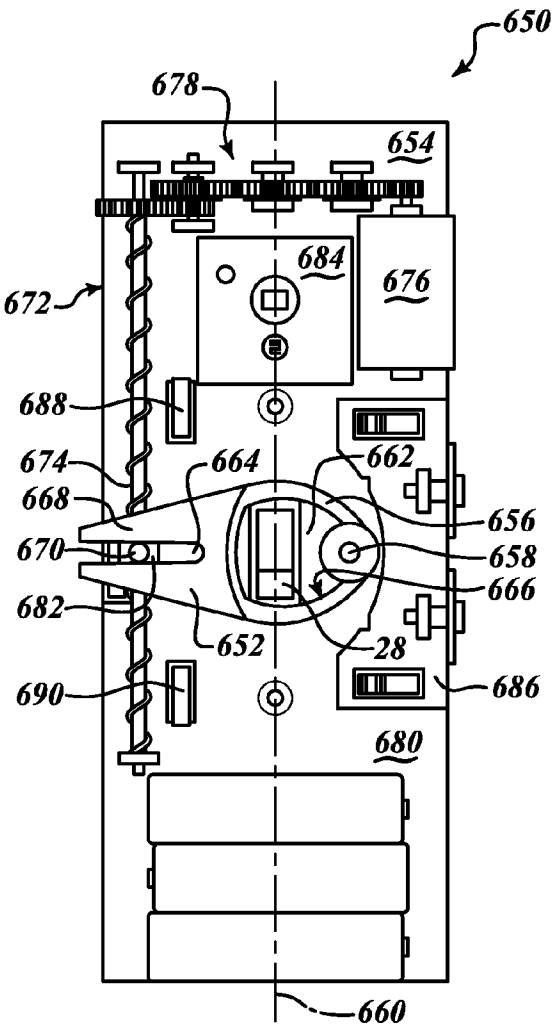
Figure 24:
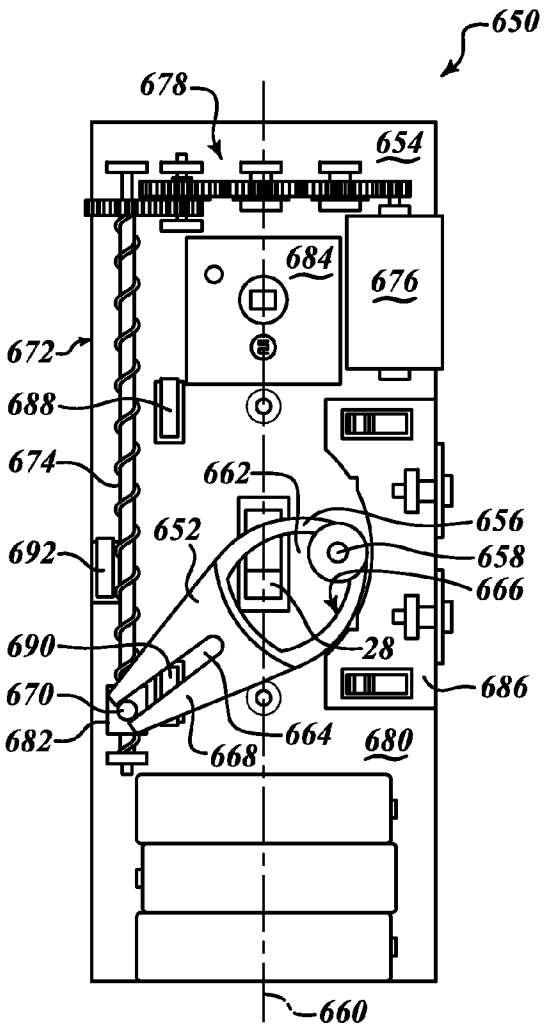

FIG. 24, FIG. 25, and FIG. 26 are diagrams of an automatic switch control having three position sensors and a yoke member that move the toggle of the switch in accordance with a further example of the present teachings.

Figure 28:
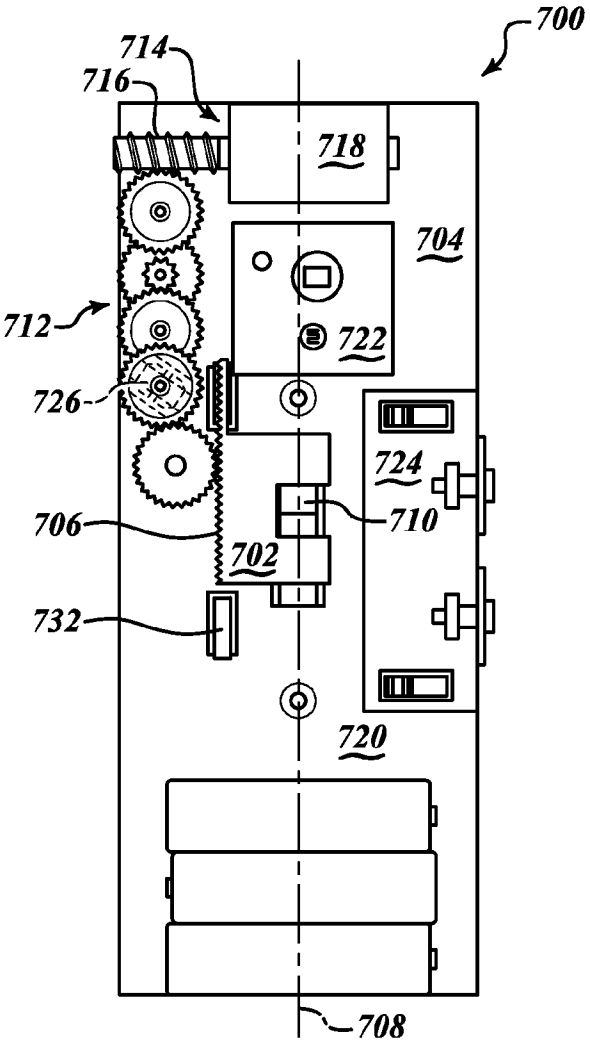
Figure 27:
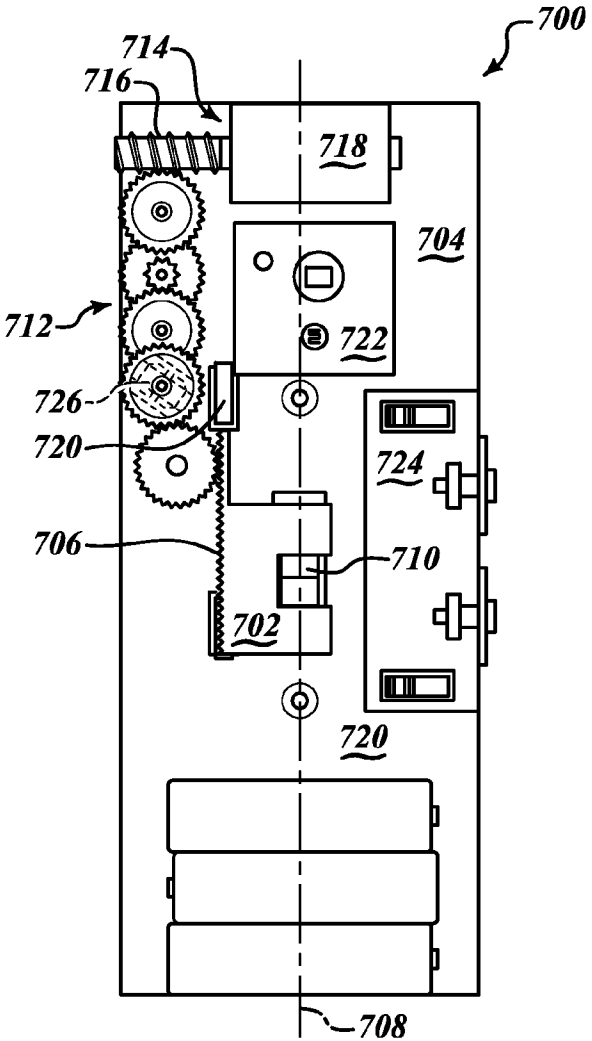

FIG. 27 and FIG. 28 are diagrams of an automatic switch control having two position sensors and a yoke member that move the toggle of the switch in accordance with yet another example the present teachings.

Figure 31:
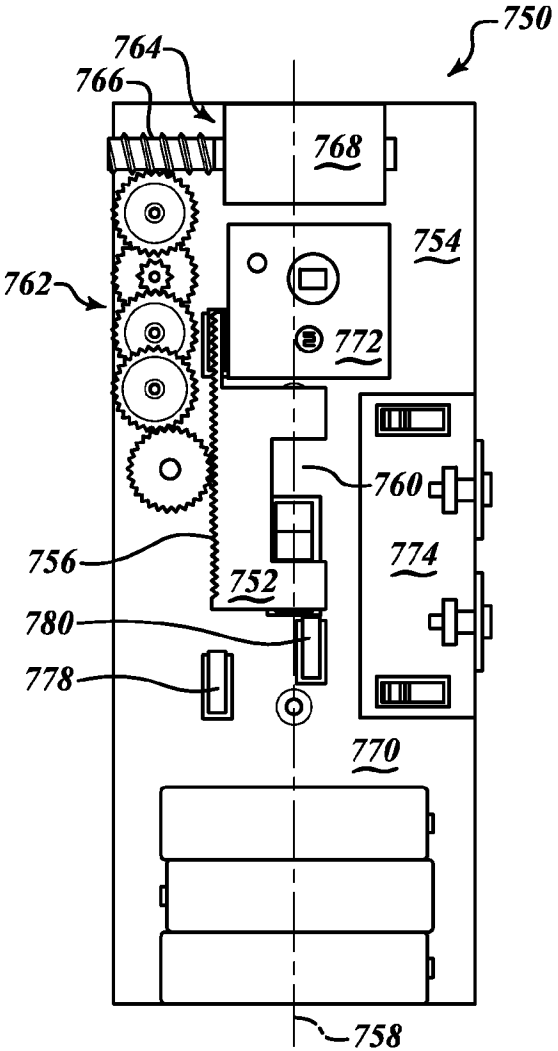
Figure 30:
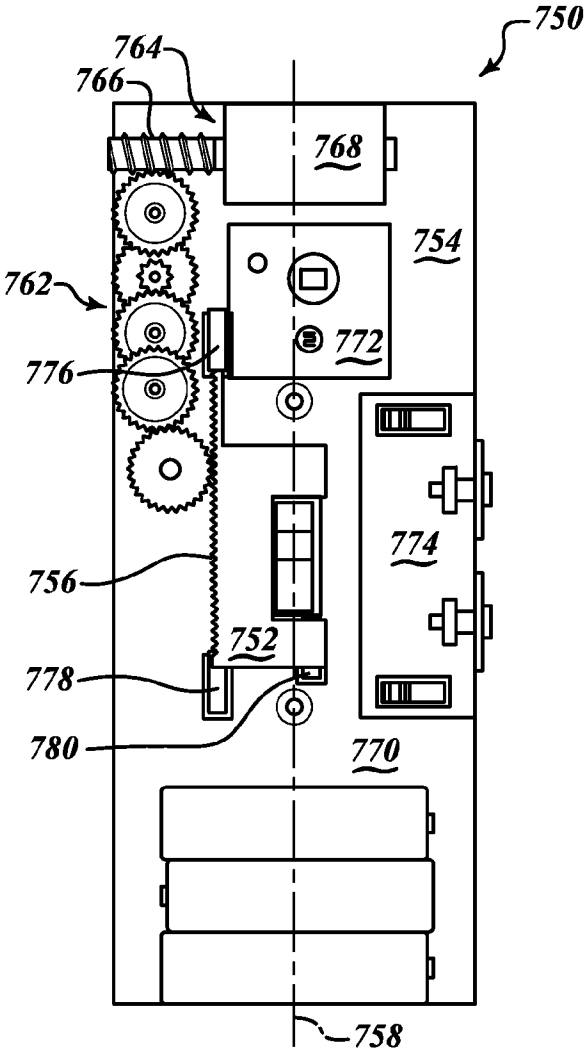
Figure 29:
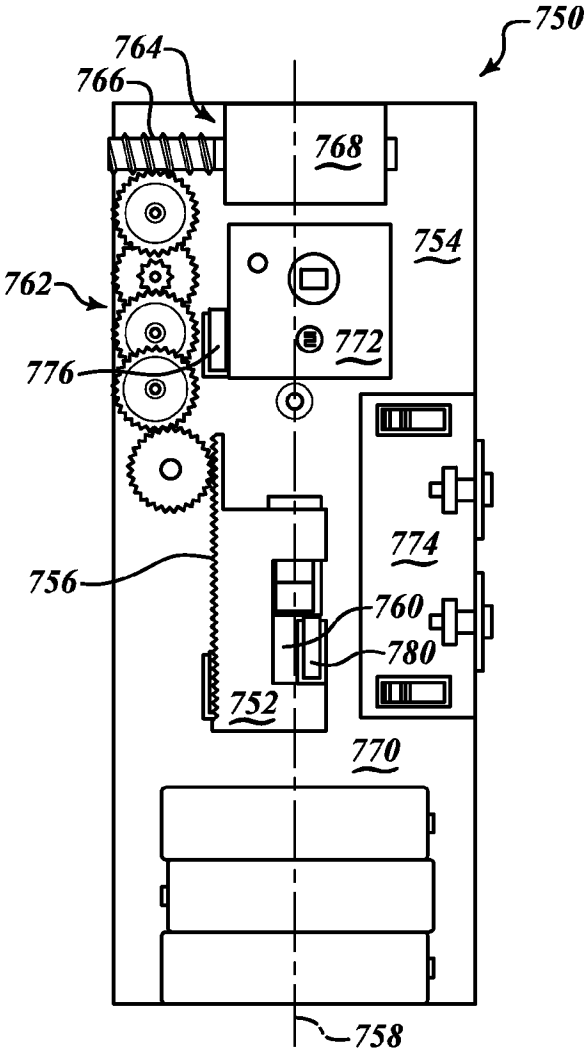

FIG. 29, FIG. 30, and FIG. 31 are diagrams similar to FIG. 27 and FIG. 28 that show an automatic switch control having three position sensors and a yoke member that move the toggle of the switch in accordance with another example of the present teachings.

FIG. 32 through FIG. 36 are diagrams of an idler drive mechanism of an automatic switch control that can move the toggle of the switch in accordance with a further example of the present teachings.

Figure 39:
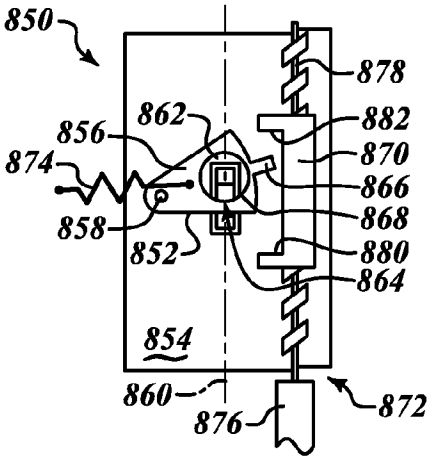
Figure 38:
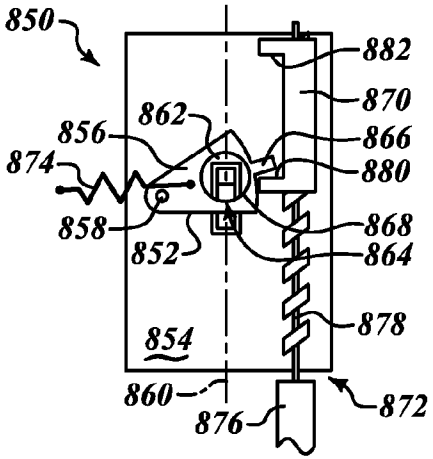
Figure 37:
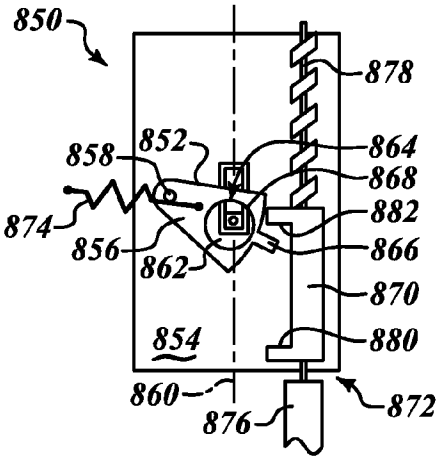

FIG. 37, FIG. 38, and FIG. 39 are diagrams of an automatic switch control having a yoke member with a center spring that can move the toggle of the switch in accordance with yet another example of the present teachings.

Figure 42:
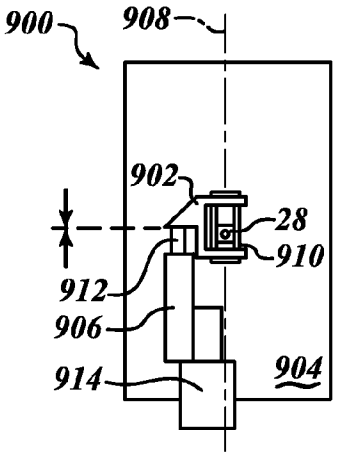
Figure 41:
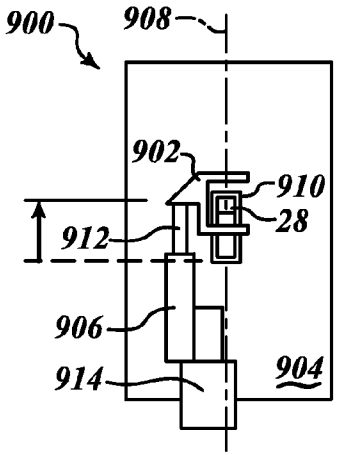
Figure 40:
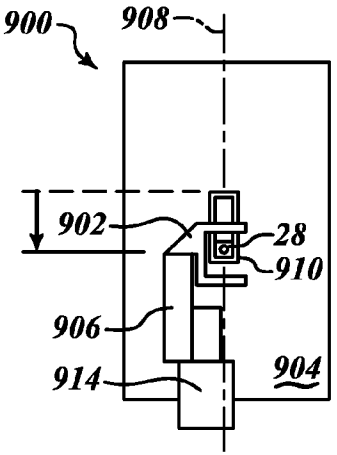

FIG. 40, FIG. 41, and FIG. 42 are diagrams of an automatic switch control having a yoke member attached to a telescoping member that move the toggle in accordance with another example of the present teachings.

Figure 45:
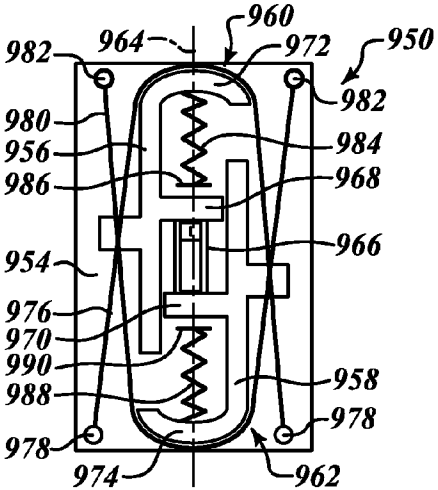
Figure 44:
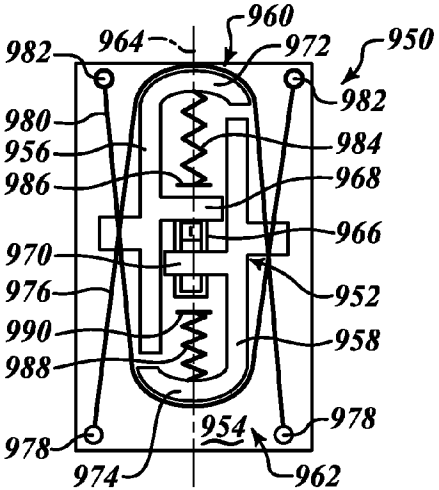
Figure 43:
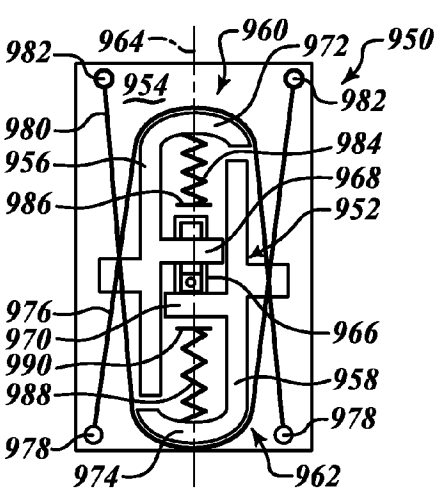

FIG. 43, FIG. 44, and FIG. 45 are diagrams of an automatic switch control having a shape memory wire that constricts to move a yoke member and move the toggle of the switch in accordance with a further example of the present teachings.

Figure 48:
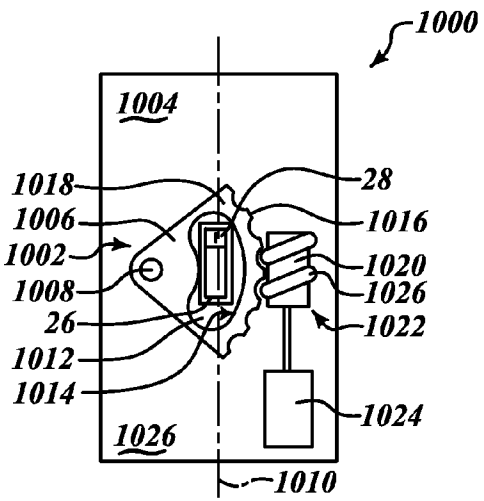
Figure 47:
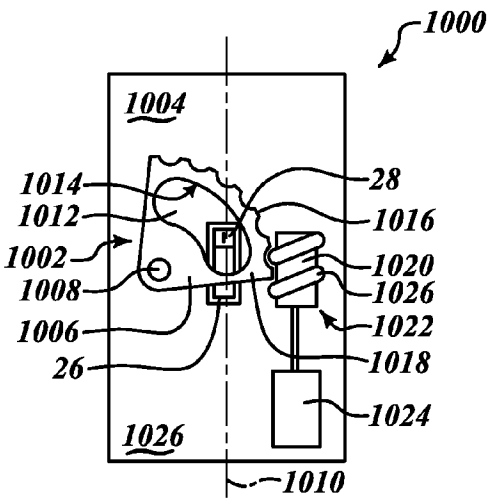
Figure 46:
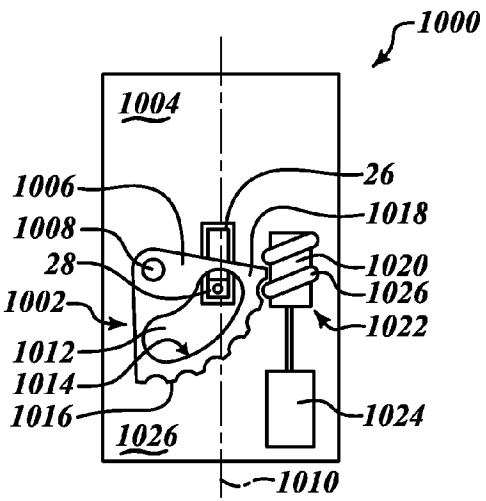

FIG. 46, FIG. 47, and FIG. 48 are diagrams of an automatic switch control having a yoke member that can pivot relative to a housing to move the toggle of the switch in accordance with various examples of the present teachings.

Figure 51:
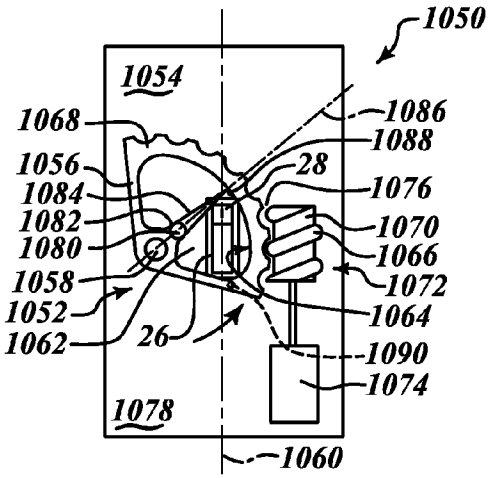
Figure 50:
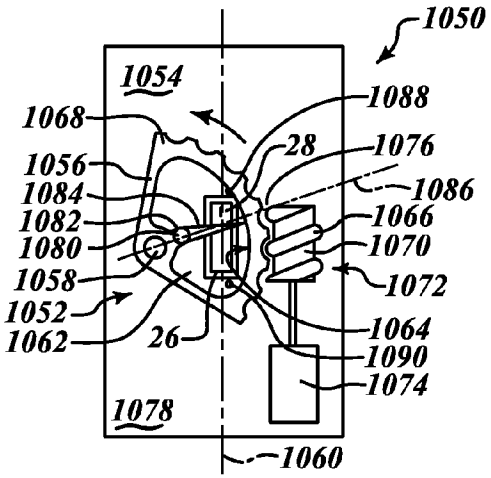
Figure 49:
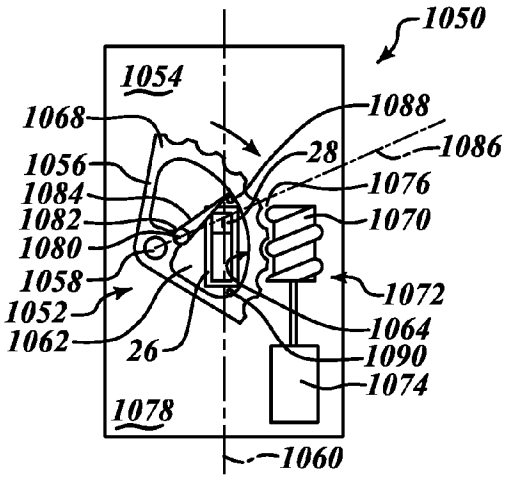

FIG. 49, FIG. 50, and FIG. 51 are diagrams of an automatic switch control having a yoke member with a toggle mover member that can wind up a spring member to move the toggle of the switch in accordance with further examples of the present teachings.

Figure 54:
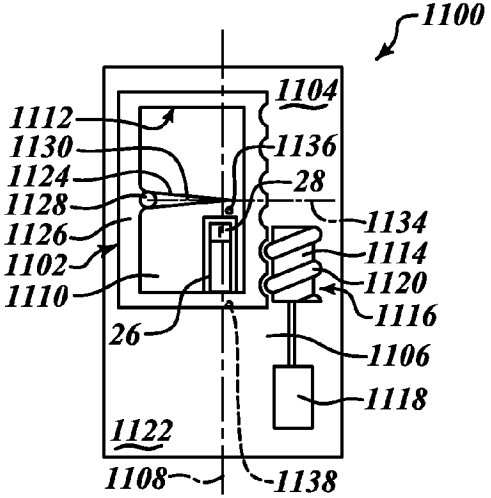
Figure 53:
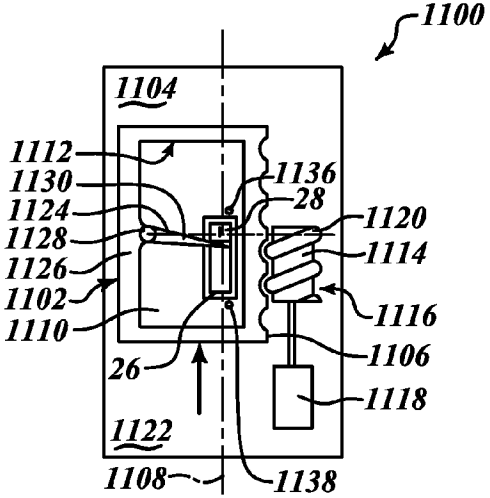
Figure 52:
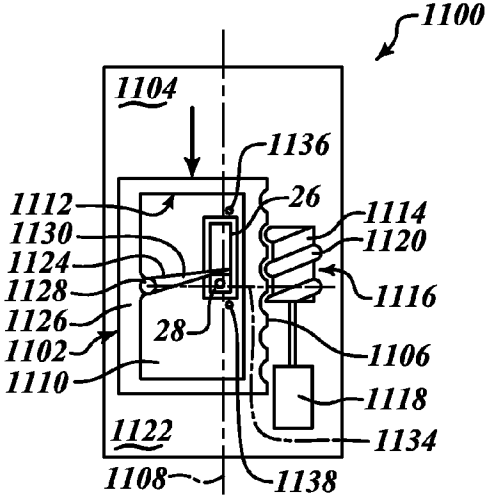

FIG. 52, FIG. 53, and FIG. 54 are similar to FIG. 49, FIG. 50, and FIG. 51 and show a toggle mover member connected to a yoke member that is slidable about a longitudinal axis to move the toggle of the switch in accordance with further examples of the present teachings.

Figure 57:
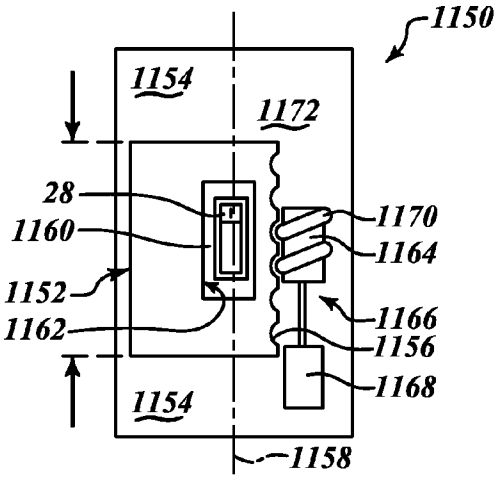
Figure 56:
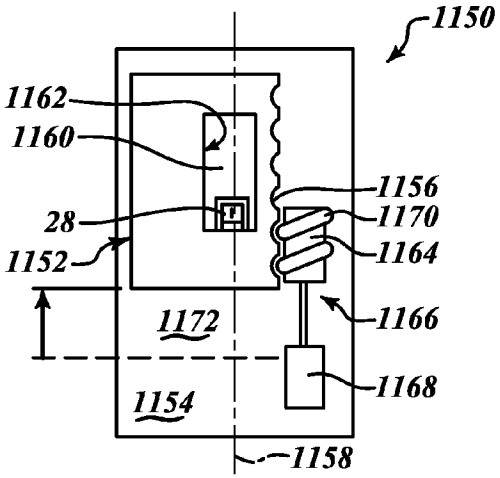
Figure 55:
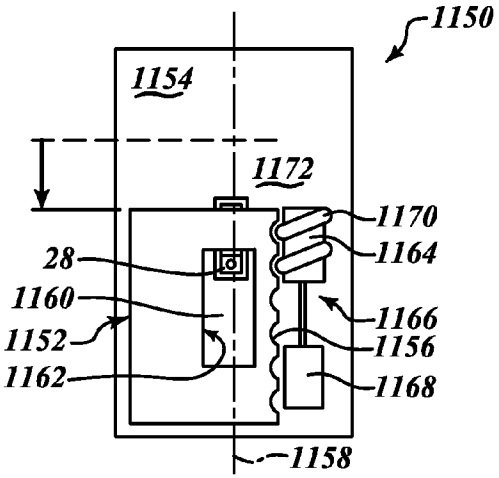

FIG. 55, FIG. 56, and FIG. 57 are diagrams of an automatic switch control having a yoke member that can slide along a longitudinal axis of a housing to move the toggle of the switch in accordance with further examples of the present teachings.

Figure 60:
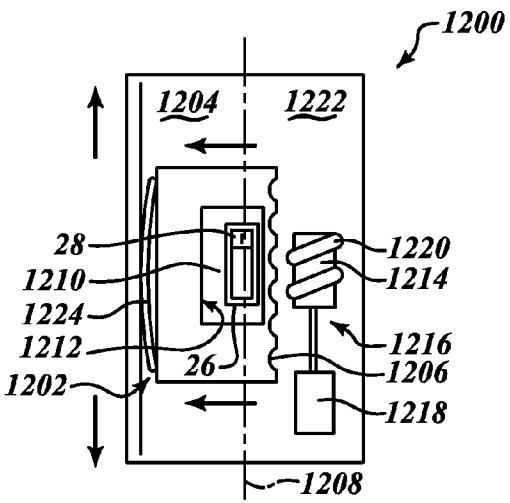
Figure 59:
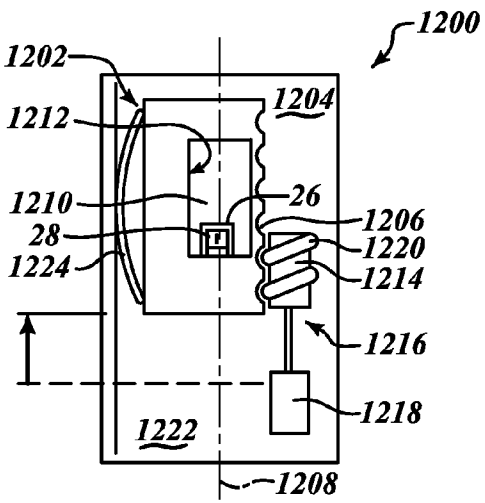
Figure 58:
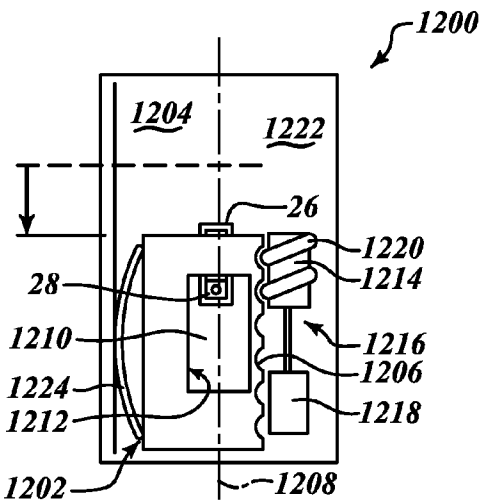

FIG. 58, FIG. 59, and FIG. 60 are similar to FIG. 55, FIG. 56, and FIG. 57 and include a spring member that can urge the yoke member into engagement with a worm drive in accordance with further examples of the present teachings.

Figure 63:
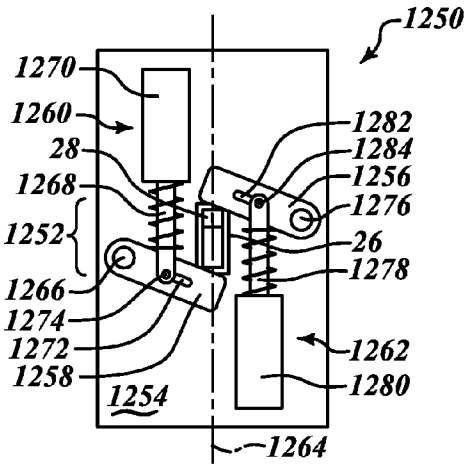
Figure 62:
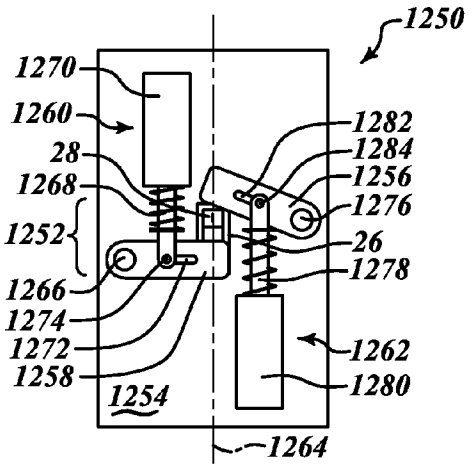
Figure 61:
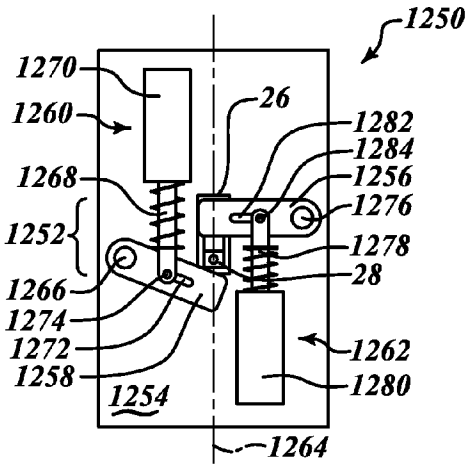

FIG. 61, FIG. 62, and FIG. 63 are diagrams of an automatic switch control having two opposed solenoids that move the toggle of the switch in accordance with another example of the present teachings.

Figure 64:
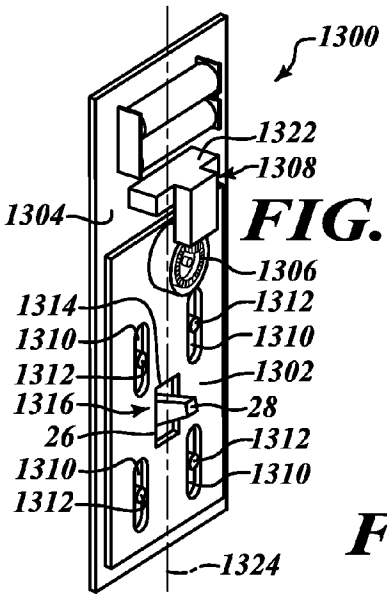

FIG. 64 is a diagram of an automatic switch control having a yoke member driven by a gear assembly in an elliptical fashion to move the toggle of the switch in accordance with a further example of the present teachings.

Figure 65:
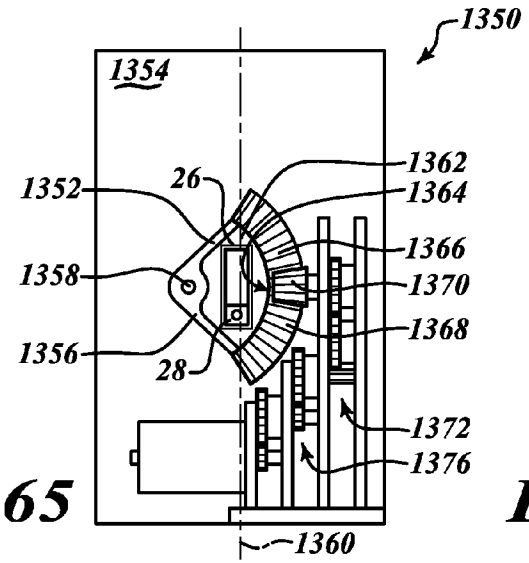

FIG. 65 is a diagram of an automatic switch control having a yoke member pivotally attached to a gear assembly that moves the toggle of the switch in accordance with yet another example of the present teachings.

Figure 66:
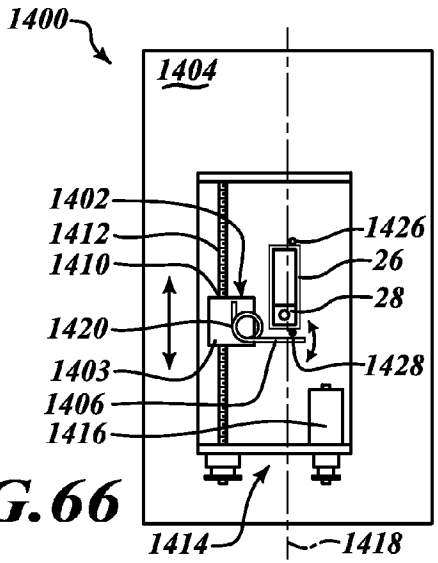

FIG. 66 is a diagram of an automatic switch control having a yoke member that moves longitudinally to wind up a spring member to move the toggle of the switch in accordance with another example of the present teachings.

Figure 68:
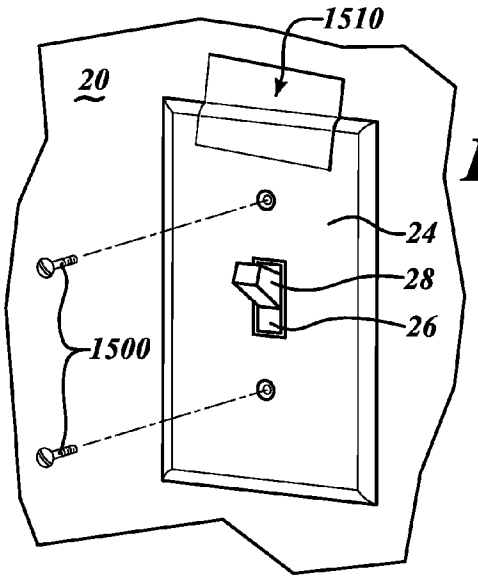
Figure 69:
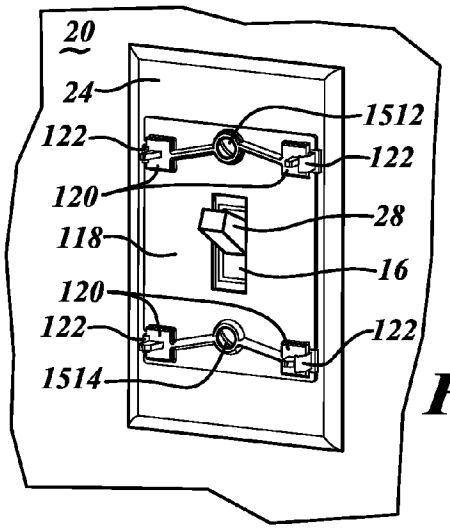
Figure 67:
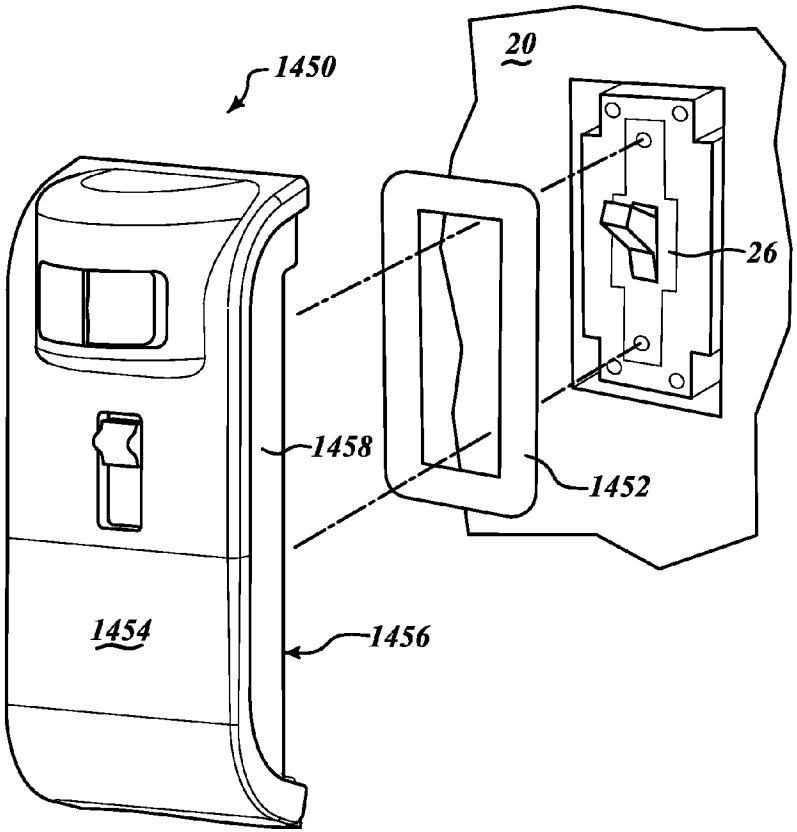

FIG. 67, FIG. 68, and FIG. 69 are partial exploded assembly views of an automatic switch control having connection means to connect a housing of the automatic switch control to the switch on the wall in accordance with the present teachings.

DETAILED DESCRIPTION

The following description is merely exemplary in nature and is not intended to limit the present teachings, their application, or uses. It should be understood that throughout the drawings, corresponding reference numerals indicate like or corresponding parts and features.

Examples are provided so that this disclosure will be thorough, and will fully convey the scope to those who are skilled in the art. Numerous specific details are set forth such as examples of specific components, devices, and methods, to provide a thorough understanding of the teachings of the present disclosure. It will be apparent to those skilled in the art that specific details need not be employed, that example embodiments may be embodied in many different forms, and that neither should be construed to limit the scope of the teachings. In some examples, well-known processes, well-known device structures, and well-known technologies are not described in detail.

The terminology used herein is for the purpose of describing particular examples only and is not intended to be limiting. As used herein, the singular forms "a," "an," and "the" may be intended to include the plural forms as well, unless the context clearly indicates otherwise. The terms "comprises," "comprising," "including," and "having" are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood in light of the disclosure that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers, and/or sections, these elements, components, regions, layers, and/or sections should not be limited by these terms. These terms may be only used to distinguish one element, component, region, layer or section from another element, component, region, layer, or section. Terms such as "first," "second," and other numerical terms when used herein do not imply a sequence or order unless clearly indicated by the context. Thus, a first element, component, region, layer, or section discussed herein could be termed a second element, component, region, layer, or section without departing from the teachings of the disclosure.

Spatially relative terms, such as "inner," "outer," "beneath", "below," "lower," "above," "upper," "front," "rear," "beneath," and the like, may be used herein for ease of description to describe one element or feature's relationship to another element or feature as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
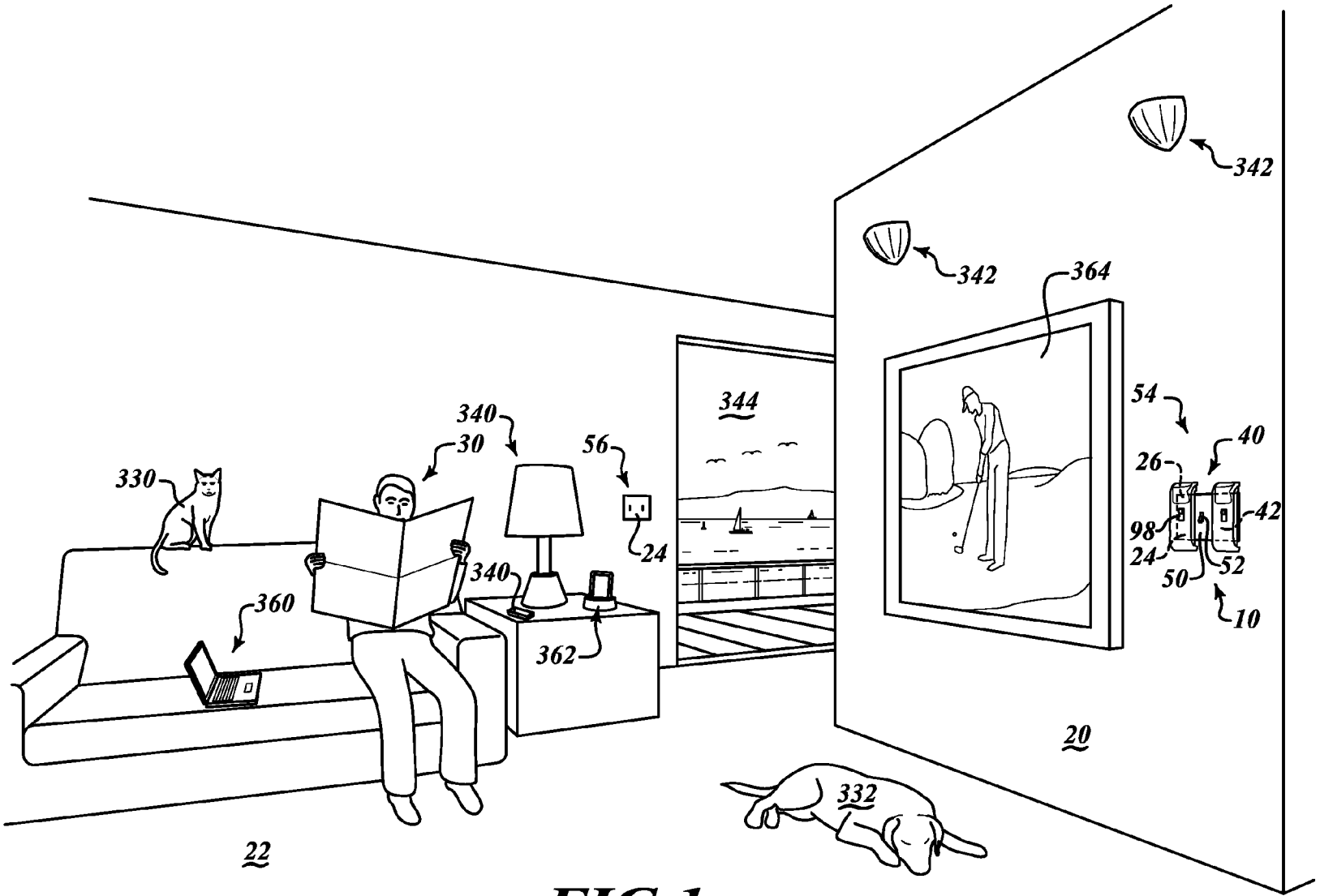
FIG. 1 is a perspective view of an automatic switch control mounted on a switch on a wall that can provide access to an adjacent switch and another automatic switch control mounted next to the adjacent switch in accordance with the present teachings.
Figure 2:
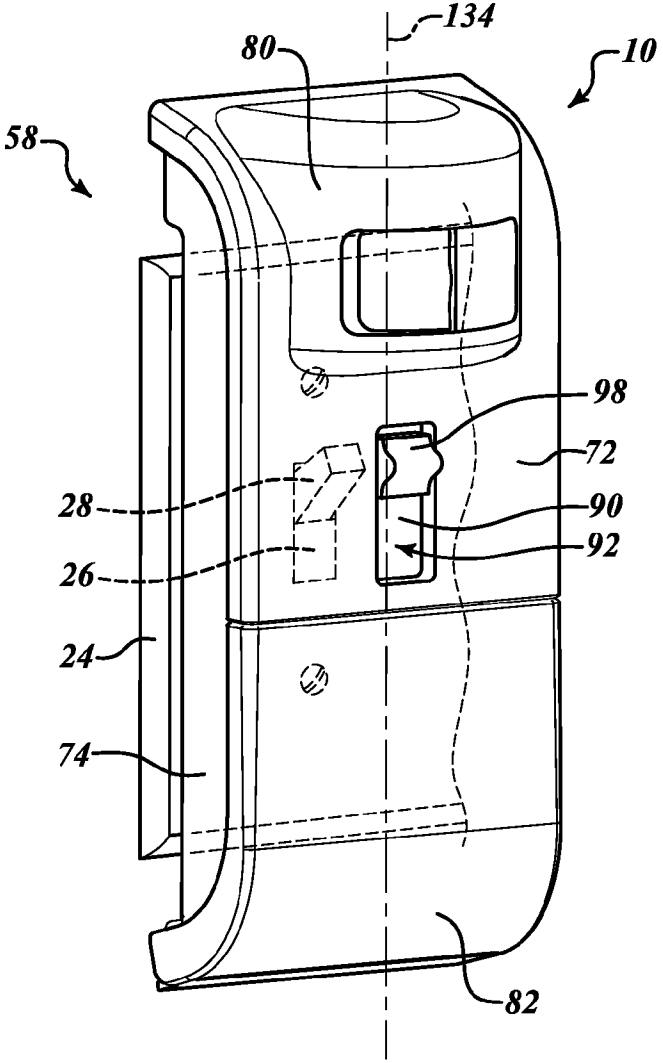
FIG. 2 is a front perspective view of the automatic switch control of FIG. 1 in accordance with the present teachings.

With reference to FIG. 1 and FIG. 2, an automatic switch control 10 can be mounted on a wall 20 of a room 22. The automatic switch control 10 can connect to the wall 20 over a switch plate 24 that can already be installed over a switch 26 having a toggle 28, as is known in the art. The automatic switch control 10 can turn the switch 26 on and off by moving the toggle 28 to an on position (e.g., FIG. 2) and an off position (e.g., FIG. 3), respectively. As described herein, a user 30 can rely on the automatic switch control 10 to move the toggle 28 to the on position or the off position in response to one or more signals and/or circumstances (singular or in combination) that can be sensed by the automatic switch control 10. Further, responses by the automatic switch control 10 based on the one or more signals and/or circumstances can be programmed and re-programmed by the user 30. The many signals and/or circumstances can include but are not limited to the detection or lack of detection of motion, heat, sound, ambient light, expiration of time, a signal from a wireless transmitter, and/or a signal from a computer network.

The automatic switch control 10 can be used with a second automatic switch control 40 with switches ganged next to one another. For example, the automatic switch control 10 and the automatic switch control 40 can both be mounted to the switch plate 24 and the automatic switch control 40 can control a toggle (not shown) of a switch 42 in a similar fashion to the automatic switch control 10. The automatic switch control 10 can be mounted over the switch plate 24 to interface with the switch 26 on the wall 20 and the automatic switch control 40 can also be mounted on the switch plate 24 to interface with the switch 42, or vice versa. The automatic switch control 10 and the automatic switch control 40 can be mounted in a generally horizontal fashion and provide access to a switch 50 that can be in between the switch 26 and the switch 42. It will be appreciated in light of the disclosure that the automatic switch control 10, 40 can be installed over a single switch or multiple switches in a multi-switch installation such as a three-gang switch installation 54, a two-gang switch installation 56, or a single switch installation 58 (FIG. 2).

The automatic switch control 10 and the automatic switch control 40 can be installed in an abutting relationship when installed over the switch 26 and the switch 44 that are already installed adjacent to another or can be installed spaced from one another when the switch 26 and the switch 50 are similarly spaced from one another. The automatic switch control 10 and the automatic switch control 40 can be installed over one or more switches 26, 44, 50 in the three-gang switch installation 54 and in doing so can be shown to maintain access to the one or more switches that do not have the automatic switch control 10 installed over it, e.g., the switch 50 as illustrated in FIG. 1.

Figure 7:
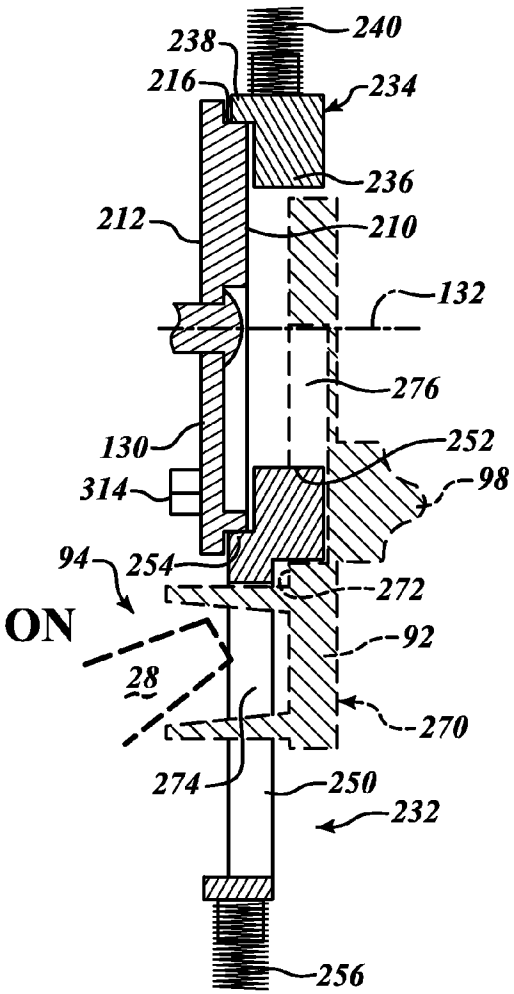
FIG. 6 through FIG. 12 are diagrams that show a progression of the automatic switch control of FIG. 2 moving a toggle of the switch between the on position and the off position in accordance with the present teachings.
Figure 8:
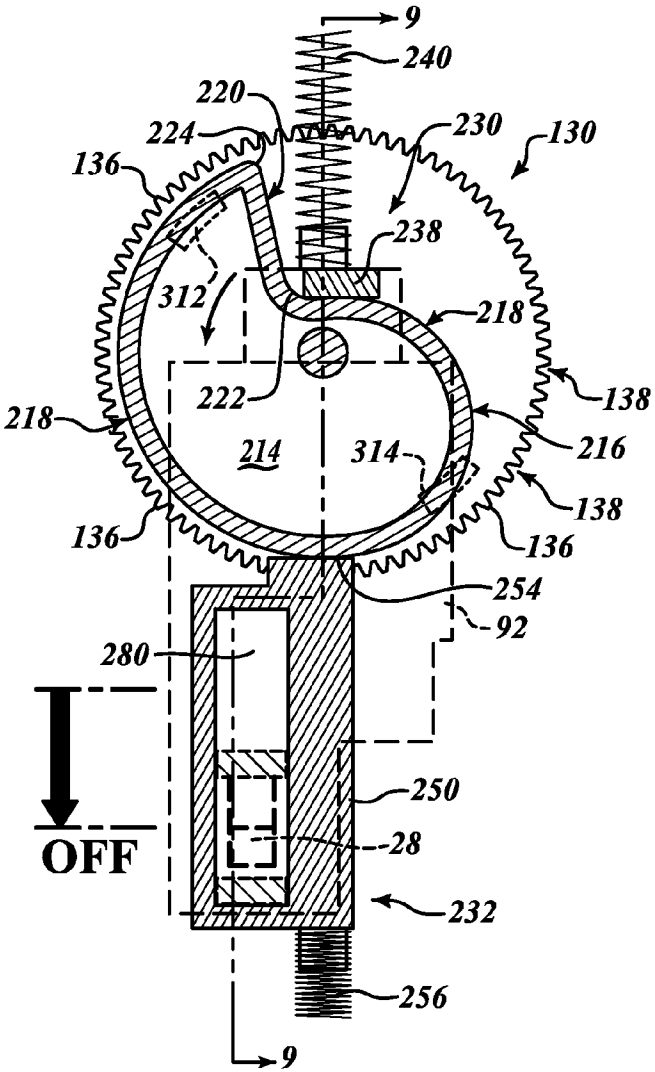

With reference to FIG. 5 through FIG. 11, the toggle 28 on the switch 26 can have a range of motion 60 that can be bounded by the on position (e.g., FIG. 6) and on an opposite side bounded by the off position (e.g., FIG. 8). The range of motion 60 can define an entirety of an area in which the toggle 28 can move between the on position and off position. The switch 26 can also have a middle position 62 (FIG. 11) between the on position and the off position. The switch 26, using a spring or suitable flexible member (not shown), can complete movement of the toggle 28 to the on position or to the off position. As such, the user 30 need not move the toggle 28 completely to the on position or completely to the off position because it can be shown that the user 30 can leave the toggle 28 in one of two intermediate positions. The first intermediate position can be a portion of the area of the range of motion 60 between the middle position 62 and the on position. The second intermediate position can be a portion of the area of the range of motion 60 between the middle position 62 and the off position. It can be shown that when the toggle 28 is left in either the first intermediate position or the second intermediate position, the switch 26 can return the toggle 28 to the on position or the off position, respectively, without leaving the toggle 28 in the middle position 62.

While a portion of the area in the range of motion 60 that defines the middle position 62 is relatively small, leaving the toggle 28 in or near the middle position 62 can be shown to leave the switch 26 undesirably unable to complete the motion of the toggle 28 to the on position or the off position. In this regard, the automatic switch control 10 when installed over the switch 26 can be shown to move the toggle 28 to the on position and the off position but not leave the toggle 28 in the middle position 62 of the switch 26. By not leaving the toggle 28 in the middle position 62, the automatic switch control 10 can be shown to not leave the toggle 28 in the positions adjacent the middle position that could undesirably tease the connections of the switch 26. To the end, the automatic switch control 10, when installed over the switch 26, can also be shown to move the toggle 28 completely to the on position or to the first intermediate position that results in the switch 26 under its own power moving the toggle 28 to the on position. Also, the switch 26 under its own power can move the toggle 28 to completely the off position or to the second intermediate position that results in the toggle 28 being moved to the off position by the switch 26.

The automatic switch control 10, when not moving the toggle 28, can be shown to permit the user 30 to manually move the toggle 28 because the automatic switch control 10 is not engaged with the toggle 28 of the switch 26 to such an extent that manual movement would not be possible. In various examples, being disengaged from the toggle 28 can include completely avoiding contact with the toggle 28 when not moving the toggle 28 under the control of the automatic switch control. Being disengaged from the toggle 28 can also include having a portion of the automatic switch control 10 moving with the toggle 28 (e.g.: a yoke member 602 shown in FIG. 22), but this portion is otherwise disengaged from its respective drive mechanism and is able to move manually with the toggle 28. Being disengaged from the toggle 28 can further include having a portion of the automatic switch control 10 continue to move after it moves the toggle 28 so as to move to position that is no longer engaged with the toggle 28 to, in turn, permit manual movement of the toggle 28.

Figure 3:
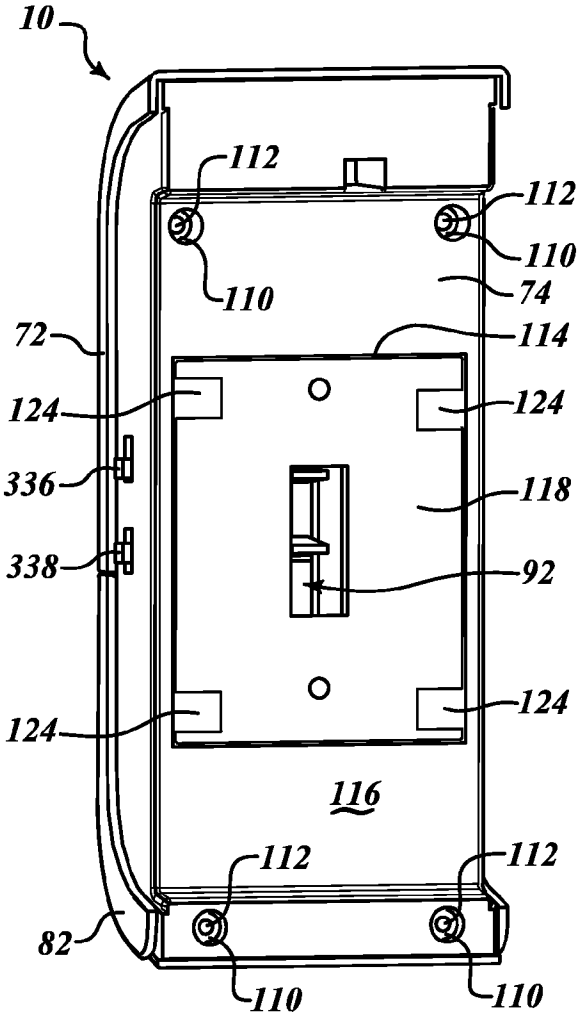
FIG. 3 is a rear perspective view of the automatic switch control of FIG. 2 showing a toggle mover member in accordance with the present teachings.
Figure 4:
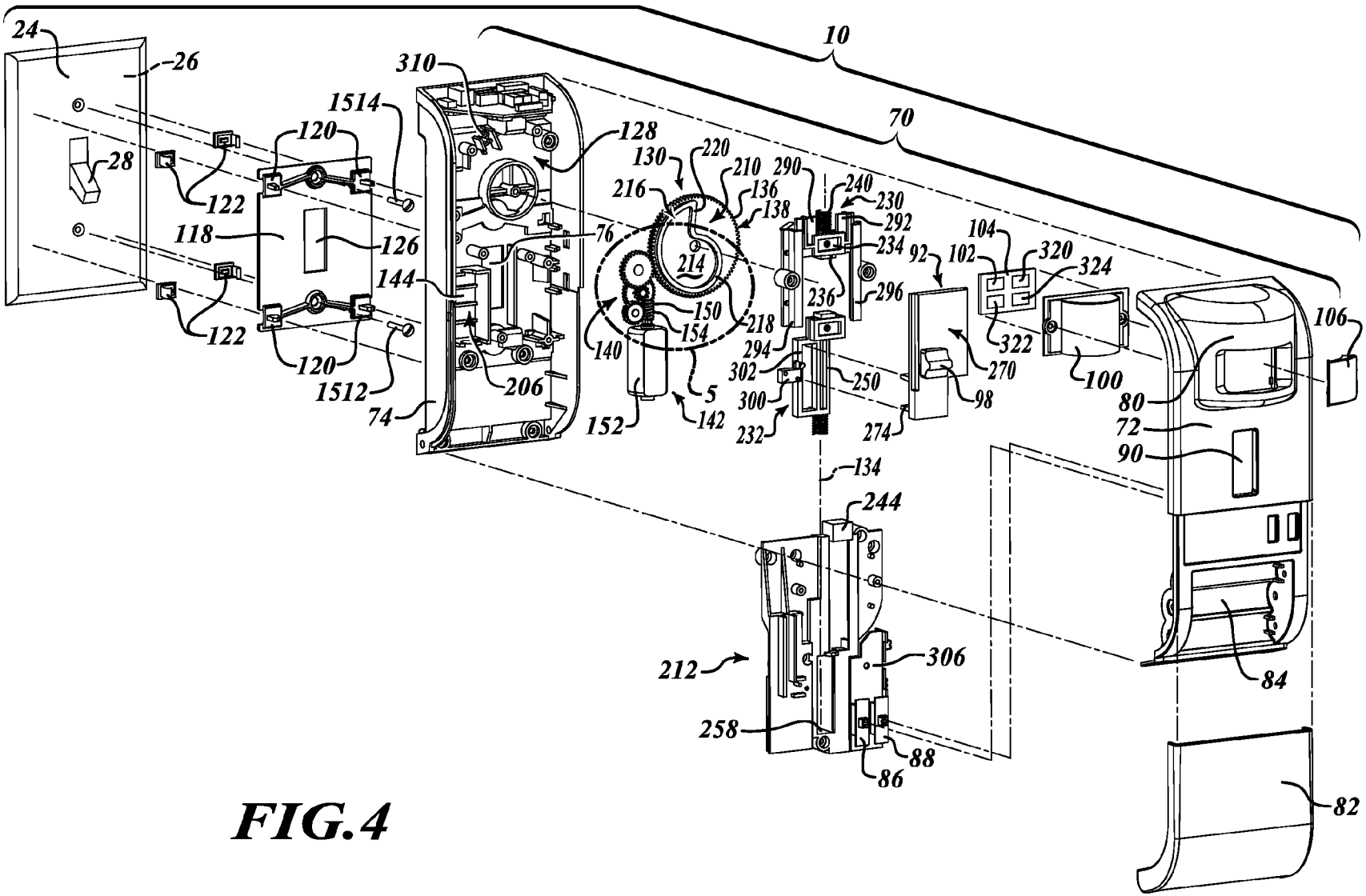
FIG. 4 is an exploded assembly view of the automatic switch control of FIG. 1 showing a wheel member in a housing that can activate first and second plunger mechanisms to turn off and turn on, respectively, the switch in accordance with the present teachings.
Figure 5:
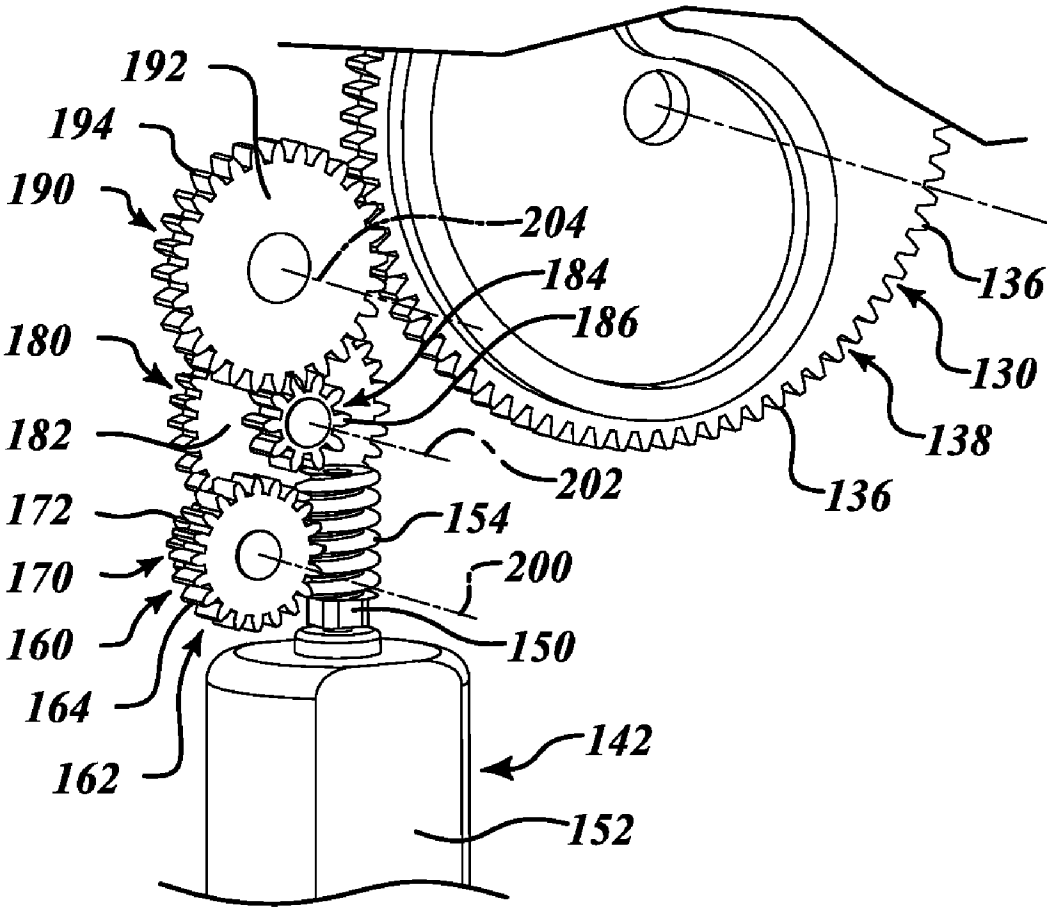
FIG. 5 is a partial view of the automatic switch control of FIG. 4 showing a wheel member in a housing that can activate the first and second plunger mechanisms in accordance with the present teachings.

With reference to FIG. 2, FIG. 3, and FIG. 4, the automatic switch control 10 can include a housing 70 having a front shell member 72 and a rear shell member 74 that can be secured together. The rear shell member 74 can connect to the switch plate 24 so the toggle 28 of the switch 26 can partially protrude through an aperture 76 formed in the rear shell member 74. The front shell member 72 can include a sensor housing 80 and a cover member 82. The cover member 82 can be pivotally mounted to the front shell member 72. The cover member 82 can be opened, and in doing so, can be pivoted away from the front shell member 72. When the cover member 82 is opened, the cover member 82 can reveal a holder member 84 that can hold one or more batteries or other suitable power source that can provide electrical power to the automatic switch control 10. The cover member 82, when opened, can also reveal a first input mechanism 86 and a second input mechanism 88 that the user 30 can use to modify functionality of the automatic switch control 10 as desired.

The front shell member 72 of the housing 70 can define an aperture 90 through which a portion of a manual actuator member 92 can protrude. The manual actuator member 92 can connect to the toggle 28 at a connection point 94 and can urge the toggle 28 between the on position and the off position. The connection point 94 between the manual actuator member 92 and the toggle 28 can be located entirely inside the housing 70 when the automatic switch control 10 is installed on the switch 26. In this regard, the connection point 94 is not visible to the user 30 when the automatic switch control 10 is installed on the switch 26. A portion of the manual actuator member 92 that can protrude from an aperture 96 formed on the front shell member 72 can include a handle portion 98. The handle portion 98 can be grasped by the user 30 to move the toggle 28 with the manual actuator member 92 through the entire range of motion 60 of the toggle 28.

With reference to FIG. 4, the sensor housing 80 can contain one or more sensor modules behind a lens member 100. The sensors can be used to detect, for example, motion, heat, ambient light, a signal from a wireless transmitter. The sensor housing 80 can also cover one or more light emitting modules 102 that can be used to indicate to the user 30 the detection or the lack thereof of motion, heat, ambient light, expiration of time, the signal from the wireless transmitter and/or the signal from the computer network. The light emitting module 102 can be a suitable light emitting diode that can be connected to a board member 104 that can be secured in the sensor housing 80. The light emitting modules 102 can also emit light to indicate to the user 30 that voltage can be low in the automatic switch control 10 such that further operation is best accomplished with replacement of the batteries. The light emitting modules 102 can also emit light to indicate to the user 30 that power consumption in the automatic switch control 10 is indicative of a jammed condition. In a jammed condition, the automatic switch control 10 can stop attempting to move the toggle 28 and with the light emitting modules 102 can indicate to the user that the jammed condition is present.

A blocker member 106 can be disposed over the lens member 100 in the sensor housing 80 to obscure a view of the one or more sensors inside the sensor housing 80. The blocker member 106 can be placed behind the sensor housing 80 in the housing 70 or can be connected to the sensor housing 80 outside of the housing 70. The user 30 can selectively move the blocker member 106 to change what views through the lens member 100 can be obscured by the blocker member 106.

With reference to FIG. 3, the rear shell member 74 of the housing 70 includes four apertures 110 that can accept fasteners 112 that can be used to secure the front shell member 72 of the housing 70 to the rear shell member 74. The rear shell member 74 can also define a mounting plate aperture 114 that can be recessed (partially or wholly) in a rear surface 116 of the rear shell member 74. The mounting plate aperture 114 can receive a mounting plate member 118 that can have connector members 120 that can secure the mounting plate member 118 to the rear shell member 74. The mounting plate member 118 can include four of the connector members 120 that can each include a clip 122. The clips 122 can releasably connect the connector members 120 to apertures 124 located in the mounting plate aperture 114 to connect the mounting plate member 118 to the rear shell member 74. The mounting plate member 118 can define an aperture 126 that can cooperate with the aperture 76 formed in the rear shell member 74 to accept the toggle 28 from the switch 26.

With reference to FIG. 2 and FIG. 4, a front surface 128 of the rear shell member 74 of the housing 70, can rotatably support a wheel member 130 that can spin around an axis of rotation 132. The axis of rotation 132 of the wheel member 130 can be generally perpendicular to a longitudinal axis 134 of the automatic switch control 10. The wheel member 130 can be disposed on the rear shell member 74 so that the wheel member 130 can be directly above the toggle 28 when the automatic switch control 10 is installed to the switch 26.

With reference to FIG. 4, the wheel member 130 can include gear teeth 136. The gear teeth 136 can be circumferentially spaced on an outer periphery 138 of the wheel member 130. The gear teeth 136 on the wheel member 130 can mesh with a gear assembly 140. A worm drive 142 can connect to the gear assembly 140 to rotate the wheel member 130 about the axis of rotation 132. The worm drive 142 and the gear assembly 140 can be positioned on a frame member 144 that can be formed from or be connected to the rear shell member 74.

The worm drive 142 can include an output shaft 150 that can be selectively rotated by an electric motor 152 controlled by the automatic switch control 10. The output shaft 150 can have gear teeth 154 and can engage the gear assembly 140. The output shaft 150 can be positioned to be generally parallel to the longitudinal axis 134 of the automatic switch control 10 and can also be generally parallel to a direction of travel defined by the range of motion 60 of the toggle 28.

With reference to FIG. 4, the drive member of the output shaft 150 can connect to a first gear member 160. The first gear member 160 can include a first periphery 162 having gear teeth 164 that engage with the output shaft 150. For example, the first gear member 160 can be a round spur gear that can connect to the output shaft 150 that can have longitudinally arranged helical gear teeth. The first gear member 160 can also include a second periphery 170 having gear teeth 172 that can engage with a first periphery 180 on a second gear member 182. The second gear member 182 can include a second periphery 184 that can have gear teeth 186. The second periphery 184 of the second gear member 182 can engage a first periphery 190 on a third gear member 192. The first periphery 190 on the third gear member 192 can have gear teeth 194 that can mesh with the gear teeth 186 on the second periphery 184 of the second gear member 182 and can also mesh with the gear teeth 136 on the wheel member 130.

The gear members 160, 182, 192 can be rotatably supported by the frame member 144 that is connected to the housing 70. Each of the gear members 160, 182, 192 can define an axis of rotation 200, 202, 204, respectively, that can be parallel to the axis of rotation 132. The frame member 144 can cooperate with the rear shell member 74 to form a housing 206 around the electric motor 152. The wheel member 130 can have a front surface 210 and a rear surface 212. When the automatic switch control 10 is installed over the switch 26, the rear surface 212 of the wheel member 130 can face the toggle 28 of the switch 26. The front surface 210 of the wheel member 130 can include a cam member 214 that can be located on an opposite side of the wheel member 130 from the toggle 28 of the switch 26.

The cam member 214 can define a ramp surface 216. The ramp surface 216 can include a round portion 218 that can continuously connect with a flat portion 220. In this regard, a total of 360 degrees of rotation of the ramp surface 216 can include the flat portion 220, a transition 222 between the flat portion 220 and the round portion 218, the round portion 218, and a transition 224 between the round portion 218 and the flat portion 220. Distances can be defined between circumferential positions on ramp surface 216 and the axis of rotation 132. These distances can vary at different circumferential positions of the wheel member 130. Put another way, the physical distance between the axis of rotation 132 and the ramp surface 216 remains constant, but an observer watching rotation of the wheel member 130 from a fixed location away from the axis of rotation 132 can observe the ramp surface 216 advancing toward them during the round portion 218 and then retreating away from them during the flat portion 220.

A first plunger mechanism 230 can be disposed above the wheel member 130 and a second plunger mechanism 232 can be disposed beneath the wheel member 130. The wheel member 130 can be disposed above the toggle 28 of the switch 26 when the automatic switch control 10 is installed on the switch 26. When the automatic switch control 10 is installed on the switch 26, the first plunger mechanism 230 can be disposed immediately above the on position of the toggle 28 and can thus move the toggle 28 of the switch 26 to the off position. The second plunger mechanism 232 can be disposed immediately below the off position of the toggle 28 and thus can move the toggle 28 of the switch 26 to the on position. The first plunger mechanism 230 and the second plunger mechanism 232 can be in vertical alignment with each other, with the longitudinal axis 134 and with the toggle 28 of the switch 26, when the automatic switch control 10 is installed over the switch 26.

The first plunger mechanism 230 can include a post member 234 having a head portion 236 and a cam follower 238. The first plunger mechanism 230 can also include a spring member 240 that can connect the post member 234 to a mechanism housing 242 having a stop member 244. The spring member 240 can urge the post member 234 from a retracted condition to an extended condition. The spring member 240 can bias the post member 234 toward the toggle 28 of the switch 26 and toward the second plunger mechanism 232. The cam follower 238 of the post member 234 can ride the ramp surface 216 of the cam member 214 as the wheel member 130 rotates. By riding the round portion 218 of the ramp surface 216, the cam follower 238 can urge the post member 234 of the first plunger mechanism 230 to the retracted condition. In doing so, the automatic switch control 10 can load (or further load) the spring member 240 When the cam follower 238 encounters the flat portion 220, the flat portion 220 of the ramp surface 216 can also permit the first plunger mechanism 230 to move to the extended condition and unload the spring member 240.

The second plunger mechanism 232 can include a post member 250 having a head portion 252 and a cam follower 254. The second plunger mechanism 232 can also include a spring member 256 that connects the post member 250 to the mechanism housing 242 having a stop member 258. The spring member 256 can urge the post member 250 from a retracted condition to an extended condition. The spring member 256 can bias the post member 250 toward the toggle 28 of the switch 26 and toward the first plunger mechanism 230. The cam follower 254 of the second plunger mechanism 232 can also ride the ramp surface 216 of the cam member 214 as the wheel member 130 rotates. By riding the ramp surface 216, the cam follower 254 can urge the post member 250 of the second plunger mechanism 232 to the retracted condition and load the spring member 256. When the cam follower 254 encounters the flat portion 220, the flat portion 220 of the ramp surface 216 can also permit the second plunger mechanism 232 to move to the extended condition and unload the spring member 256.

Figure 6:
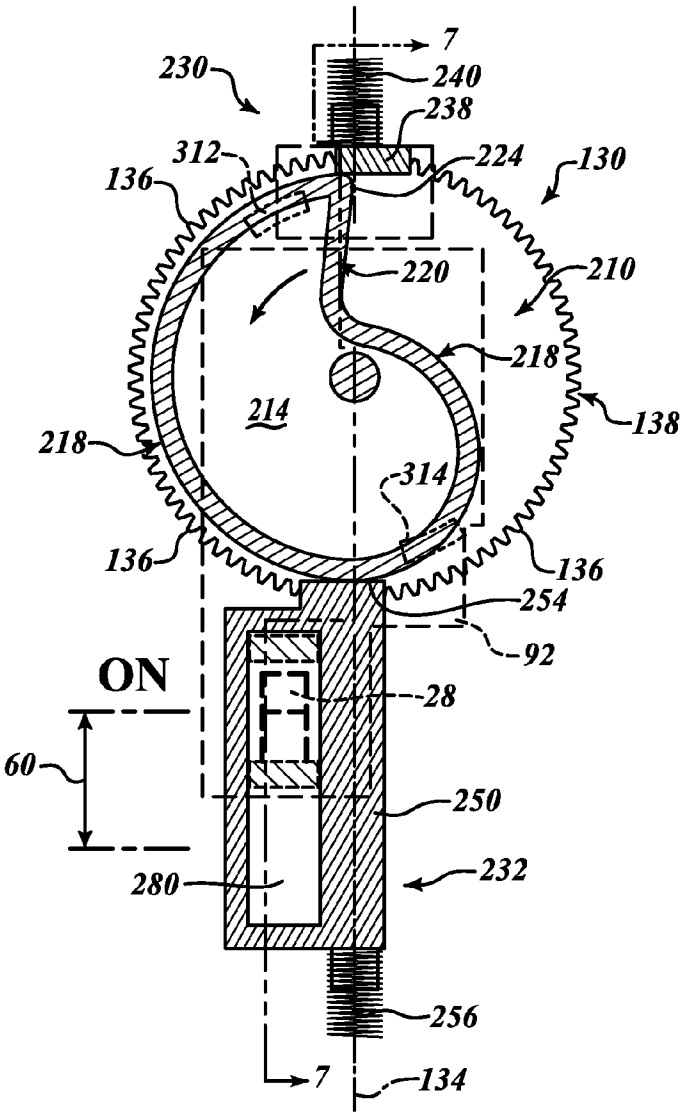
Figure 9:
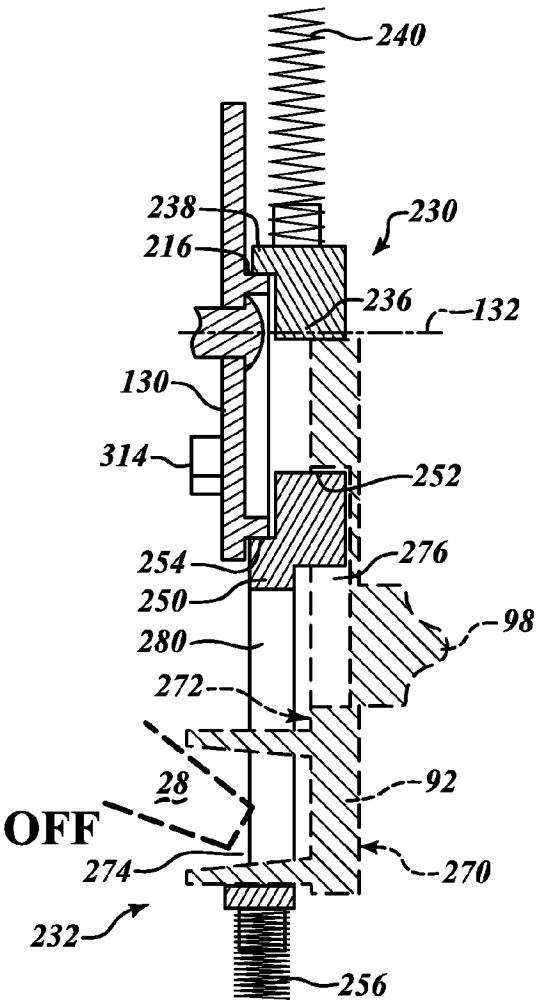

In this arrangement, the distance between the ramp surface 216 of the cam member 214 and the axis of rotation 132 of the wheel member 130 can control the position of the post members 234, 250 of the first and second plunger mechanisms 230, 232. With reference to FIG. 6 and FIG. 7, the wheel member 130 can be in a rotational position where a maximum distance between the ramp surface 216 and the axis of rotation 132 can be disposed immediately beneath the first plunger mechanism 230 to keep the post member 234 of the first plunger mechanism 230 in the retracted condition. With reference to FIG. 8 and FIG. 9, the wheel member 130 can continue to rotate and be in a rotational position where a minimum distance between the ramp surface 216 and the axis of rotation 132 can be disposed immediately beneath the first plunger mechanism 230. Because the flat portion 220 of the ramp surface 216 continues to rotate out of an obstructing position with the cam follower 238, the cam follower 238 can be free to fall along the along the flat portion 220 as the spring member 240 can be permitted to move the post member 234 to the extended condition. It will be appreciated in light of the disclosure that the cam follower 238 can disconnect from the ramp surface 216 as the flat portion 220 rotates past the cam follower 238 and the post member 234 can be thrust toward the manual actuator member 92 without any obstruction from any portion of the wheel member 130.

Figure 11:
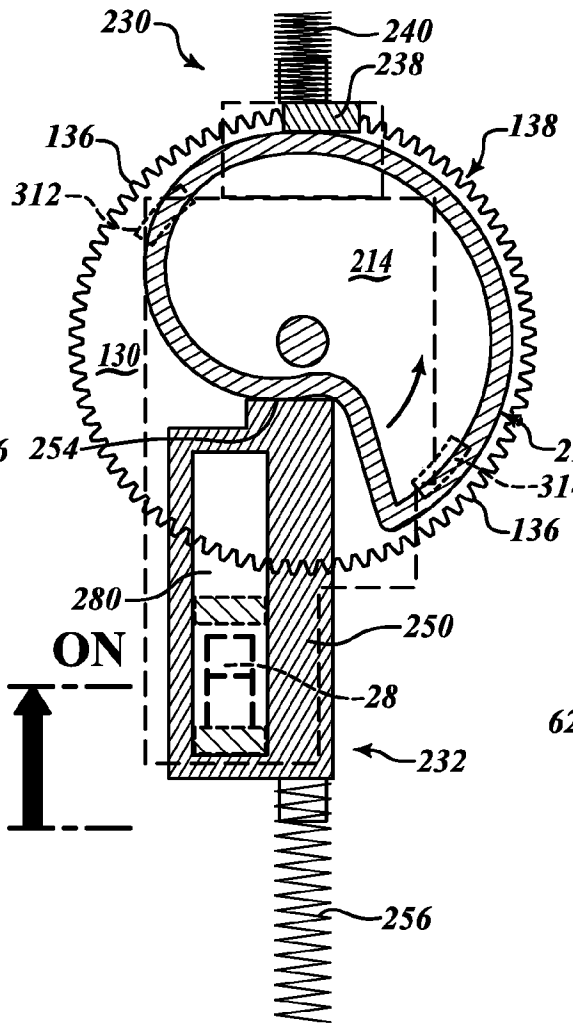
Figure 10:
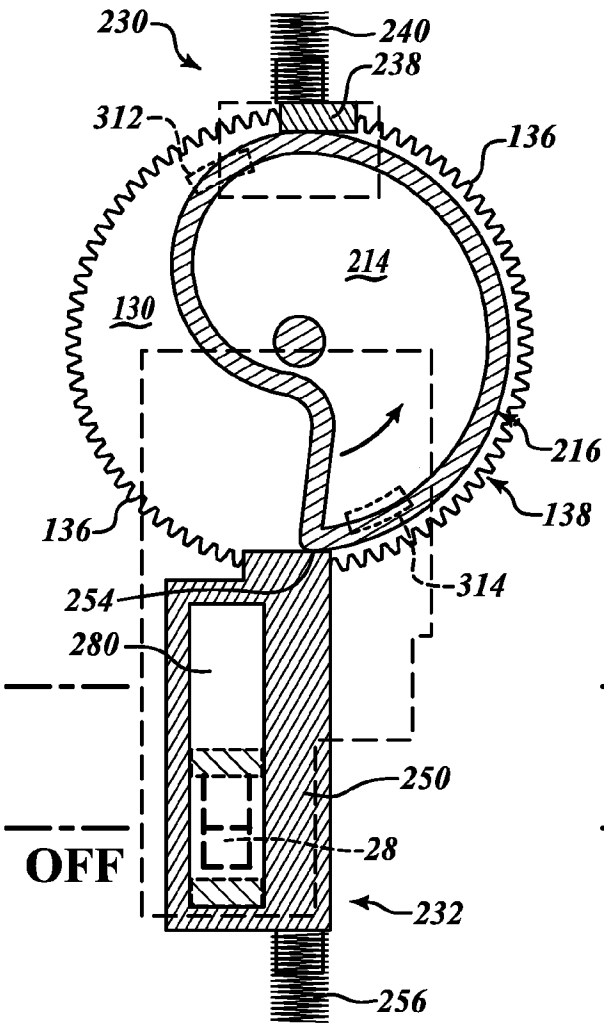

With reference to FIG. 10, the wheel member 130 can also be in a rotational position where the maximum distance between the ramp surface 216 and the axis of rotation 132 can be disposed immediately above the second plunger mechanism 232 to keep the post member 250 of the second plunger mechanism 232 in the retracted condition. With reference to FIG. 11, the wheel member 130 can be in a further rotational position where the minimum distance between the ramp surface 216 and the axis of rotation 132 can be disposed immediately beneath the second plunger mechanism 232 as the flat portion 220 rotates by. This can permit the spring member 256 to move the post member 250 to the extended condition because the cam follower 254 is not obstructed by the flat portion 220 of the ramp surface 216.

Furthermore and with reference to FIG. 6 and FIG. 10, the wheel member 130 can be in a rotational position where the maximum distance between the ramp surface 216 and the axis of rotation 132 can be disposed immediately beneath the first plunger mechanism 230 and also can be disposed immediately beneath the second plunger mechanism 232 to keep the first plunger mechanism 230 and the second plunger mechanism 232 in the retracted condition.

Figure 12:
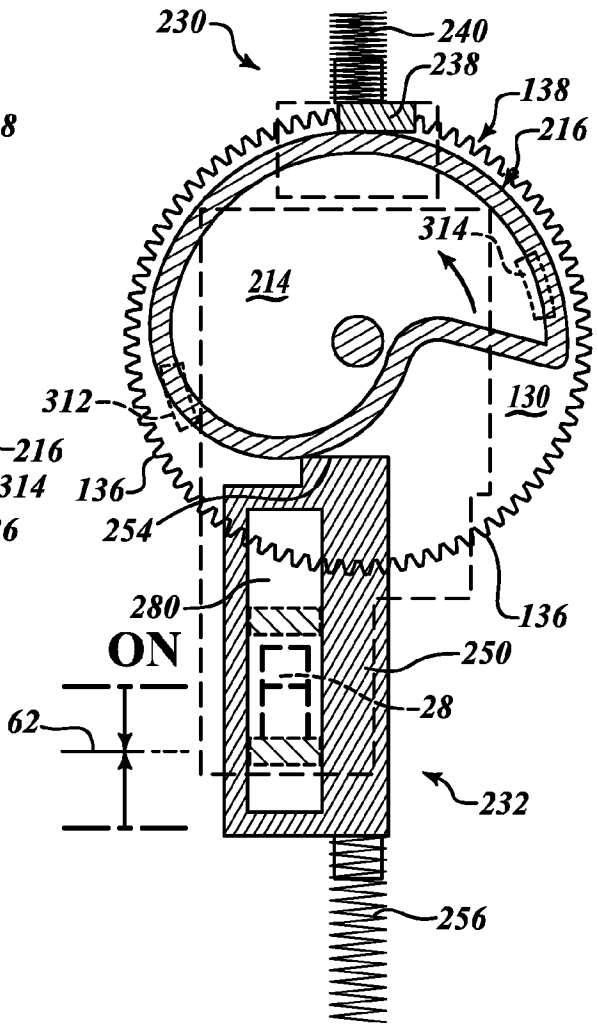

With reference to FIG. 12, the ramp surface 216 can be configured to relatively gradually return the first plunger mechanism 230 and the second plunger mechanism 232 to their respective retracted conditions relative to the speed at which the first and second plunger mechanisms 230, 232 move into the extended condition. In this regard, the flat portion 220 of the ramp surface 216 can be such that from the fixed location, the distance between the ramp surface 216 and the axis of rotation 132 can quickly decrease as the wheel member 130 rotates. After the flat portion 220, a rate at which the distance increases for the round portion 218 of the ramp surface 216 can be slower compared to a rate at which the distance decreases over the flat portion 220. As such, the automatic switch control 10 can move the post members 234, 250 of the first and second plunger mechanisms 230, 232, respectively, to the retracted conditions at the rate that can be relatively slower than the rate that the flat portion 220 of the ramp surface 216 can permit the post members 234, 250, respectively, to move to the extended condition.

With the above in mind, the flat portion 220 of the ramp surface 216 can be configured to quickly allow the first plunger mechanism 230 and the second plunger mechanism 232 to move the post members 234, 250, respectively to the extended condition. In doing so, the flat portion 220 of the ramp surface 216 can be rotated so that flat portion 220 can move to the side of the cam follower 238, 254 (i.e., do not obstruct the cam followers) allowing the spring member 240, 256 to push the post member 234, 250 to the extended condition. The motion of the post member 234, 250 can terminate as the cam follower 250, 254 can come back into contact with the round portion 218 of the ramp surface 216. Being able to extend past the flat portion 220 of the ramp surface 216 without obstruction from the ramp surface 216 can be shown to increase an impulse that is delivered by the post member 234, 250 to the manual actuator member 92 and ultimately to the toggle 28 of the switch 26. Put another way, the post members 234, 250 of the first and second plunger mechanisms 230, 232, respectively, can burst out of their housing 242, 258 to move to the extended condition when the flat portion rotates beyond the post members 234, 250. When the cam member 214 on the wheel member 130 moves the post member 234, 250 back to the retracted condition, the movement back to the retracted condition can be done more slowly relative to the movement into the extended condition.

As the wheel member 130 can permit the first and second plunger mechanisms 230, 232 to move into the extended condition, the post member 234, 250 of the first and second plunger mechanisms 230, 232 can extend toward the manual actuator member 92 and can strike the manual actuator member 92 with the head portion 236, 252 of the first or second plunger mechanisms 230, 232, respectively, to move the toggle 28 to the on position or to the off position. It will be understood in light of the disclosure that the manual actuator member 92 can move with the toggle 28 of the switch 26 between the on position and the off position. This motion can be accomplished while the post member 250 is held in the retracted condition by the ramp surface 216.

The manual actuator member 92 can include a front surface 270 and a rear surface 272. The front surface 270 can include the handle portion 98 that can extend from the front surface 270 out of the aperture 96 in the front shell member 72 of the housing 70. The rear surface 272 can be closer to the switch 26 than the front surface 270 when the automatic switch control 10 installed over the switch 26. The manual actuator member 92 can also include a toggle mover member 274 that can extend from the rear surface 272 of the manual actuator member 92. The manual actuator member 92 can also include a channel portion 276 formed in the rear surface 272. The channel portion 276 can slidingly accept the head portion 252 of the second plunger mechanism 232.

In addition, the post member 250 can define a slot portion 280. The slot portion 280 can accept the toggle mover member 274 that can extend from the rear surface 272 of the manual actuator member 92. The toggle mover member 274 can move in the slot portion 280 formed in the post member 250 to move the toggle 28 between the on position and the off position. In this arrangement, the manual actuator member 92 can grab the toggle 28 with the toggle mover member 274 that is in itself disposed through the slot portion 280 formed in the post member 250. The toggle mover member 274 can move between the on position and the off position with the toggle 28 while the post member 250 of the second plunger mechanism 232 can continue to be held in the retracted condition.

With reference to FIG. 4, the post member 234 of the first plunger mechanism 230 can include a first rail member 290 and a second rail member 292. The first rail member 290 can be connected to a first slide member 294 that can be connected to the mechanism housing 242. The second rail member 292 can also be connected to a second slide member 296 that can be connected to the mechanism housing 242. The first rail member 290 can be slidably supported by the first slide member 294 and the second rail member 292 can be slidably supported by the second slide member 296. In this regard, the first slide member 294 and the second slide member 296 can permit the post member 234 to move in a direction generally parallel to the longitudinal axis 134 between the retracted condition and the extended condition. In the extended condition, the post member 234 can travel down the first and second slide members 294, 296 so the head portion 236 can contact the manual actuator member 92 to move the toggle 28 of the switch 26 to the off position.

The post member 250 of the second plunger mechanism 232 can be slidably supported by the mechanism housing 242. The mechanism housing 242 can permit the post member 250 to travel in a direction that is parallel to the longitudinal axis 134 between the extended condition and the retracted condition. In the extended condition, the post member 250 can travel upward so the head portion 252 can contact the manual actuator member 92 to move the toggle 28 of the switch 26 to the on position.

The automatic switch control 10 can also include a position sensor 300 that can be connected to the mechanism housing 242 and can interact with a marker 302 on the manual actuator member 92. The position sensor 300 can communicate with a control module 306 contained in the housing 70 that can also control the electric motor 152. For example, the position sensor 300 can be a two-position switch where one position can correspond to the manual actuator member 92 being in the on position with the toggle 28, while the second position can correspond to the manual actuator member 92 being in the off position with the toggle 28. The position sensor 300 can also take the form of a hall-effect sensor, a light detection sensor or other suitable position or motion detection sensors. The marker 302, for example, can be a physical protrusion formed on the front surface 270 of the manual actuator member 92 that can interact with the position sensor 300. By way of the above examples, the protrusion on the manual actuator member 92 can move the two-position switch between its first and second position to indicate whether the toggle 28 with the manual actuator member 92 connected thereto is in the off position or the on position. In a further example, the position sensor 300 can be implemented as two limit switches, so that one of the limit switches can detect when the toggle 28 is in the on position, while the other limit switch can detect when the toggle 28 is in the off position. By way of this example, when the toggle 28 is in an in-between position, i.e., a fault position, neither of the limit switches will detect the manual actuator member 92 and in doing so the in-between position can be detected.

The automatic switch control 10 can also include a position sensor 310 connected to the rear shell member 74 that can interact with a marker 312 and a marker 314 on the wheel member 130. The position sensor 310 can also communicate with the control module 306 contained in the housing 70. In one example, the position sensor 300 can be a switch that can detect the marker 312, 314 as the marker 312, 314 can rotate past the position sensor 310. The position sensor 310 can also take the form of a hall-effect sensor, a light detection sensor or other suitable position or motion detection sensors. In addition, the position sensor 310 can be associated with the electric motor 152 such that information descriptive of the radial position of the wheel member 130 can be determined by monitoring power consumed by the electric motor.

The marker 312, 314 can be a physical protrusion formed on the rear surface 212 of the wheel member 130 opposite the front surface 210 on which the cam member 214 resides. The marker 312, 314 can be formed from or connected to the wheel member 130 and can be formed in a partial round shape that can approximate the curvature of the wheel member 130. The marker 312 can be radially opposed to the marker 314 so as to be on the opposite sides of the axis of rotation 132.

With reference to FIG. 4, FIG. 6, and FIG. 7, the marker 312 can contact the position sensor 310 to indicate to the control module 306 to stop rotation of the wheel member 130 in the position where the round portion 218 of the ramp surface 216 is holding both the first and the second plunger mechanisms 230, 232 in the retracted condition. In the same position, the flat portion 220 of the ramp surface 216 can be located such that when the wheel member 130 begins to rotate, the flat portion 220 of the ramp surface 216 will almost immediately rotate past the cam follower 238 of the post member 234 and into an unobstructed position. This can allow the post member 234 to burst out and contact the manual actuator member 92 to move the toggle 28 to the off position.

With reference to FIG. 4 and FIG. 10, the marker 314 can contact the position sensor 310 to indicate to the control module 306 to stop rotation of the wheel member 130 in the position where the round portion 218 of the ramp surface 216 is also holding both the first and the second plunger mechanisms 230, 232 in the retracted condition. In this rotational position, the flat portion 220 can be located such that the flat portion 220 of the ramp surface 216 will almost immediately rotate past the cam follower 254 of the post member 250. As such, the flat portion 220 of the ramp surface 216 can move into an unobstructed position that can allow the post member 250 to burst out and contact the manual actuator member 92 to move the toggle 28 to the on position.

With reference to FIG. 4, the sensor housing 80 on the housing 70 can contain and provide a view for one or more sensor modules. The one or more sensor modules can include a motion detecting module 320, a light detecting module 322, and an RF detecting module 324 that can be connected to the board member 104. The motion detecting module 320 can detect motion through the lens member 100 on the sensor housing 80. The motion detecting module 320 can be configured to detect motion of the user 30 and/or any other human individuals. The motion detecting module 320 can also be configured to detect motion of certain pets such as a cat 330, a dog 332, or other similar animals, as shown in FIG. 1.

In contrast, the automatic switch control 10 can be configured by the user 30 to ignore the motion of certain pets. With reference to FIG. 1, the user 30 can configure the automatic switch control 10 so that the motion detecting module 320 can, for example, detect an average size human but ignore motion of smaller animals such as the cat 330 and/or the dog 332. In doing so, the user 30 can configure the automatic switch control 10 by selecting a threshold for size the motion detecting module 320. The threshold for size for example can be about 20 pounds or about 10 kilograms. The automatic switch control 10 can be provided to the user 30 already configured with appropriate increments of size shown by numerical markings and/or appropriate icons to make it relatively easy for the user 30 to configure the threshold size level.

With reference to FIG. 1 and FIG. 4, the motion detecting module 320 can be configured to detect motion in one or more ways including detecting sound waves, sound levels, heat, interruptions of light, and/or one or more combinations thereof. For example, the motion detecting module 320 can emit light that can be sensed by a separate sensor or reflected back to the automatic switch control 10 so that interruption of the light can be a proxy for motion. In other examples, the motion detecting module 320 can emit ultrasonic acoustic waves. A change in acoustic signature in the room 22 can be a proxy for motion.

In further examples, the motion detecting module 320 can detect changes in the infrared spectrum by sensing heat. A change in the heat levels in the room 22 can be a proxy for motion. In this example, the user 30 can configure the size threshold so that the motion detecting module 320 can ignore a smaller thermal mass (e.g., the cat 330) but not ignore the user 30. The motion detecting module 320 can also transmit suitable electromagnetic waves and determine the time it takes the electromagnetic waves to reflect back to the motion detecting module 320. In this regard, changes in the timing of the return of the reflection of the electromagnetic wave can be a proxy for motion. To further reduce power consumption, the detection of motion can be temporarily discontinued for a certain time period or entirely once motion has been detected. The motion detection can also be discontinued temporarily to avoid too frequent turning on or turning off of the switch 26. In this regard, after the automatic switch control 10 has moved the toggle 28 due detection of motion once, further detection can be delayed for a predetermined amount of time. For example, the predetermined amount of time can be thirty seconds, one minute, two minutes, five minutes, etc. Moreover, the delay of further motion detection can be set and re-set by the user 30.

The automatic switch control 10 can also delay moving the toggle 28 to the off position after being recently moved to the on position by the automatic switch control 10. In doing so, the automatic switch control 10 can ignore any inputs for a delay period that would otherwise cause the automatic switch control 10 to move the toggle to the off position. For example, the delay period can be thirty seconds, one minute, two minutes, five minutes, etc. Moreover, the delay period can be set and re-set by the user 30.

The light detecting module 322 can detect an ambient light level in the room. Light from a room light such as a lamp 340 or wall lights 342 can contribute to the ambient light level as well as light from windows 344 in the room 22. The automatic switch control 10 can be configured by the user 30 to detect or ignore the ambient light level. The automatic switch control 10 can also be configured by the user 30 to set a threshold for the ambient light level and whether to ignore other inputs to move the toggle 28 of the switch 26. The inputs can be ignored for a certain time period or entirely when the ambient light level is above the threshold. For example, when the light detecting module 322 detects the ambient light level as being higher than the threshold, the automatic switch control 10 can ignore signals from other sensor modules that would result in turning the switch 26 on by moving the toggle 28 to the on position when the automatic switch control 10 is installed. Put another way, the light detecting module 322 can cause the automatic switch control 10 to ignore a signal to turn on the switch 26 when connected to one or more lights in the room because the room 22 is already full of light.

The automatic switch control 10 can further be configured by the user 30 to set a threshold for the ambient light level that when exceeded can cause the automatic switch control 10 to move the toggle 28 to the off position. For example, when the light detecting module 322 detects the ambient light level as being higher than the threshold, the automatic switch control 10 can move the toggle 28 to the off position because the room 22 is already full of light and any additional lights to which the automatic switch control 10 could be connected would not be needed.

The RF detecting module 324 can detect radio frequency communications from one or more remote devices to cause the automatic switch control 10 to move the toggle 28 of the switch 26. For example, the user 30 can use a remote control 346. With the remote control 346, the user 30 can command the automatic switch control 10 to turn the switch 26 to the on position or to the off position. The remote control 346 can be configured so that one input from the user 30 can cause the automatic switch control 10 to move the toggle 28 to the opposite position. In this regard, the user 30 can use the input (e.g., a button) on the remote control 346 to turn on or turn off the switch 26. Other devices that can communicate with the automatic switch control 10 via a radio frequency with the RF detecting module 324 can include additional remote sensors such as separate motion detecting modules and/or separate light detecting modules placed at remote locations around the room 22 relative to the automatic switch control 10. Additional suitable RF devices are disclosed in commonly owned U.S. Pat. No. 7,372,355 and U.S. patent application Ser. No. 12/115,797 which are hereby incorporated by reference as if fully set forth herein.

With reference to FIG. 3 and FIG. 4, a third input mechanism 336 and a fourth input mechanism 338 (FIG. 3) along with the first input mechanism 86 and the second input mechanism 88 (FIG. 4) can be set and re-set by the user 30 (FIG. 1) to control how the automatic switch control 10 works and responds including the delays for motion and threshold levels for ambient light detection. The input mechanisms 86, 88, 336, 338 can be directly accessed by the user 30 or accessed remotely through a wired or wireless connection but still provide the same functionality as operating the input mechanisms 86, 88, 336, 338 directly, as discussed herein. The input mechanisms 86, 88, 336, 338 can be two-position or multi-position switches or switch wheels.

One of the input mechanisms, for example fourth input mechanism 338, can be operable to switch polarity of the automatic switch control 10. By being able to switch the polarity, the switch 26 can be already mounted upside-down, such that the off position is actually positioned in the top position and not the bottom position. Without requiring removal and re-installation of the switch 26, the automatic switch control 10 can be re-configured by the user 30 with the fourth input mechanism 338 to accommodate such an upside-down installation of the switch 26. By way of this example, the first input mechanism 86 can control the time that the automatic switch control 10 stays in the on position before returning to the off position after the detection of motion.

The second input mechanism 88 can control the time that the automatic switch control 10 can ignore the lack of motion. As such, the automatic switch control 10 can wait the amount of time set be the second input mechanism before the automatic switch control 10 responds to such lack of motion and moves the toggle 28 to the off position. In this regard, the automatic switch control 10 can turn lights on in the room 22 when motion is detected and keep the lights on for the time period set by the second input mechanism 88. Upon expiration of the time period, the automatic switch control 10 can then turn the lights off. The third input mechanism 336 can control the ambient light level at which the automatic switch control 10 can ignore a command to turn on the switch 26 to avoid adding additional unwanted light to the room 22. Moreover, the automatic switch control 10 can move the toggle to the off position based on the ambient light level that can be set by the third input mechanism 336.

With references to FIG. 6 through FIG. 12, a progression of the rotation of the wheel member 130 is illustrated as the wheel member 130 can permit movement of the first and the second plunger mechanisms 230, 232 to move the toggle 28 of the switch 26 between the on position and the off position. In FIG. 6 and FIG. 7, the wheel member 130 can be positioned so the round portion 218 of the ramp surface 216 can contact and hold the cam followers 238, 254 of the post members 234, 250 in the retracted condition. The toggle 28 of the switch 26 can be connected to the toggle mover member 274 and the toggle 28 can be in the on position.

As the wheel member 130 rotates, the ramp surface 216 of the cam member 214 can be in the position so that the flat portion 220 of the ramp surface 216 can be almost at the cam follower 238 in FIG. 6 and FIG. 7. As the wheel member 130 rotates further, the ramp surface 216 of the cam member 214 can be in the position so that the flat portion 220 of the ramp surface 216 can rotate past the cam follower 238 and into a position that does not obstruct the cam follower 238. This position of the ramp surface 216 can allow the first plunger mechanism 230 to extend the post member 234 toward the manual actuator member 92 without obstruction from the wheel member 130. The head portion 236 on the post member 234 can strike the manual actuator member 92 and can move the toggle 28 from the off position to the on position. Because the toggle 28 has been moved to the off position from the on position, the switch 26 can turn off to whatever the switch may be connected.

The wheel member 130 can continue to rotate in a clockwise direction and the cam follower 238, 254 can follow the ramp surface 216 to return the post member 234, 250 to retracted condition as illustrated in FIG. 10. The toggle 28 can remain in the off position. From FIG. 10 to FIG. 11, the wheel member 130 can rotate and the ramp surface 216 of the cam member 214 can be positioned so that the flat portion 220 of the ramp surface 216 can just rotate past the cam follower 254 and can move to a position that does not obstruct the cam follower 254. This position of the wheel member 130 can allow the second plunger mechanism 232 to extend the post member 250 toward the manual actuator member 92. The head portion 252 on the post member 250 can strike the manual actuator member 92 and can move the manual actuator member 92 and the toggle 28 from the off position to the on position. Because the toggle 28 has been moved to the on position from the off position, the switch 26 can turn on to whatever the switch may be connected. In FIG. 12, the wheel member 130 can continue to rotate and the round portion 218 of the ramp surface 216 can move to the position and can thus hold the post members 234, 250 in the retracted condition.

Figure 13:
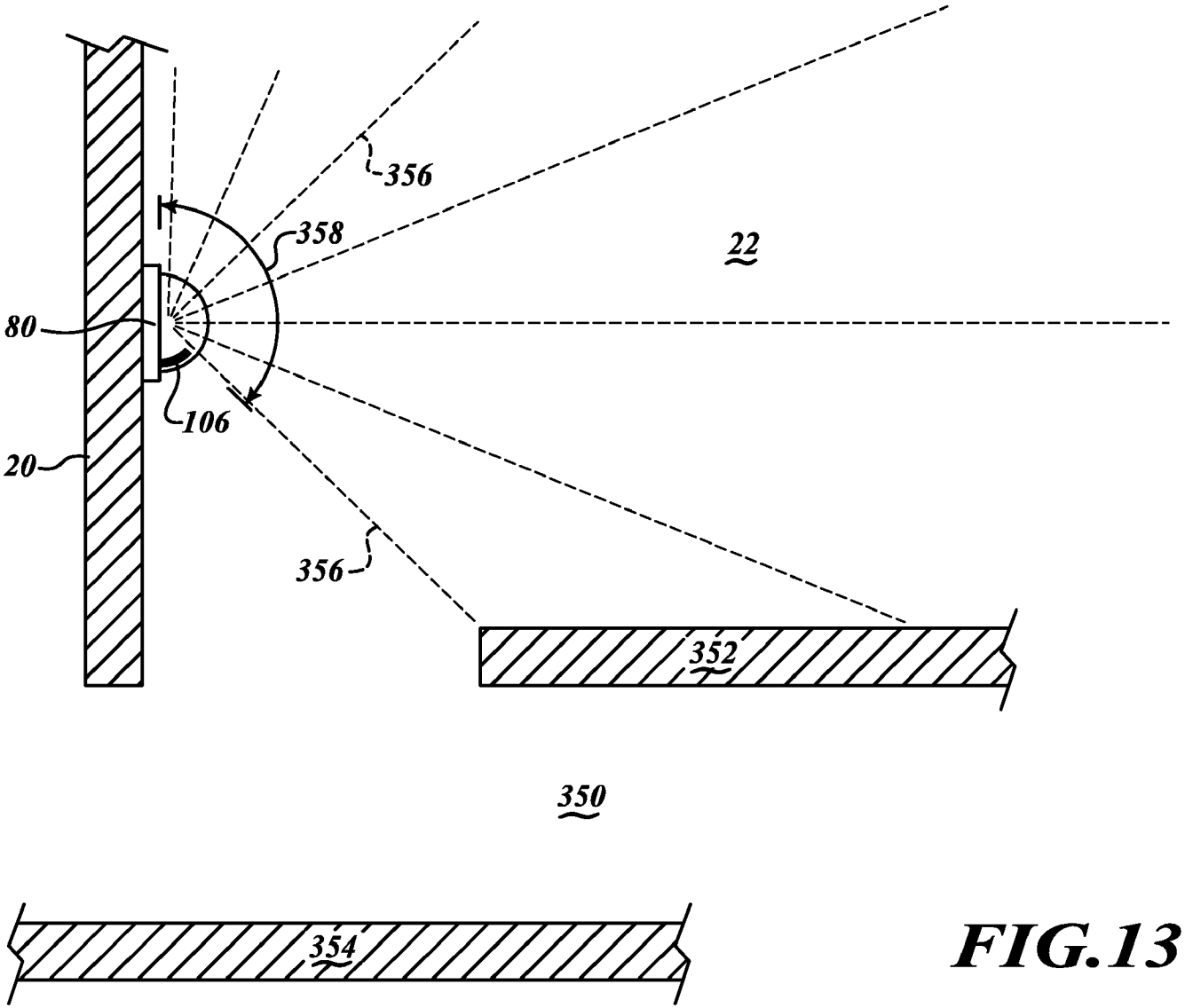
FIG. 13 is a diagram showing an exemplary field of view of the automatic switch control of FIG. 2 and a blocker member that can be moved to selectively obscure a portion of the field of view in accordance with the present teachings.

With reference to FIG. 13, the automatic switch control 10 can be installed on the wall 20 that can terminate into a hallway 350. The hallway 350 can be defined by a wall 352 that can bound the same room 22 as the wall 20. The hallway 350 can also be defined by a wall 354 that is opposite the wall 352. The motion detecting module 320 (FIG. 4) can receive electromagnetic waves to determine when there is motion in the room 22. It will be appreciated in light of the disclosure that the motion detecting module 320 can be configured to only receive electromagnetic waves or can be configured to emit and to receive electromagnetic waves. The blocker member 106, however, can be disposed in the sensor housing 80 to block a portion of the lens member 100 and therefore can limit a field of view 358 of the motion detecting module 320. For example, the blocker member 106 can prevent the motion detecting module 320 from detecting motion in the hallway 350 because the blocker member 106 can limit the field of view 358 to omit the hallway 350. It will be appreciated in light of the disclosure that the blocker member 106 can be moved to various locations in the sensor housing 80 and can selectively limit the field of view 358 of the motion detecting module 320. In doing so, the user 30 can avoid the detection of motion in areas of the room 22, where such detection may not be wanted such as the hallway 350, the window 344, a location where the dog 332 sleeps, etc.

While the automatic switch control 10 can be controlled by detection or lack of detection of motion, heat, sound, ambient light, expiration of time, or a signal from a wireless transmitter, the automatic switch control 10 can also be controlled by the user 30 communicating with the automatic switch control 10 via the internet such as through an internet protocol address. In doing so, the user 30 can directly interface with and can control the automatic switch control 10 and/or the user 30 can have a signal sent from a computer network that can be accessible from a computer 360 and/or a personal digital assistant 362. Moreover, the automatic switch control 10 can send a signal through the computer network that can be accessible from the computer 360 and/or the personal digital assistant 362 that can indicate to the user the position of the toggle 28, the position of the manual actuator member 92, the status of the detection of motion and/or the status of the detection of ambient light. The user 30 can also communicate with the automatic switch control 10 through other network connections via a phone, a network interface made available on a television 364, and/or configuring the remote control 346 to communicate the automatic switch control 10 via a local computer network. In this arrangement, the user 30 can control the automatic switch control 10 from within the room 22 or outside thereof either through a wired or a wireless connection on the premises or from remote locations with internet access.

Figure 14:
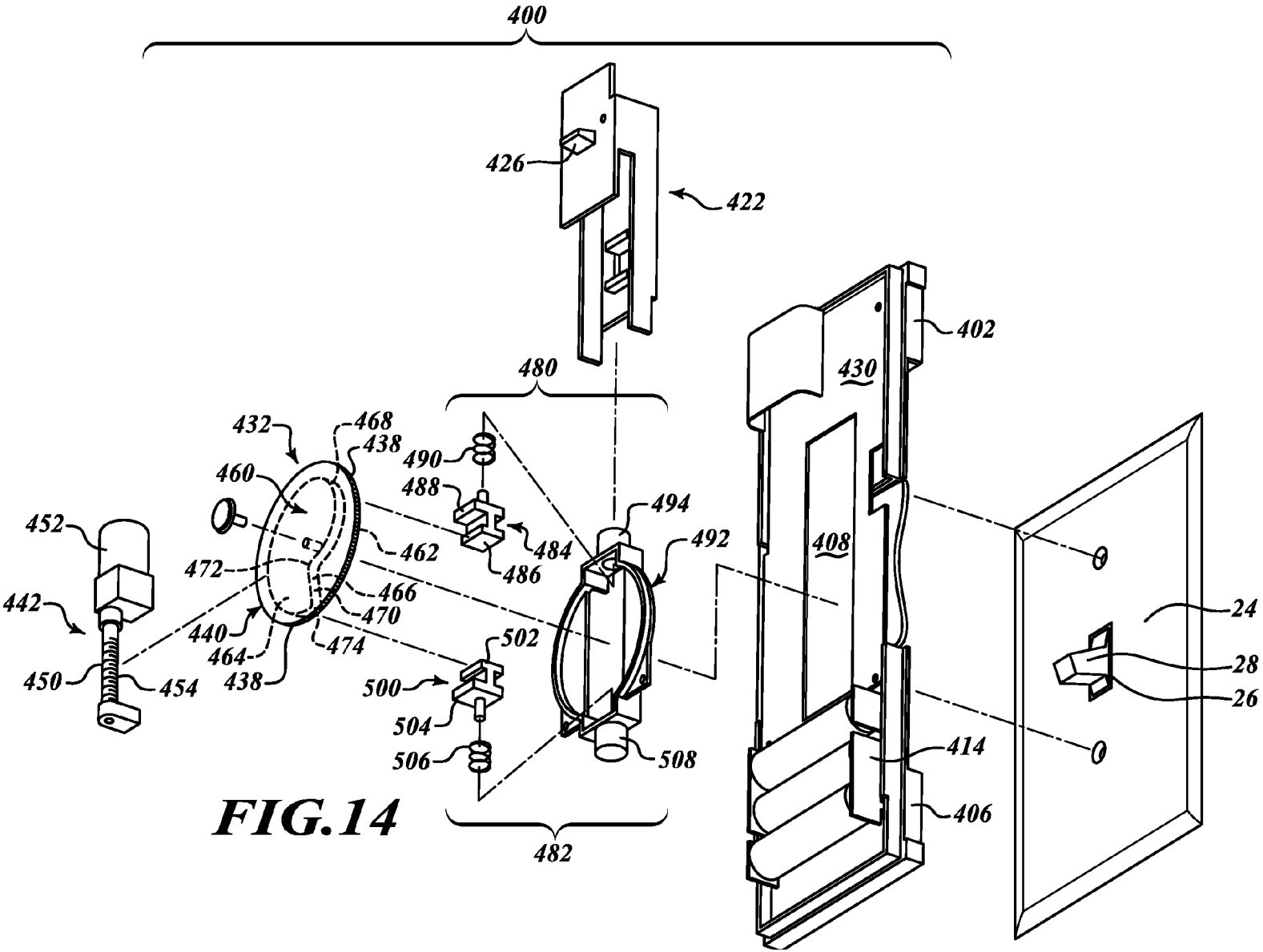
FIG. 14 is a partial exploded view of an automatic switch control showing a wheel member in a housing that can actuate first and second plunger mechanisms to turn off and turn on, respectively, the switch in accordance with another example of the present teachings.
Figure 15:
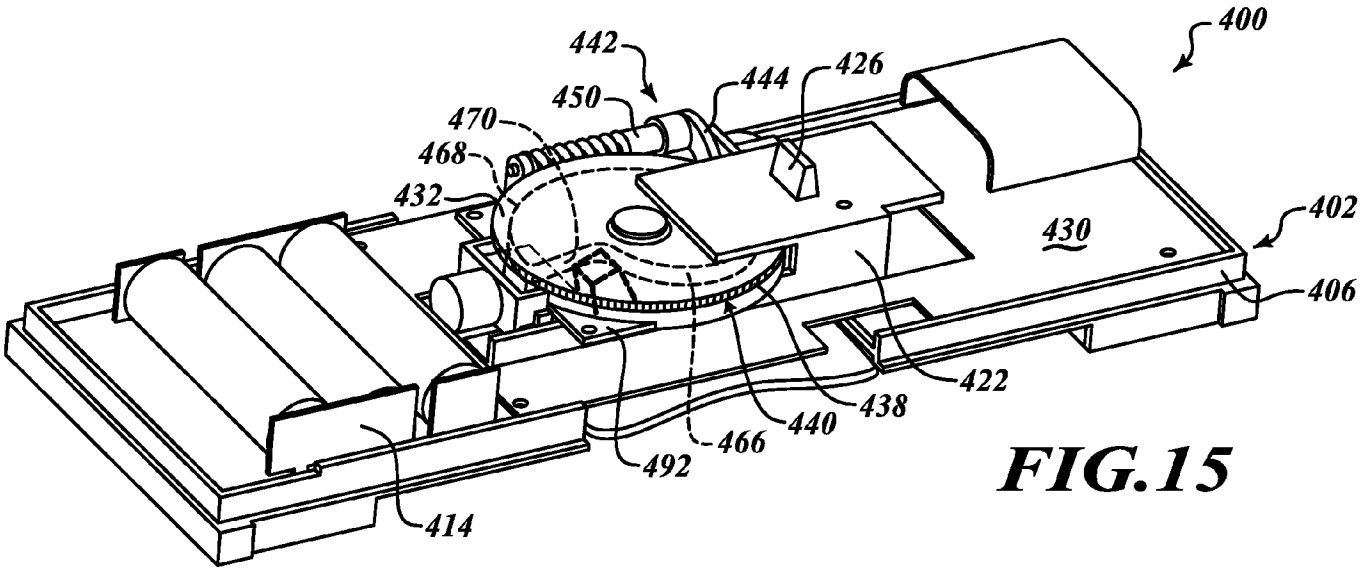
FIG. 15 is a partial perspective view of the automatic switch control of FIG. 14 with a front shell member of the housing omitted in accordance with the present teachings.
Figure 16:
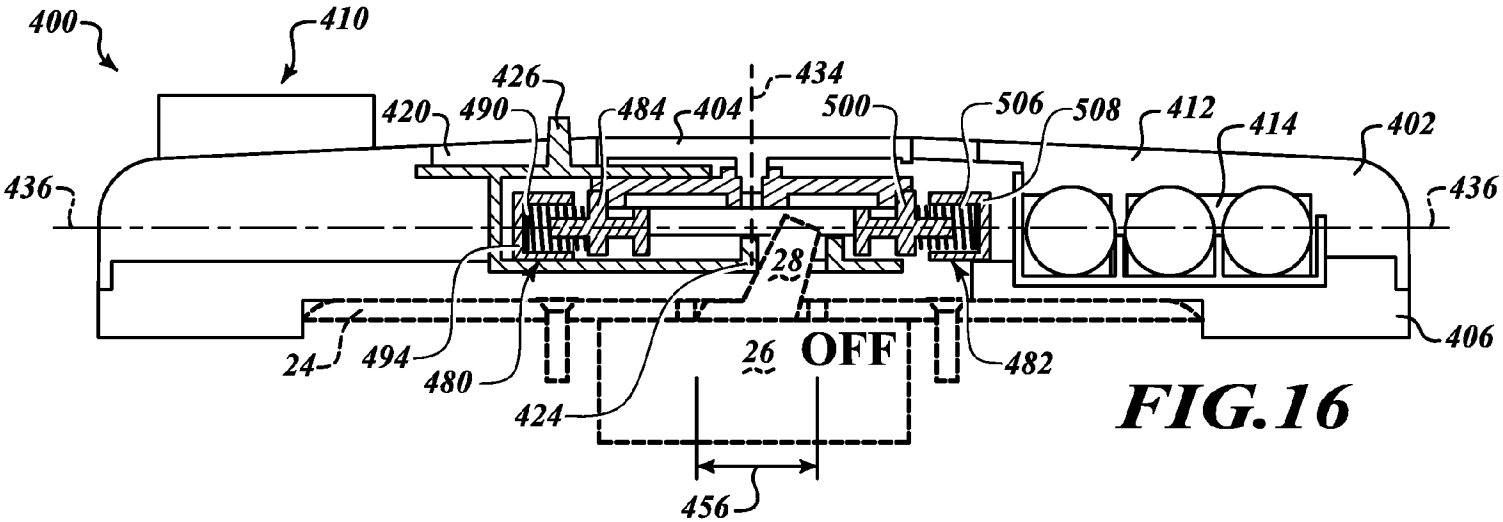
FIG. 16 is a partial cross-sectional view of the automatic switch control of FIG. 15 in accordance with the present teachings.

With reference to FIG. 14, FIG. 15, and FIG. 16, an automatic switch control 400 can be similar to the automatic switch control 10 (FIG. 2) and can mount to the switch 26 to move the toggle 28 to the on position and the off position. The user 30 can program and re-program the automatic switch control 400 to move the toggle 28 to the on position or to the off position in response to one or more signals and/or circumstances similar to the automatic switch control 10 as described herein.

The automatic switch control 400 can include a housing 402 having a front shell member 404 and a rear shell member 406 that can be secured together. The rear shell member 406 can connect to the switch plate 24 so the toggle 28 of the switch 26 can partially protrude through an aperture 408 formed in the rear shell member 406 of the housing 402. The front shell member 404 can include a sensor housing 410 and a cover member 412. The cover member 412 can be pivotally mounted to the front shell member 404 of the housing 70. The cover member 412 can be opened and in doing so can be pivoted away from the front shell member 404 of the housing 402. When the cover member 412 is opened, the cover member 412 can reveal a holder member 414 that can hold one or more batteries or other suitable power source that can provide electrical power to the automatic switch control 400.

With reference to FIG. 16, the front shell member 404 of the housing 402 can define an aperture 420 through which a portion of a manual actuator member 422 can protrude. The manual actuator member 422 can connect to the toggle 28 at a connection point 424 and can urge the toggle 28 between the on position and the off position. The connection point 424 between the manual actuator member 422 and the toggle 28 can be located entirely inside the housing 402 when the automatic switch control 400 is installed on the switch plate 24 of the switch 26. In this regard, the connection point 424 between the toggle 28 and the manual actuator member 422 is not visible to the user 30 when the automatic switch control 400 is installed on the wall 20. A portion of the manual actuator member 422 that can protrude from the aperture 420 on the front shell member 404 can include a handle portion 426. The handle portion 426 can be grasped by the user 30 to move the toggle 28 with the manual actuator member 422 through the entire range of motion 60 (FIG. 6) of the toggle 28.

The sensor housing 410 can contain one or more sensor modules that can be used to detect motion, heat, ambient light, expiration of time, the signal from the wireless transmitter, and/or the signal from the computer network similar to the automatic switch control 10.

With reference to FIG. 2 and FIG. 4, a front surface 430 of the rear shell member 406 of the housing 402, can rotatably support a wheel member 432 that can spin around an axis of rotation 434. The axis of rotation 434 of the wheel member 432 is generally perpendicular to a longitudinal axis 436 of the automatic switch control 400. The wheel member 432 can be located on the rear shell member 406 so that the wheel member 432 can be directly over the toggle 28 when the automatic switch control 400 is installed to the switch 26 in contrast to the automatic switch control 10 that is positioned above the toggle 28. The wheel member 130 can include gear teeth 438. The gear teeth 438 can be circumferentially spaced on an outer periphery 440 of the wheel member 432.

With reference to FIG. 4, the gear teeth 438 on the wheel member 432 can mesh with a worm drive 442. The worm drive 442 can be positioned on a frame member 444 that can be formed from or connected to the rear shell member 406. The worm drive 442 can include an output shaft 450 that can be selectively rotated by an electric motor 452 controlled by the automatic switch control 10. The output shaft 450 can have gear teeth 454 and can engage the wheel member 432 directly. The output shaft 450 can be positioned to be generally parallel to the longitudinal axis 436 of the automatic switch control 400 and can also be generally parallel to a direction of travel defined by a range of motion 456 of the toggle 28.

In one example, the output shaft 450 can include longitudinally arranged helical gear teeth that can mesh with the gear teeth 438 on the wheel member 432. The wheel member 432 can have a front surface 460 and a rear surface 462. When the automatic switch control 400 is installed over the switch 26, the rear surface 462 of the wheel member 130 can face the toggle 28 of the switch 26. The rear surface 462 of the wheel member 130 can also include a cam member 464 such that the cam member 464 can face the toggle 28 of the switch 26. The cam member 464 can define a ramp surface 466. The ramp surface 466 can include a round portion 468 that can continuously connect with a flat portion 470. In this regard, the total 360 degrees of rotation of the ramp surface 466 can include the flat portion 470, followed by a transition 472 between the flat portion 470 and the round portion 468, followed by the round portion 468, followed by a transition 474 between the round portion 468 and then back to the flat portion 470.

Distances can be defined between circumferential positions on ramp surface 466 and the axis of rotation 434. These distances can vary at different circumferential positions of the wheel member 432 similar to the wheel member 130.

A first plunger mechanism 480 can be disposed above the wheel member 432 and a second plunger mechanism 482 can be disposed beneath the wheel member 432. When the automatic switch control 400 is installed on the switch 26, the first plunger mechanism 480 can be disposed immediately above the on position of the switch 26 and can move the toggle 28 of the switch 26 to the off position. The second plunger mechanism 482 can be disposed immediately below the off position of the switch 26 and can be arranged to move the toggle 28 of the switch 26 to the on position. The first plunger mechanism 480 and the second plunger mechanism 482 can be in vertical alignment with each other, with the longitudinal axis 436 and with the toggle 28 of the switch 26, when the automatic switch control 400 is installed over the switch 26.

The first plunger mechanism 480 can include a post member 484 having a head portion 486 and a cam follower 488. The first plunger mechanism 480 can also include a spring member 490 that can connect the post member 484 to a mechanism housing 492 having a stop member 494 for the first plunger mechanism 480. The spring member 490 can urge the post member 484 from a retracted condition to an extended condition. The spring member 490 can bias the post member 484 toward the toggle 28 of the switch 26 and toward the second plunger mechanism 482. The cam follower 488 of the post member 484 can ride the ramp surface 466 of the cam member 464 as the wheel member 432 rotates. By riding the ramp surface 466, the cam follower 488 can urge the post member 484 of the first plunger mechanism 480 to the retracted condition and can also permit the first plunger mechanism 480 to move to the extended condition.

The second plunger mechanism 482 can include a post member 500 having a head portion 502 and a cam follower 504. The second plunger mechanism 482 can also include a spring member 506 that can connect the post member 500 to the mechanism housing 492 having a stop member 508 for the second plunger mechanism 482. The spring member 506 can urge the post member 500 from a retracted condition to an extended condition. The spring member 506 can bias the post member 500 toward the toggle 28 of the switch 26 and toward the first plunger mechanism 480. The cam follower 504 of the second plunger mechanism 482 can also ride the ramp surface 466 of the cam member 464 as the wheel member 432 rotates. By riding the ramp surface 466, the cam follower 504 can urge the post member 500 of the second plunger mechanism 482 to the retracted condition and can also permit the second plunger mechanism 482 to move to the extended condition.

Figure 17:
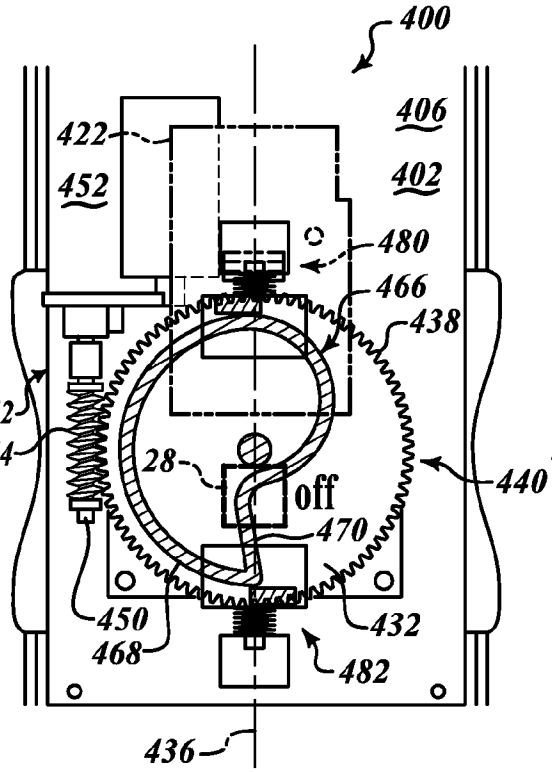
Figure 21:
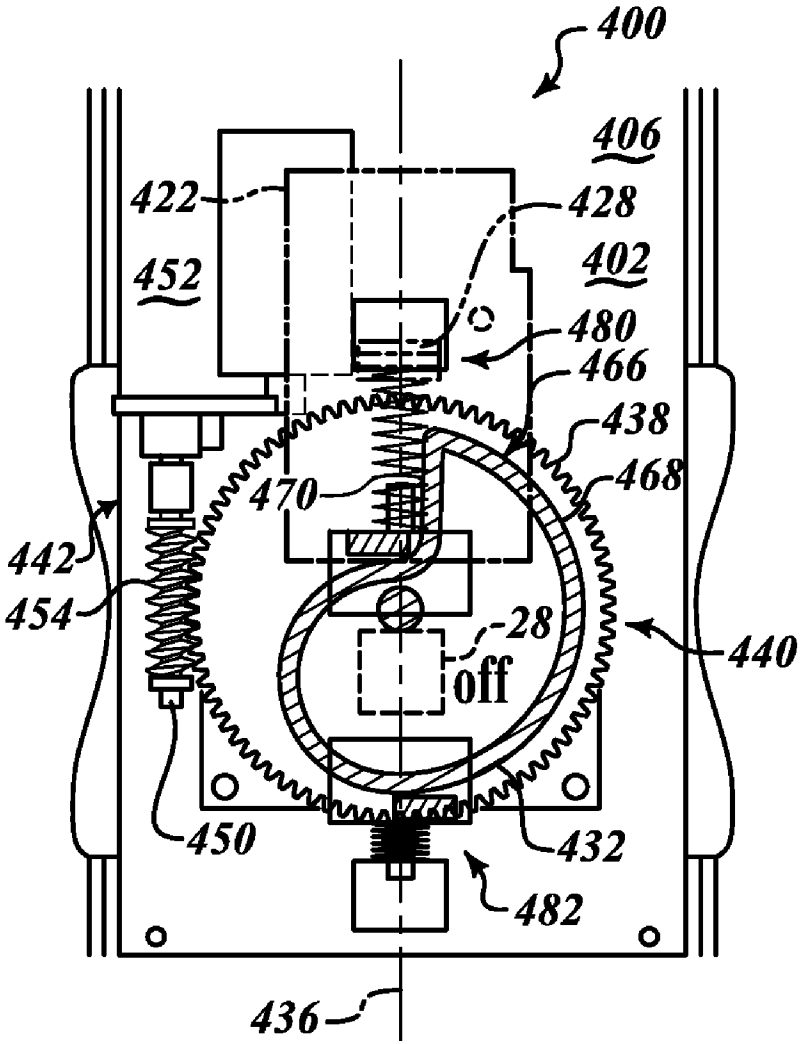
Figure 20:
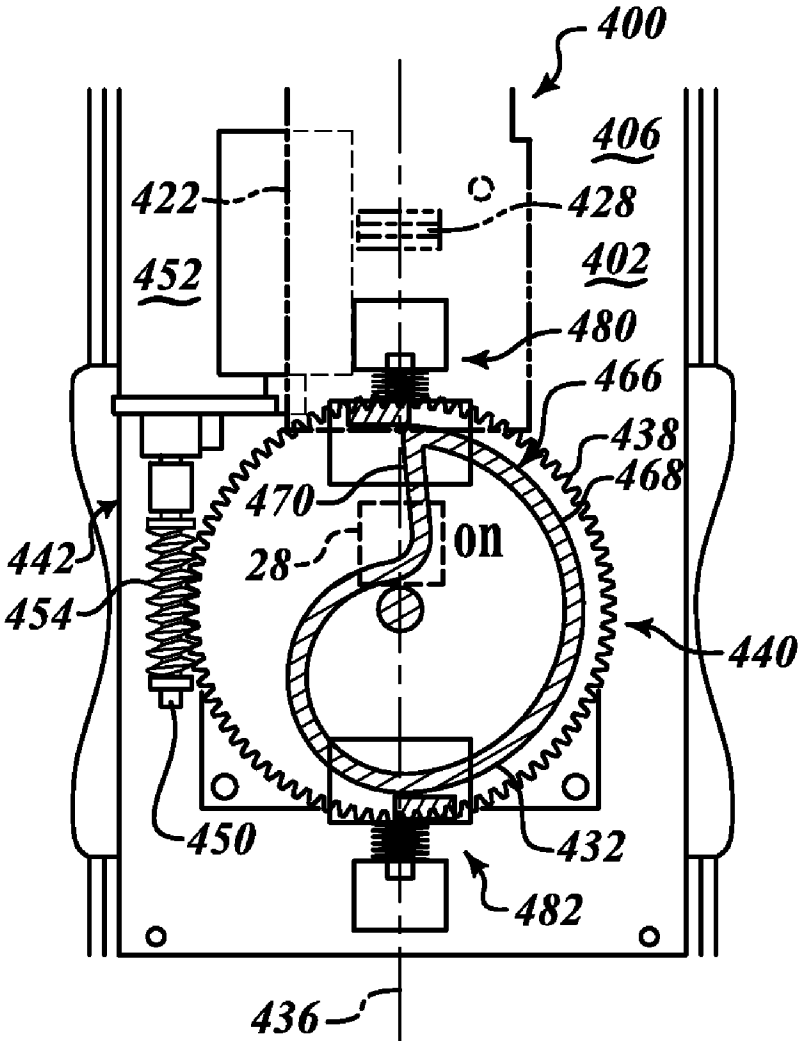

In this arrangement, the distance between the ramp surface 466 of the cam member 464 and the axis of rotation 434 of the wheel member 432 can control the position of the post members 484, 500 of the first and second plunger mechanisms 480, 482. With reference to FIG. 17 and FIG. 20, the wheel member 432 can be in a rotational position where the maximum distance between the ramp surface 466 and the axis of rotation 434 can be disposed immediately beneath the first plunger mechanism 480 and also can be disposed immediately beneath the second plunger mechanism 482 to keep the first plunger mechanism 480 and the second plunger mechanism 482 in the retracted condition. In this arrangement, the ramp surface 466 of the wheel member 432 can be in such a rotational position so that the cam member 464 can hold the post members 484, 500 of the first and second plunger mechanisms 480, 482 outside the area defined by the range of motion 456 of the toggle 28.

Similar to the cam member 214 on the wheel member 130, the flat portion 470 of the ramp surface 466 can be configured to quickly allow the first plunger mechanism 480 and the second plunger mechanism 482 to move the post members 484, 500, respectively to the extended condition. In doing so, the flat portion 470 of the ramp surface 466 can be rotated so that the flat portion 470 can move to the side of the cam follower 488, 504 (i.e., not obstruct the cam followers) allowing the spring member 490, 506 to push the post member 484, 500 to the extended condition. The motion of the post member 484, 500 can terminate as the cam follower 488, 504 can contact the round portion 468 of the ramp surface 466.

As the wheel member 432 can permit the first and second plunger mechanisms 480, 482 to move into the extended condition, the post member 484, 500 of the first and second plunger mechanisms 480, 482 can extend toward the manual actuator member 422 and can strike the manual actuator member 422 with the head portion 486, 502 of the first or second plunger mechanisms 480, 482, respectively, to move the toggle 28 to the on position or to the off position. It will be understood in light of the disclosure that the manual actuator member 422 can move with the toggle 28 of the switch 26 between the on position and the off position independently of any engagement with the post members 484, 500 while both of the post members 484, 500 are held in the retracted condition by the ramp surface 466 on the wheel member 432.

The manual actuator member 422 can include a front surface 520 and a rear surface 522. The front surface 520 can include the handle portion 426 that can extend from the front surface 520 out of the aperture 420 in the front shell member 404 of the housing 402. The rear surface 522 can be closer to the switch 26 than the front surface 520 when the automatic switch control 10 installed over the switch 26. The manual actuator member 422 can also include a toggle mover member 524 that can extend from the rear surface 522 of the manual actuator member 422. The manual actuator member 422 can grab the toggle 28 with the toggle mover member 524 and move between the on position and the off position with the toggle 28 while the post member 484, 500 of the first and the second plunger mechanisms 480, 482 are held in the retracted condition.

The post member 484, 500 of the first and second plunger mechanisms 480, 482 can be slidably supported by the mechanism housing 492. The mechanism housing 492 can permit the post member 484, 500 to travel in a direction that is parallel to the longitudinal axis 436 of the automatic switch control 400 between the extended condition and the retracted condition.

With references to FIG. 17 through FIG. 21, a progression of the rotation of the wheel member 432 is illustrated as the wheel member 432 can permit movement of the first and the second plunger mechanisms 480, 482 to move the toggle 28 of the switch 26 between the on and the off positions. In FIG. 17 and FIG. 20, the wheel member 432 can be positioned so the round portion 468 of the ramp surface 466 can contact and hold the cam followers 488, 504 to hold the post members 484, 500 in the retracted condition. The toggle 28 of the switch 26 is connected to the toggle mover member 524 and the toggle 28 can be in the on position.

Figure 18:
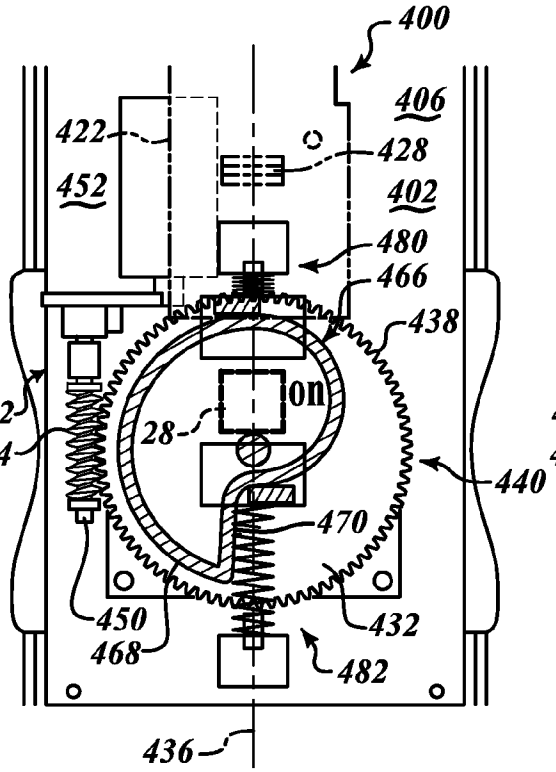

From FIG. 17 to FIG. 18, the wheel member 432 can rotate and the ramp surface 466 of the cam member 464 can be positioned so that the flat portion 470 of the ramp surface 466 just rotates past the cam follower 488 and can move to a position that does not obstruct the cam follower 488. This position of the wheel member 432 can allow the first plunger mechanism 480 to extend the post member 484 toward the manual actuator member 422. The head portion 486 on the post member 484 can directly strike the toggle 28 and can move the toggle 28 from the off position to the on position. Because the toggle 28 has been moved to the off position from the on position, the switch 26 can turn off to whatever the switch may be connected.

Figure 19:
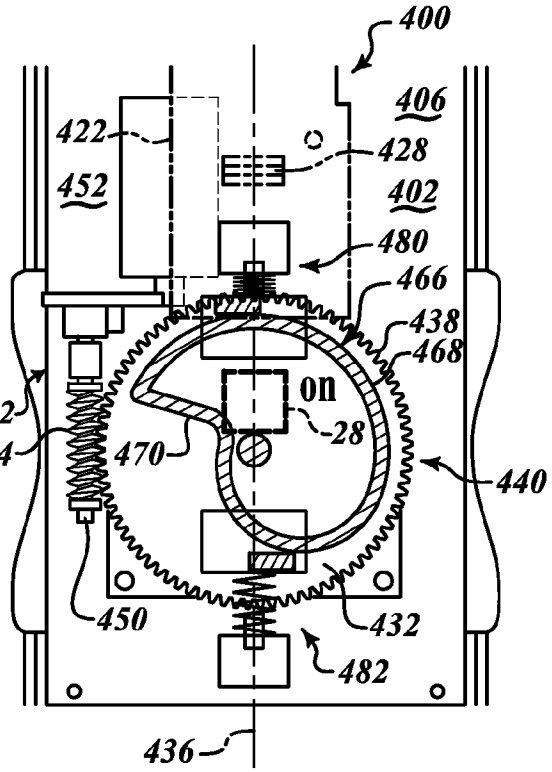
FIG. 17 through FIG. 21 are diagrams that show a progression of the automatic switch control of FIG. 14 moving the toggle of the switch between the on position and the off position in accordance with the present teachings.

With reference to FIG. 19, the wheel member 432 can continue to rotate in a clockwise direction and the cam follower 488, 504 can follow the ramp surface 466 to return the post member 484, 500 to the retracted condition. The toggle 28 can remain in the off position. From FIG. 10 to FIG. 11, the wheel member 432 can rotate and the ramp surface 466 of the cam member 464 can be positioned so that the flat portion 470 of the ramp surface 466 rotates just past the cam follower 504 and can move to a position that does not obstruct the cam follower 504. This position of the wheel member 432 can allow the second plunger mechanism 482 to extend the post member 500 toward the manual actuator member 422. The head portion on the post member 500 can strike the manual actuator member 422 and can move the manual actuator member 422 and the toggle 28 from the off position to the on position. Because the toggle 28 has been moved to the on position from the off position, the switch 26 can turn on to whatever the switch may be connected. In FIG. 12, the wheel member 432 can continue to rotate the round portion 468 of the ramp surface 466 and can move the hold the post members 484, 500 back into the retracted condition.

Figure 23:
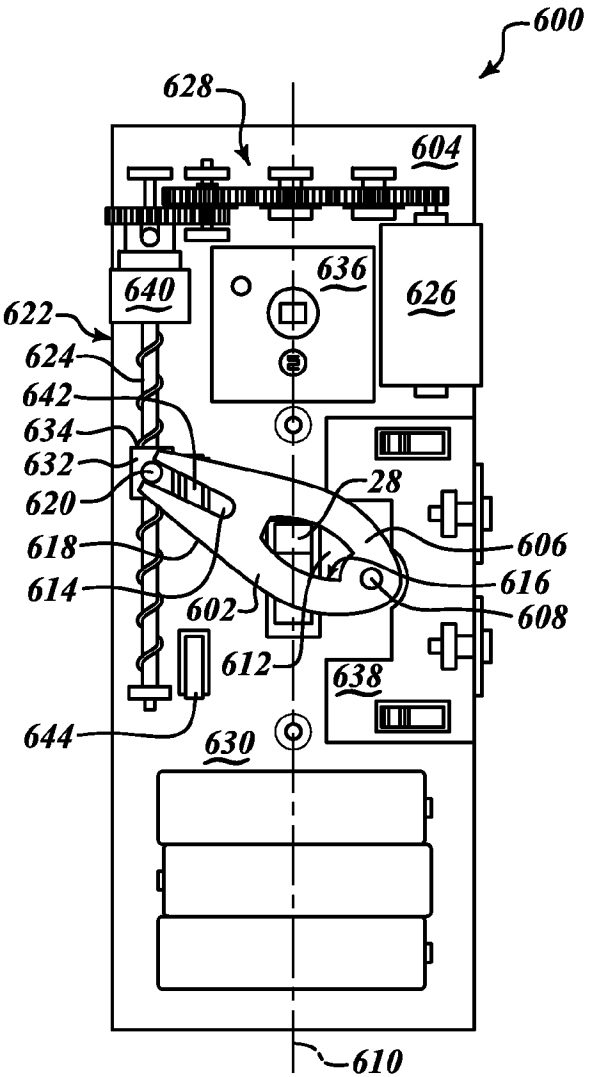
FIG. 22 and FIG. 23 are diagrams of an automatic switch control with two position sensors and a yoke member that move the toggle in accordance with another example of the present teachings.
Figure 22:
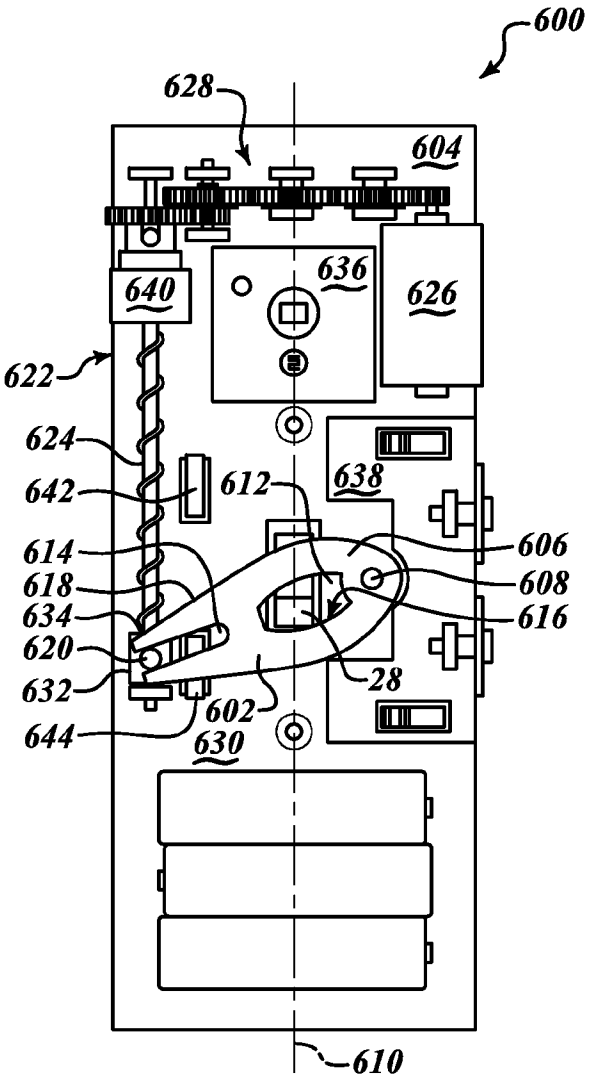

With reference to FIG. 22 and FIG. 23, an automatic switch control 600 in accordance with another example of the present teachings can be placed over the toggle 28 of the switch 26 and can move the toggle 28 between the on position and the off position. The automatic switch control 600 can also permit the user 30 (FIG. 1) to manually move the toggle 28 and permit the switch 26 to move the toggle 28 under its own power between the on position and the off position.

The automatic switch control 600 can include a yoke member 602 that can be rotatably supported on a housing 604 of the automatic switch control 600. The yoke member 602 can have a pivot portion 606 on one side of the yoke member 602 that can be pivotally attached to the housing 604 with a pin member 608. The pin member 608 can allow the yoke member 602 to pivot in a curved path relative to the toggle 28 that can move in a direction generally parallel to a longitudinal axis 610 of the automatic switch control 600.

The yoke member 602 can define a first aperture 612 and a second aperture 614. The first aperture 612 can be completely internal within the yoke member 602 and thus can form an inner periphery 616. The first aperture 612 can be sized to accept the toggle 28 of the switch 26. The second aperture 614 can be formed at an end portion 618 of the yoke member 602 that can be opposite the pivot portion 606. The second aperture 614 can be open to the end portion 618 and can accept a post member 620 that can be connected to a worm drive 622. Movement of the post member 620 in the second aperture 614 can transfer the longitudinal motion of the post member 620 to pivotal motion of the yoke member 602.

The worm drive 622 can have a drive member 624 that can be engaged by the electric motor 626. The electric motor 626 can drive a gear assembly 628 that can connect the worm drive 622 to the electric motor 626. The worm drive 622, the gear assembly 628, and the electric motor 626 can be connected to a rear shell member 630 the housing 604. The worm drive 622 can also include a follower member 632 having an aperture 634 that can be threaded for rotation over the drive member 624. The follower member 632 can also have the post member 620 that can extend from the follower member 632 and can be received in the second aperture 614 formed on the yoke member 602.

The electric motor 626 can selectively apply rotational power to the worm drive 622 in either a clockwise or a counterclockwise direction to move the yoke member 602 and the toggle 28 to the on position or to the off position. As such, the user 30 can rely on the automatic switch control 600 to move the toggle 28 to the on position or to the off position in response to one or more signals and/or circumstances (singular or in combination) that can be detected by a sensor module 636. The sensor module 636 can be connected to a control module 638 that can control the automatic switch control 600 similar to the automatic switch control 10 discussed herein.

The gear assembly 628 can include a centrifugal clutch 640. The centrifugal clutch 640 can permit the gear assembly 628 to disengage from the worm drive 622 when the rotational speed of the gear assembly 628 at the centrifugal clutch 640 is below a threshold value. When the threshold value is exceeded, the centrifugal clutch 640 can close and thus engage the worm drive 622 to the electric motor 626

The electric motor 626 can engage the worm drive 622 to move the follower member 632 and the yoke member 602 to the top position. In the top position, the yoke member 602 can contact a first position sensor 642 and can move the toggle 28 to the on position. The electric motor 626 can also engage the worm drive 622 to move the follower member 632 and the yoke member 602 to the bottom position. In the bottom position, the yoke member 602 can contact a second position sensor 644 and can move the toggle 28 to the off position. Also when the yoke member 602 contacts the first position sensor 642 or the second position sensor 644, the electric motor 626 can stop driving the worm drive 622 and because the rotational speed drops below the threshold value, the centrifugal clutch 640 can open and thus disengage the electric motor 626 from the worm drive 622.

When the centrifugal clutch 640 is open and the electric motor 626 is disengaged from the worm drive 622, the yoke member 602 can be moved manually, that is without assistance from the electric motor 626. For example, the user 30 (FIG. 1) can grasp the toggle 28 and can move the toggle 28 from the on position to the off position, or vice versa. The yoke member 602 can move with the toggle 28 by moving the follower member 632 that, in turn, can cause the drive member 624 to rotate. Even though the drive member 624 can rotate in response to manual movement of the toggle 28 and the yoke member 602, the drive member 624 is not engaged and therefore does not back drive the gear assembly 628 and the electric motor 626 because the centrifugal clutch 640 can be open.

The first aperture 612 formed in the yoke member 602 can be sized to encircle the toggle 28 so some portions of the yoke member 602 can be present in the area defined by the range of motion 60 (FIG. 6) of the toggle 28. Even though the toggle 28 must be in contact with at least a portion of the yoke member 602 to move through its range of motion 60, the user 30 (FIG. 1) remains able to manually move the toggle 28 between the on position and the off position. Moreover, the switch 26 remains able to move the toggle 28 under its own power when the centrifugal clutch 640 is open. In this regard, the force required to move the follower member 632 longitudinally in the upward direction or the downward direction along the worm drive 622 can be shown to be less than the force exerted by the switch 26 on the toggle 28 that would be required to move the toggle 28 from one of the intermediate positions to the on position or the off position.

With reference to FIG. 22, when the toggle 28 is in the off position, the yoke member 602 can be in the corresponding bottom position. When the sensor module 636 receives one or more signals to activate the automatic switch control 600, the control module 638 can start the electric motor 626. Once the electric motor 626 rotates the gear assembly 628 beyond the threshold rotational speed, the centrifugal clutch 640 can close. When the centrifugal clutch 640 closes, the worm drive 622 can connect to the gear assembly 628 and rotate the drive member 624 to move the follower member 632 in an upward direction. By moving the follower member 632 in the upward direction, the yoke member 602 can move toward the top position and move the toggle 28 from the off position to the on position.

With reference to FIG. 23, the position sensor 642 can detect that the yoke member 602 has moved to the top position and can deactivate the electric motor 626 and the worm drive 622 can cease to rotate. At this time, when the user 30 manually moves the toggle 28 from the on position to the off position, the yoke member 602 can be pulled with the toggle 28 and the follower member 632 can move downward by rotating the worm drive 622. This is possible because the worm drive 622 is not connected to the gear assembly 628 and the electric motor 626 because there is no rotational motion imparted by the electric motor 626 and, therefore, the centrifugal clutch 640 can remain open.

When the sensor module 636 receives another signal to activate the automatic switch control 600, the control module 638 can start the electric motor 626. With the toggle 28 in the on position, the drive member 624 can rotate in an opposite direction to move the follower member 632 in the downward direction. By moving the follower member 632 in the downward direction, the yoke member 602 can move back to the bottom position and can move the toggle 28 from the on position to the off position.

With reference to FIG. 22, the second position sensor 644 can detect that the yoke member 602 has moved to the bottom position. At this point, the control module 638 can deactivate the electric motor 626 and the worm drive 622 can cease to rotate. The user 30 (FIG. 1) nevertheless remains able to manually move the toggle 28 from the off position to the on position, or vice versa.

With reference to FIG. 24, FIG. 25, and FIG. 26, an automatic switch control 650 in accordance with another example of the present teachings can be placed over the toggle 28 of the switch 26 and can move the toggle 28 between the on position and the off position in a similar fashion to the automatic switch control 600, as shown in FIG. 22. The automatic switch control 650 can also permit the user 30 (FIG. 1) to manually move the toggle 28 and permit the switch 26 to move the toggle 28 under its own power between the on position and the off position.

The automatic switch control 650 can include a yoke member 652 that can be rotatably supported on a housing 654 of the automatic switch control 650. The yoke member 652 can have a pivot portion 656 on one side of the yoke member 652 that can be pivotally attached to the housing 654 with a pin member 658. The pin member 658 can allow the yoke member 652 to pivot in a curved path relative to the toggle 28 that can move in a direction generally parallel to a longitudinal axis 660 of the automatic switch control 650.

The yoke member 652 can define a first aperture 662 and a second aperture 664. The first aperture 662 can be completely internal within the yoke member 652 and thus can form an inner periphery 666. The first aperture 662 can be sized to accept the toggle 28 of the switch 26. The second aperture 664 can be formed at an end portion 668 of the yoke member 652 that can be opposite the pivot portion 656. The second aperture 664 can be open to the end portion 668 and can accept a post member 670 that can be connected to a worm drive 672. Movement of the post member 670 in the second aperture 664 can transfer the longitudinal motion of the post member 670 to the pivotal motion of the yoke member 652.

The worm drive 672 can have a drive member 674 that can be rotated by an electric motor 676. The electric motor 676 can drive a gear assembly 678 that can connect the worm drive 672 to the electric motor 676. The worm drive 672, the gear assembly 678, and the electric motor 676 can be connected to a rear shell member 680 of the housing 654. The worm drive 672 can also include a follower member 682 that can be threaded for rotation over the drive member 674. The follower member 682 can also have the post member 670 that can extend from the follower member 682 and can be received in the second aperture 664 formed on the yoke member 652.

The worm drive 672 can rotate the drive member 674 in the first direction and in the second, opposite direction to move the follower member 682 similar to the worm drive 622 of the automatic switch control 600. As such, the user 30 (FIG. 1) can rely on the automatic switch control 650 to move the toggle 28 to the on position or the off position in response to one or more signals and/or circumstances (singular or in combination) that can be detected by a sensor module 684. The sensor module 684 can be connected to a control module 686 that can control the automatic switch control 650 similar to the automatic switch control 600, as shown in FIG. 22, discussed herein.

The gear assembly 678 can omit the centrifugal clutch 640 (FIG. 22) in contrast to the automatic switch control 600. With this said, the electric motor 676 can rotate the worm drive 672 to move the follower member 682 and the yoke member 652 to the top position. In the top position, the yoke member 652 can contact a first position sensor 688 and move the toggle 28 to the on position, as shown in FIG. 26. The electric motor 676 can also rotate the worm drive 672 in the opposite direction to move the follower member 682 and the yoke member 652 to the bottom position, as shown in FIG. 24. In the bottom position, the yoke member 652 can contact a second position sensor 690 and move the toggle 28 to the off position.

In further contrast to the automatic switch control 600 (FIG. 22), the electric motor 676 of the automatic switch control 650 can also rotate the worm drive 672 to move the follower member 682 and the yoke member 652 to a neutral position, as shown in FIG. 25. In the neutral position, the yoke member 652 can contact a third position sensor 692 and move the toggle 28 to the off position. When the yoke member 652 contacts the first position sensor 688, the second position sensor 690, and/or the third position sensor 692, the electric motor 676 can stop driving the worm drive 672. When the control module 686 detects reduced power available to the automatic switch control 650, the control module 686 can move the yoke member 652 to the neutral position to avoid leaving the yoke member 652 in a position other than the neutral position without sufficient power to move the yoke member 652.

The first aperture 662 formed in the yoke member 652 can be sized to encircle the toggle 28, but unlike the yoke member 602 (FIG. 22), no portion of the yoke member 652 is present in the area defined by the range of motion 60 (FIG. 6) of the toggle 28, when the yoke member 652 is the neutral position. In this regard, the user 30 can remain able to manually move the toggle 28 between the on and the off positions and the switch 26 remains able to move the toggle 28 under its own power. As such, the first aperture 662 is large enough where the toggle 28 can move between the on position and the off position while not coming into contact with the yoke member 652, when the yoke member 652 is in the neutral position.

With reference to FIG. 27 and FIG. 28, an automatic switch control 700 in accordance with another example of the present teachings can be placed over the toggle 28 of the switch 26 and can move the toggle 28 between the on position and the off position. The automatic switch control 700 can also permit the user 30 (FIG. 1) to manually move the toggle 28 and permit the switch 26 to move the toggle 28 under its own power between the on position and the off position.

The automatic switch control 700 can include a yoke member 702 that can be slidably supported on a housing 704 of the automatic switch control 700. The yoke member 702 can have gear teeth 706 on one side of the yoke member 702 that can permit the yoke member 702 to travel longitudinally with the toggle 28 and in a direction generally parallel to a longitudinal axis 708 of the automatic switch control 700. The yoke member 702 can define a first aperture 710 that can be sized to accept the toggle 28. The gear teeth 706 on the yoke member 702 can engage a gear assembly 712. The gear assembly 712 can connect a worm drive 714 to the yoke member 702. The worm drive 714 can have a drive member 716 that can be rotated by an electric motor 718. The worm drive 714, the gear assembly 712, and the electric motor 718 can be connected to a rear shell member 720 of the housing 704.

The worm drive 714 can rotate the drive member 716 in a first direction. The yoke member 702, in response, can move in an upward direction that can be parallel to the longitudinal axis 708. The yoke member 702 can move upward and stop in a top position (FIG. 27) where the yoke member 702 can move the toggle 28 to the on position. When the worm drive 714 rotates the drive member 716 in a second, opposite direction, the yoke member 702 can move in a downward direction that can be parallel to the longitudinal axis 708. The yoke member 702 can move downward and stop in a bottom position (FIG. 28) where the yoke member 702 can move the toggle 28 to the off position.

The electric motor 718 can selectively rotate the worm drive 714 in either direction to move the yoke member 702 and the toggle 28 to the on position or the off position. As such, the user 30 (FIG. 1) can rely on the automatic switch control 700 to move the toggle 28 to the on position or the off position in response to one or more signals and/or circumstances (singular or in combination) that can be detected by a sensor module 722 that can be connected to a control module 724 that can control the automatic switch control 700 similar to the automatic switch control 600 discussed herein.

The gear assembly 712 can include a centrifugal clutch 726. The centrifugal clutch 726 can permit the yoke member 702 to disengage from the gear assembly 712 when the rotational speed of the gear assembly 712 at the centrifugal clutch 726 is below a threshold value. When the threshold value is exceeded, the centrifugal clutch 726 can close and can connect the yoke member 702 to the worm drive 714 and the electric motor 718.

The electric motor 718 can rotate the worm drive 714 to move the yoke member 702 to the top position. In the top position (FIG. 28), the yoke member 702 can contact a first position sensor 730 and move the toggle 28 to the on position. The electric motor 718 can also rotate the worm drive 714 to move the yoke member 702 to the bottom position. In the bottom position (FIG. 27), the yoke member 702 can contact a second position sensor 732 and move the toggle 28 to the off position. Also, when the yoke member 702 contacts the first position sensor 730 or the second position sensor 732, the electric motor 718 can stop driving the worm drive 714 and because the rotational speed drops below the threshold value, the centrifugal clutch 726 can open and can disengage the yoke member 702 from the worm drive 714.

When the centrifugal clutch 726 is open, the yoke member 702 can be disconnected from the worm drive 714 and the yoke member 702 can be moved manually, that is without assistance from the electric motor 718. For example, the user 30 can grasp the toggle 28 and can move the toggle 28 from the on position to the off position, or vice versa. The yoke member 702 can still connect to the gear assembly 712 but does not back drive the gear assembly 712 and the electric motor 718 because the centrifugal clutch 726 is open.

The first aperture 710 formed in the yoke member 702 can be sized to encircle the toggle 28 so some portions of the yoke member 702 are present in the area defined by the range of motion 60 (FIG. 6) of the toggle 28. Even though the toggle 28 must be in contact with at least a portion of the yoke member 702 to move through its range of motion 60, the user 30 (FIG. 1) remains able to manually move the toggle 28 between the on position and the off position. Moreover, the switch 26 remains able to move the toggle 28 under its own power when the centrifugal clutch 726 is open such that the force required to move the follower member 632 longitudinally in the upward direction or the downward direction is less than the force exerted by the switch 26 on the toggle 28 that would be required to move the toggle 28 from one of the intermediate positions to the on position or the off position.

With reference to FIG. 27, when the toggle 28 is in the off position, the yoke member 702 can be in the corresponding bottom position. When the sensor module 722 receives one or more signals to activate the automatic switch control 700, the control module 724 can start the electric motor 718. Once the electric motor 718 rotates the gear assembly 712 beyond the threshold rotational speed, the centrifugal clutch 726 can close. When the centrifugal clutch 726 closes, the gear assembly 712 can connect to the yoke member 702 to move the yoke member 702 toward the top position and move the toggle 28 from the off position to the on position.

With reference to FIG. 28, the first position sensor 730 can detect that the yoke member 702 has moved to the top position and can deactivate the electric motor 718 and the worm drive 714 can cease to rotate. At this time, when the user 30 manually moves the toggle 28 from the on position to the off position, the yoke member 702 can be pulled with the toggle 28. This is possible because the yoke member 702 is not connected to the gear assembly 712 and the electric motor 718 because there is insufficient rotational motion imparted by the electric motor 718 and, therefore, the centrifugal clutch 726 can remain open. When the sensor module 722 receives another signal to activate the automatic switch control 700, the control module 724 can start the electric motor 718. With the toggle 28 in the on position, the drive member 716 can rotate in an opposite direction to move the yoke member 702 back to the bottom position and can move the toggle 28 from the on position to the off position.

With reference to FIG. 27, the second position sensor 732 can detect that the yoke member 702 has moved to the bottom position. At this point, the control module 724 can deactivate the electric motor 718 and the worm drive 714 can cease to rotate. The user 30 (FIG. 1) can nevertheless continue to manually move the toggle 28 from the off position to the on position, or vice versa. The yoke member 702 can be pulled with the toggle 28 because the yoke member 702 is not connected to the gear assembly 712 and the centrifugal clutch 726 can remain open.

With reference to FIG. 29, FIG. 30, and FIG. 31, an automatic switch control 750 in accordance with another example of the present teachings can be placed over the toggle 28 of the switch 26 and can move the toggle 28 between the on position and the off position in a similar fashion to the automatic switch control 650, as shown in FIG. 24. The automatic switch control 750 can also permit the user 30 (FIG. 1) to manually move the toggle 28 and permit the switch 26 to move the toggle 28 under its own power between the on position and the off position.

The automatic switch control 750 can include a yoke member 752 that can be slidably supported on a housing 754 of the automatic switch control 750. The yoke member 752 can have gear teeth 756 on one side of the yoke member 752 that can permit the yoke member 752 to travel longitudinally with the toggle 28 and in a direction generally parallel to a longitudinal axis 758 of the automatic switch control 750. The yoke member 702 can define a first aperture 760 that can be sized to accept the toggle 28. The gear teeth 756 on the yoke member 752 can engage a gear assembly 762. The gear assembly 762 can connect a worm drive 764 to the yoke member 752. The worm drive 764 can have a drive member 766 that can be rotated by an electric motor 768. The worm drive 764, the gear assembly 762, and the electric motor 768 can be connected to a rear shell member 770 of the housing 704.

When the worm drive 764 rotates the drive member 766 in the first direction and in the second, opposite direction, the yoke member 752 can move in a longitudinal direction. As such, the user 30 (FIG. 1) can rely on the automatic switch control 750 to move the toggle 28 to the on position or the off position in response to one or more signals and/or circumstances (singular or in combination) that can be detected by a sensor module 772. The sensor module 772 can be connected to a control module 774 that can control the automatic switch control 750 similar to the automatic switch control 700 discussed herein.

The gear assembly 762 can omit a centrifugal clutch in contrast to the automatic switch control 700. The electric motor 768 can rotate the worm drive 764 to move the yoke member 752 to the top position. In the top position (FIG. 31), the yoke member 752 can contact a first position sensor 776 and move the toggle 28 to the on position. The electric motor 768 can also rotate the worm drive 764 to move the yoke member 752 to the bottom position. In the bottom position (FIG. 29), the yoke member 752 can contact a second position sensor 778 and move the toggle 28 to the off position.

In contrast to the automatic switch control 700, the electric motor 768 of the automatic switch control 750 can also rotate the worm drive 764 to move the yoke member 752 to the neutral position, as shown in FIG. 30. In the neutral position, the yoke member 752 can contact a third position sensor 780. When the yoke member 752 contacts the first position sensor 776, the second position sensor 778, and/or the third position sensor 780, the electric motor 768 can stop driving the worm drive 764. When the control module 774 detects reduced power available to the automatic switch control 750, the control module 774 can move the yoke member 752 to the neutral position to avoid leaving the yoke member 752 in a position other than the neutral position without sufficient power to move the yoke member 752.

The first aperture 760 formed in the yoke member 752 can be sized to encircle the toggle 28. Unlike the yoke member 702 (FIG. 27), however, no portion of the yoke member 752 is present in the area defined by the range of motion 60 (FIG. 1) of the toggle 28, when the yoke member 752 is in the neutral position. In this regard, the user 30 (FIG. 1) remains able to manually move the toggle 28 between the on and the off positions and the switch 26 remains able to move the toggle 28 under its own power. As such, the first aperture 760 can be large enough so the toggle 28 can move between the on position and the off position while not coming into contact with the yoke member 752, when the yoke member 752 is in the neutral position. With the yoke member 752 in the neutral position, the user 30 (FIG. 1) can manually move the toggle 28 from the on position to the off position and the yoke member 752 is not pulled with the toggle 28 but can remain in the neutral position.

With reference to FIG. 32 through FIG. 36, an automatic switch control 800 in accordance with another example of the present teachings can be placed over the toggle 28 and can move the toggle 28 between the on position and the off position. The automatic switch control 800 can also permit the user 30 (FIG. 1) to manually move the toggle 28 and permit the switch 26 to move the toggle 28 under its own power between the on position and the off position.

The automatic switch control 800 can include a yoke member 802 that can be slidably supported on a housing 804 of the automatic switch control 800. The yoke member 802 can move in a direction generally parallel to a longitudinal axis 806 of the automatic switch control 800. The yoke member 802 can define a first aperture 808 that can be sized to accept the toggle 28. The yoke member 802 can also include a first set of gear teeth 810 and a second set of gear teeth 812 that are spaced from one another by a smooth portion 814 (i.e., no gear teeth) of the yoke member 802.

A gear drive 820 can have a drive member 822 that can be rotated by an electric motor 824. The drive member 822 can engage to and rotate a gear member 826 that can connect the gear drive 820 to the yoke member 802. The gear drive 820, the gear member 826, and the electric motor 824 can be connected to a front shell member 830 of the housing 804, while the yoke member 802 can be slidably connected to a rear shell member 832 of the housing 804. The gear drive 820 can rotate the drive member 822 in a first direction and in a second, opposite direction to move the yoke member 802. As such, the user 30 (FIG. 1) can rely on the automatic switch control 800 to move the toggle 28 to the on position or the off position in response to one or more signals and/or circumstances similar to the automatic switch control 10 discussed herein.

Figure 32:
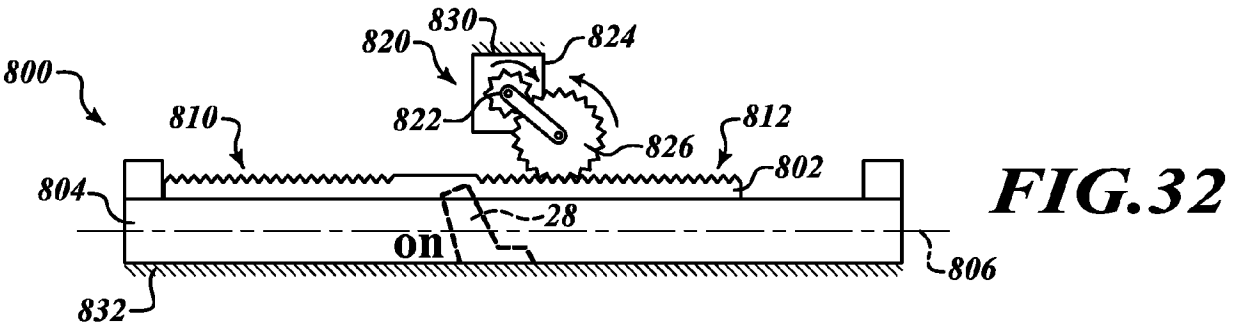

With reference to FIG. 32, when the toggle 28 is in the on position, the yoke member 802 can be in the corresponding top position. The electric motor 824 can rotate the drive member 822 to rotate the gear member 826. The gear member 826 can be in engagement with the second portion of the gear teeth 812 to move the yoke member 802 in a downward direction. By moving the yoke member 802 in the downward direction, the yoke member 802 can move toward the bottom position and move the toggle 28 from the on position to the off position.

Figure 33:
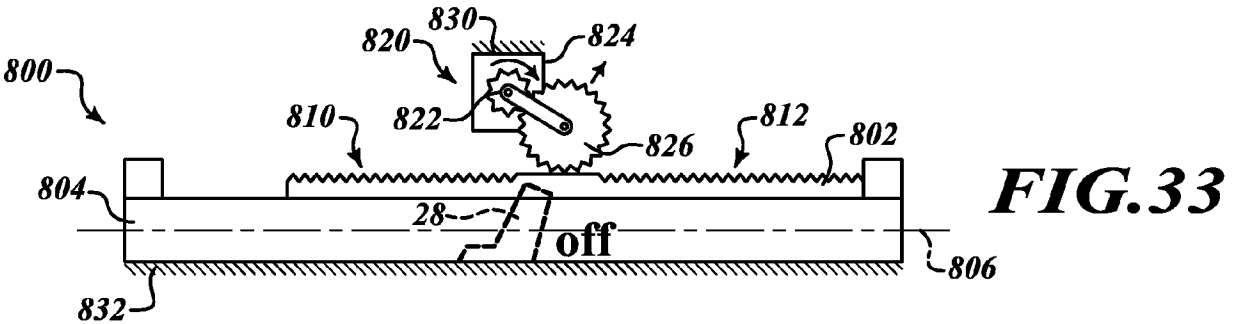
Figure 34:
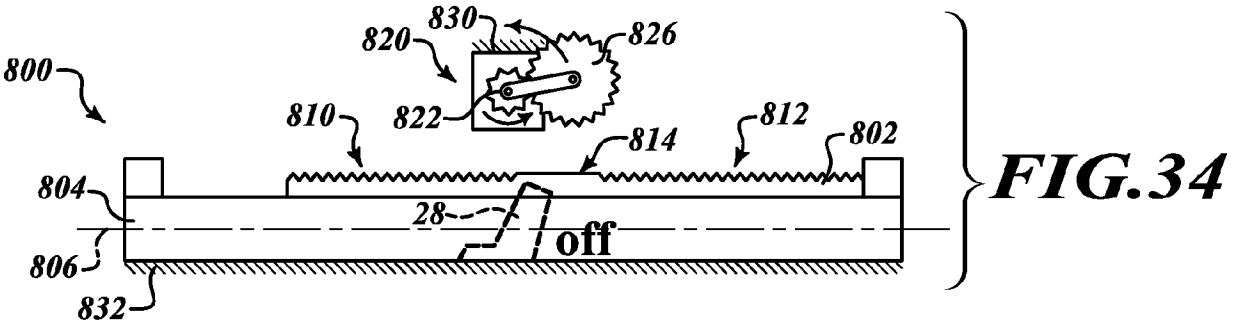

With reference to FIG. 33, the gear drive 820 can detect that the yoke member 802 has moved to the bottom position because the gear drive 820 can encounter the smooth portion 814 on the yoke member 802 and a load on the gear drive 820 can be shown to be reduced. When the gear drive 820 encounters the smooth portion 814, the gear drive 820 can lift and disengage the gear member 826 from the yoke member 802 and in a sense the gear drive 820 can lift and idle the gear member 826. With reference to FIG. 34, the gear drive 820 can pause with the gear member 826 disengaged from the yoke member 802, so that the yoke member 802 can be moved manually with manual movement of the toggle 28.

Figure 35:
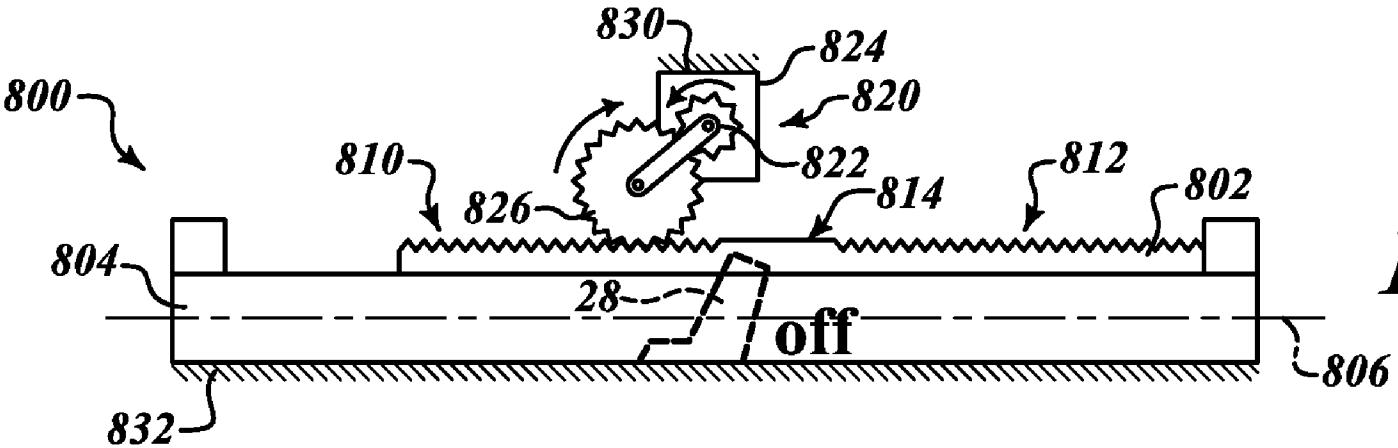

With reference to FIG. 35, the automatic switch control 800 can be commanded to move the toggle 28 from the off position to the on position. In doing so, the electric motor 824 can rotate the drive member 822 to rotate the gear member 826. The gear member 826 can continue to rotate around the drive member 822 and come into engagement with the first set of the gear teeth 810. Once the gear member 826 engages the first set of the gear teeth 810, the gear drive 820 can move the yoke member 802 in an upward direction. By moving the yoke member 802 in the upward direction, the yoke member 802 can move toward the top position and move the toggle 28 from the off position to the on position.

Figure 36:
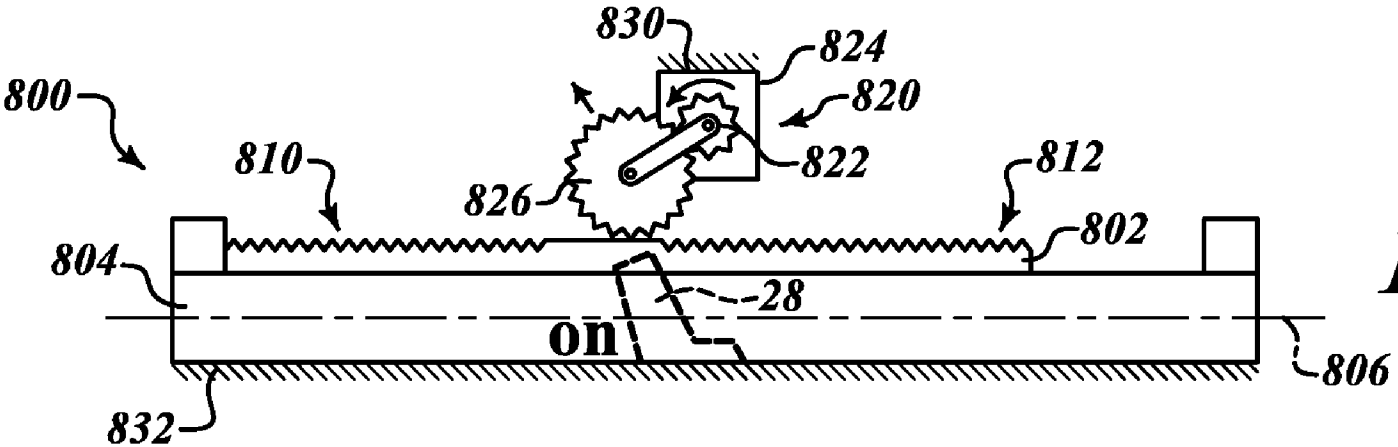

With reference to FIG. 36, the gear drive 820 can detect that the yoke member 802 has moved to the top position because the gear drive 820 can encounter the smooth portion 814 on the yoke member 802. When the gear drive 820 encounters the smooth portion 814, the gear drive 820 can lift and therefore idle the gear member 826 from the yoke member 802 to once again allow manual movement of the toggle 28.

With reference to FIG. 37, FIG. 38, and FIG. 39, an automatic switch control 850 in accordance with another example of the present teachings can be placed over the toggle 28 of the switch 26 and can move the toggle 28 between the on position and the off position in a similar fashion to the automatic switch control 600, as shown in FIG. 22. The automatic switch control 850 can also permit the user 30 (FIG. 1) to manually move the toggle 28 and permit the switch 26 to move the toggle 28 under its own power between the on position and the off position.

The automatic switch control 850 can include a yoke member 852 that can be rotatably supported on a housing 854 of the automatic switch control 850. The yoke member 852 can have a pivot portion 856 on one side of the yoke member 852 that can be pivotally attached to the housing 854 with a pin member 858. The pin member 858 can allow the yoke member 852 to pivot in a curved path relative to the toggle 28 that in contrast can move in a direction generally parallel to a longitudinal axis 860 of the automatic switch control 850.

The yoke member 852 can define a first aperture 862 that can be completely internal within the yoke member 852 and thus can form an inner periphery 864. The first aperture 862 can be sized to accept the toggle 28 of the switch 26. The yoke member 852 can also define a tab member 866 at an end portion 868 of the yoke member 852 that can be opposite the pivot portion 856. The tab member 866 can extend from the end portion 868 and can be accepted by a catch member 870 that can be connected to a worm drive 872. The yoke member 852 can also include a spring member 874 that can connect to the housing 804. Cooperation between the catch member 870, the tab member 866, and the spring member 874 can transfer the longitudinal motion of the catch member 870 to pivotal motion of the yoke member 852.

The worm drive 872 can move the catch member 870 longitudinally when an electric motor 876 rotates. The electric motor 876 can rotate a drive member 878 that can be received for threaded engagement with the catch member 870 so that rotation of the drive member 878 can cause longitudinal movement of the catch member 870. The worm drive 872 and the electric motor 876 can be connected to the housing 854.

With reference to FIG. 37, when the toggle 28 is in the off position, the yoke member 852 can be in the corresponding bottom position. The spring member 874 can further hold the yoke member 852 in the bottom position. The electric motor 876 can rotate the drive member 878 to move the catch member 870. A bottom stop member 880 formed on the catch member 870 can contact the tab member 866 and can move the yoke member 852 in an upward direction. By moving the yoke member 852 in the upward direction, the yoke member 852 can move toward the top position and move the toggle 28 from the off position to the on position.

With reference to FIG. 38, once the yoke member 852 has moved to the top position, the electric motor 876 can move the catch member 870 downward to a neutral position, as shown in FIG. 39. Once the catch member 870 reaches the neutral position, the electric motor 876 can be deactivated. With the catch member 870 in the neutral position, the user 30 (FIG. 1) can manually move the toggle 28 from the on position to the off position and the catch member 870 is not pulled with the toggle 28 but can remain in the neutral position. The user 30 can move the toggle 28 to enter the on position or the off position while the catch member 870 is in the neutral position. In doing so, the yoke member 852 can move with the toggle 28 and be held in the on position or the off position by the spring member 874 but otherwise not be obstructed by the catch member 870. It will be appreciated in light of the disclosure that the spring member 874 can serve to make the neutral position (i.e., a middle position) of the yoke member 852 unstable, so that the toggle 28 is always forced to the on position or to the off position once the catch member 870 initiates any motion. In the event that the catch member 870 fails to complete its motion, the spring member 874 can ensure that the toggle 28 remains in either the on position or the off position.

With reference to FIG. 40, FIG. 41, and FIG. 42, an automatic switch control 900 in accordance with another example of the present teachings can be placed over the toggle 28 of the switch 26 and can move the toggle 28 between the on position and the off position in a similar fashion to the automatic switch control 650, as shown in FIG. 24. The automatic switch control 900 can also permit the user 30 (FIG. 1) to manually move the toggle 28 and permit the switch 26 to move the toggle 28 under its own power between the on position and the off position.

The automatic switch control 900 can include a yoke member 902 that can be slidably supported on a housing 904 of the automatic switch control 900. The yoke member 902 can be coupled to a drive member 906 so the yoke member 902 and the toggle 28 can move in a direction generally parallel to a longitudinal axis 908 of the automatic switch control 900.

The yoke member 902 can define a first aperture 910 that can be sized to accept the toggle 28 of the switch 26. The drive member 906 can include a telescoping member 912 that can move the yoke member 902 longitudinally when an electric motor 914 rotates. The electric motor 914 can extend or retract the telescoping member 912 to cause the longitudinal movement of the yoke member 902. The drive member 906, the telescoping portion 912, and the electric motor 914 can be connected to the housing 904.

With reference to FIG. 40, when the toggle 28 is in the off position, the telescoping portion 912 can hold the yoke member 902 in the corresponding bottom position. The electric motor 914 can engage the drive member 906 to move the yoke member 902 in an upward direction. By moving the yoke member 902 in the upward direction, the yoke member 902 can move toward the top position and move the toggle 28 from the off position to the on position.

With reference to FIG. 41, once the yoke member 902 has moved to the top position, the electric motor 914 can have the drive member 906 move the yoke member 902 downward to a neutral position, as shown in FIG. 42. Once the yoke member 902 reaches the neutral position, the electric motor 914 can be deactivated and the telescoping portion 912 can hold the yoke member 902 in the neutral position. With the yoke member 902 in the neutral position, the user 30 (FIG. 1) can manually move the toggle 28 from the on position to the off position and the yoke member 902 is not pulled with the toggle 28 but otherwise can remain in the neutral position.

With reference to FIG. 43, FIG. 44, and FIG. 45, an automatic switch control 950 in accordance with another example of the present teachings can be placed over the toggle 28 of the switch 26 and can move the toggle 28 between the on position and the off position in a similar fashion to the automatic switch control 600, as shown in FIG. 22. The automatic switch control 950 can also permit the user 30 (FIG. 1) to manually move the toggle 28 and permit the switch 26 to move the toggle 28 under its own power between the on position and the off position.

The automatic switch control 950 can include a yoke member 952 that can be slidably supported on a housing 954 of the automatic switch control 950. The yoke member 952 can include a top slide member 956 and a bottom slide member 958. A first plunger mechanism 960 can move the top slide member 956 toward the off position of the toggle 28 and a second plunger mechanism 962 can move the bottom slide member 958 toward the on position of the toggle 28. The top and the bottom slide members 956, 958 can move in a direction generally parallel to a longitudinal axis 964 of the automatic switch control 950.

The yoke member 952 can define a first aperture 966 between a tab member 968 on the top slide member 956 and a tab member 970 on the bottom slide member 958 that can be sized to accept the toggle 28 of the switch 26. Above the tab member 968, the top slide member 956 can also include a curved portion 972 and below the tab member 970, the bottom slide member 958 can also include a curved portion 974. The first plunger mechanism 960 can include a wire 976 that can be disposed around the curved portion 972 of the top slide member 956 and can be connected to posts 978 located at the bottom of the housing 954. The second plunger mechanism 962 can include a wire 980 that can be disposed around the curved portion 974 of the bottom slide member 958 and can be connected to posts 982 located at the top of the housing 954. The wire 976, 980 can be a shape-memory alloy wire, such as nitinol, that can constrict in response to heating of the wire from a current applied to the wire. A spring member 984 can be disposed between a stop member 986 and the curved portion 972 of the top slide member 956 to urge the top slide member 956 toward the top of the housing 954 and away from the toggle 28. A spring member 988 can be similarly disposed between a stop member 990 and the curved portion 974 of the bottom slide member 958 to urge the bottom slide member 958 toward the bottom of the housing 954 and away from the toggle 28.

The toggle 28 is in the off position and the yoke member 952 is in the bottom position, as shown in FIG. 43. The first plunger mechanism 960 can constrict the wire 976 to urge the top slide member 956 toward the toggle 28. With reference to FIG. 44, the second plunger mechanism 962 can constrict the wire 980 to move the bottom slide member 958 toward the toggle 28 and move the toggle 28 to the on position. With reference to FIG. 45, both the wires 976, 980 can loosen such that the spring members 984, 988 can urge the yoke member 952 to the neutral position, as shown in FIG. 45. In the neutral position, the tab member 968 on the top slide member 956 and the tab member 970 on the bottom slide member 958 can be located outside the range of motion 60 (FIG. 6) of the toggle 28 so that the toggle 28 can be moved manually or by the switch 26 under its own power.

With reference to FIG. 46, FIG. 47, and FIG. 48, an automatic switch control 1000 in accordance with another example of the present teachings can be placed over the toggle 28 of the switch 26 and can move the toggle 28 between the on position and the off position in a similar fashion to the automatic switch control 600, as shown in FIG. 22. The automatic switch control 1000 can also permit the user 30 (FIG. 1) to manually move the toggle 28 and permit the switch 26 to move the toggle 28 under its own power between the on position and the off position.

The automatic switch control 1000 can include a yoke member 1002 that can be rotatably supported on a housing 1004 of the automatic switch control 1000. The yoke member 1002 can have a pivot portion 1006 on one side of the yoke member 1002 that can be pivotally attached to the housing 1004 with a pin member 1008. The pin member 1008 can allow the yoke member 1002 to pivot in a curved path relative to the toggle 28 that in contrast can move in a direction generally parallel to a longitudinal axis 1010 of the automatic switch control 1000.

The yoke member 1002 can define a first aperture 1012 that can be completely internal within the yoke member 1002 and thus can form an inner periphery 1014. The first aperture 1012 can be sized to accept the toggle 28 of the switch 26. The yoke member 1002 can also define gear teeth 1016 on an end portion 1018 of the yoke member 1002 that can be opposite the pivot portion 1006. The gear teeth 1016 can extend from the end portion 1018 and can engage a drive member 1020 of a worm drive 1022. Cooperation between the gear teeth 1016 on the yoke member 1002 and the worm drive 1022 can transfer the rotational motion of the worm drive 1022 to pivotal motion of the yoke member 1002. An electric motor 1024 can rotate the drive member 1020, so that gear teeth 1026 on the drive member 1020 can engage the gear teeth 1016 on the yoke member 1002 so that rotation of the drive member 1020 can cause pivotal motion of the yoke member 1002. The worm drive 1022 and the electric motor 1024 can be connected to a rear shell member 1028 of the housing 1004.

With reference to FIG. 46, when the toggle 28 is in the off position, the yoke member 1002 can be in the corresponding bottom position. The worm drive 1022 can hold the yoke member 1002 in the bottom position. The electric motor 1024 can rotate the drive member 1020 to pivot the yoke member 1002 in an upward direction. By pivoting the yoke member 1002 in the upward direction, the yoke member 1002 can move toward the top position and can, in turn, move the toggle 28 from the off position to the on position, as shown in FIG. 47.

With reference to FIG. 48, once the yoke member 1002 has moved to the top position (FIG. 47) or to the bottom position (FIG. 46), the electric motor 1024 can rotate the drive member 1020 to move the yoke member 1002 to a neutral position, as shown in FIG. 48. Once the yoke member 1002 reaches the neutral position, the electric motor 1024 can be deactivated. With the yoke member 1002 in the neutral position, the user 30 (FIG. 1) can manually move the toggle 28 from the on position to the off position and in doing so the yoke member 1002 is not pulled with the toggle 28 but can remain in the neutral position. Because the aperture 1012 can be large enough so that the inner periphery 1014 of the aperture 1012 can be disposed outside of the range of motion 60 (FIG. 6) of the toggle 28, the aperture 1012 of the yoke member 1002 can be shown to not obstruct the movement of the toggle 28 to the off position or the on position when the yoke member 1002 is in the neutral position. Moreover, the yoke member 1002 can be shown to not have any direct contact with the toggle 28 during its movement to the off position or the on position when the yoke member 1002 is in the neutral position.

With reference to FIG. 49, FIG. 50, and FIG. 51, an automatic switch control 1050 in accordance with another example of the present teachings can be placed over the toggle 28 of the switch 26 and can move the toggle 28 between the on position and the off position in a similar fashion to the automatic switch control 1000, as shown in FIG. 46. The automatic switch control 1050 can also permit the user 30 (FIG. 1) to manually move the toggle 28 and also permit the switch 26 to move the toggle 28 under its own power between the on position and the off position.

The automatic switch control 1050 can include a yoke member 1052 connected to a housing 1054 with a pivot portion 1056 on one side of the yoke member 1052 with a pin member 1058. The pin member 1058 can allow the yoke member 1052 to pivot in a curved path relative to the toggle 28 that can move in a longitudinal direction generally parallel to a longitudinal axis 1060 of the automatic switch control 1050.

The yoke member 1052 can define a first aperture 1062 that can be completely internal within the yoke member 1052 and thus can form an inner periphery 1064 that can be sized to surround the toggle 28 of the switch 26. The yoke member 1052 can also include gear teeth 1066 on an end portion 1068 of the yoke member 1052 that can be opposite the pivot portion 1056. The gear teeth 1066 can extend from the end portion 1068 and can be engaged by a drive member 1070 of a worm drive 1072. Cooperation between the gear teeth 1066 on the yoke member 1052 and the drive member 1070 of the worm drive 1072 can transfer the rotational motion of the worm drive 1072 to the pivotal motion of the yoke member 1052. An electric motor 1074 can rotate the drive member 1070 so that gear teeth 1076 on the drive member 1070 can engage the gear teeth 1066 and cause the pivotal motion of the yoke member 1052. The worm drive 1072 and the electric motor 1074 can be connected to a rear shell member 1078 of the housing 1054.

The yoke member 1052 can include a spring member 1080 that can be connected to the yoke member 1052 with a pin member 1082 that can be disposed between the pin member 1058 and the toggle 28 when the automatic switch control 1050 is installed over the switch 26. The spring member 1080 can be connected between the pin member 1082 and a toggle mover member 1084 that can pivotally supported by the pin member 1082. The spring member 1080 can hold the toggle mover member 1084 in a neutral condition that can align the toggle mover member 1084 with an axis 1086, as shown in FIG. 51. The toggle mover member 1084 can be deflected out of alignment with the axis 1086 (i.e., moved to a deflected condition) to generate a spring force in the spring member 1080. The spring member 1080 can be a torsion spring that can connect to the pin member 1082. When the toggle mover member 1084 is moved from the neutral condition to the deflected condition, the toggle mover member 1084 can wind up (i.e., load) the spring member 1080. In the neutral condition, the spring member 1080 can be aligned with the axis 1086 that can extend from the pin member 1082 and can divide the aperture 1062 into two equal portions.

A first pin member 1088 and a second pin member 1090 can extend from the rear shell member 1078 in a perpendicular direction and can provide a fail-safe functionality to the automatic switch control 1050. The fail-safe functionality can be shown to prevent the toggle mover member 1084 from leaving the toggle 28 in any position except at or near the top position or at or near the bottom position even when the automatic switch control 10 loses operability and the electric motor 1074 is unable to complete movement of the yoke member 1052 to the top position or to the bottom position. The first pin member 1088 and the second pin member 1090 can be connected to the rear shell member 1078 on an opposite side of the toggle 28 and the longitudinal axis 1060 from the pin member 1058 that can connect the yoke member 1052 to the rear shell member 1078. The first pin member 1088 can be disposed above the toggle 28 and the second pin member 1090 can be disposed beneath the toggle 28. The first pin member 1088 and the second pin member 1090 can both be in a position that can partially obstruct the movement of the toggle mover member 1084.

The toggle mover member 1084 can ultimately push the toggle 28 into the on position or the off position and then the toggle mover member 1084 can skip over the toggle 28 as the yoke member 1052 can complete its motion to the top position or the bottom position, respectively. At that point, the yoke member 1052 can move into the neutral position (FIG. 51) that is disengaged from the toggle 28 and permits manual movement of the toggle 28 by the switch 26 or the user 30 (FIG. 1). As shown in FIG. 49, when the toggle 28 is in the on position, the yoke member 1052 can move toward the bottom position. The toggle mover member 1084 can come into contact with the pin member 1088. As the yoke member 1052 continues to rotate, the toggle mover member 1084 can deflect (i.e., wind up) the spring member 1080. When the yoke member 1052 arrives at (or near) the bottom position, the toggle mover member 1084 can skip past the pin member 1088 and can return to the neutral condition but in doing so can contact the toggle 28 to move the toggle 28 to the off position as the spring member 1080 unwinds (i.e., unloads) from being deflected against the pin member 1088.

With reference to FIG. 50, the electric motor 1074 can rotate the drive member 1070 to rotate the yoke member 1052 toward to the top position. By rotating the yoke member 1052 in the upward direction, the toggle mover member 1084 can be deflected against the second pin member 1090 to once again wind up (i.e., load) the spring member 1080. As the toggle mover member 1084 continues to move with the yoke member 1052, the toggle mover member 1084 can move past the second pin member 1090 and can contact a bottom portion of the toggle 28 to move the toggle 28 toward the top position as shown in FIG. 51. It will be appreciated in light of the disclosure that the toggle mover member 1084 can be in the deflected condition as the spring member 1080 unwinds (i.e., unloads) and moves to the neutral condition, while moving the toggle 28 to the on position or to the off position.

With reference to FIG. 51, once the yoke member 1052 has moved to (or near) the top position, the toggle mover member 1084 can skip past the toggle 28 to a position just above the toggle 28. The worm drive 1072 can hold the yoke member 1052 in the top position or in the bottom position. When the toggle mover member 1084 skips past the toggle 28 and returns to the neutral condition, the toggle mover member 1084 is no longer in contact with the toggle 28 and the yoke member 1052 can move to the top position. As such, the yoke member 1052 can be in the neutral position that is disengaged from the toggle 28, and permits manual movement of the toggle 28 by the switch 26 or the user 30 (FIG. 1). With the yoke member 1052 in the neutral position, the electric motor 1074 can be deactivated. With the yoke member 1052 in the neutral position, the user 30 (FIG. 1) can manually move the toggle 28 between the on position and the off position and the yoke member 1052 is not pulled with the toggle 28 but can remain in the neutral position. The toggle 28 can move between the on position and the off position because the toggle mover member 1084 and the yoke member 1052 can remain outside of the range of motion 60 (FIG. 6) of the toggle 28 and therefore do not obstruct the motion of the toggle 28.

With reference to FIG. 52, FIG. 53, and FIG. 54, an automatic switch control 1100 in accordance with another example of the present teachings can be placed over the toggle 28 of the switch 26 and can move the toggle 28 between the on position and the off position in a similar fashion to the automatic switch control 1050, as shown in FIG. 49. The automatic switch control 1100 can also permit the user 30 (FIG. 1) to manually move the toggle 28 and also permit the switch 26 to move the toggle 28 under its own power between the on position and the off position.

The automatic switch control 1100 can include a yoke member 1102 that can be slidably supported on a housing 1104 of the automatic switch control 1100. The yoke member 1102 can have gear teeth 1106 on one side of the yoke member 1102 that can be engaged to move the yoke member 1102 longitudinally with the toggle 28 and generally parallel to a longitudinal axis 1108 of the automatic switch control 1100. The yoke member 1102 can define a first aperture 1110 that can be completely internal within the yoke member 1102 and thus can form an inner periphery 1112 that can be sized to surround the toggle 28 of the switch 26. The gear teeth 1106 on the yoke member 1102 can be engaged by a drive member 1114 of a worm drive 1116. Cooperation between the gear teeth 1106 on the yoke member 1102 and the drive member 1114 of the worm drive 1116 can transfer the rotational motion of the worm drive 1116 to the longitudinal motion of the yoke member 1102. An electric motor 1118 can rotate the drive member 1114 to impart the longitudinal motion on the yoke member 1102. The worm drive 1116 and the electric motor 1118 can be connected to a rear shell member 1122 of the housing 1104.

The yoke member 1102 can include a spring member 1124 that can be connected to a pivot portion 1126 of the yoke member 1102 with a pin member 1128. The spring member 1124 can be connected between the pin member 1128 and a toggle mover member 1130 that can be pivotally supported by the pin member 1128. The spring member 1124 can hold the toggle mover member 1130 in a neutral condition that can align the toggle mover member 1130 with an axis 1134, as shown in FIG. 54. The toggle mover member 1130 can be deflected out of alignment with the axis 1134 (i.e., moved to a deflected condition) to generate a spring force in the spring member 1124. The spring member 1124 can be a torsion spring that can connect to the pin member 1128. When the toggle mover member 1130 is moved from the neutral condition to the deflected condition, the toggle mover member 1130 can wind up (i.e., load) the spring member 1128. In the neutral condition, spring member 1124 can be aligned with the axis 1134 that can extend from the pin member 1128 and can divide the aperture 1110 into two equal portions.

A first pin member 1136 and a second pin member 1138 can extend from the rear shell member 1122 in a perpendicular direction and can provide a fail-safe functionality to the automatic switch control 1100. It will be appreciated in light of the disclosure that the automatic switch control 10 can move the toggle 28 near the on position or near the off position to permit the switch 26 to complete the motion. The first pin member 1136 and the second pin member 1138 can be connected to the rear shell member 1122 on an opposite side of the toggle 28 and the longitudinal axis 1108 from the pin member 1058 that can connect the yoke member 1102 to the rear shell member 1122. The first pin member 1136 can be disposed above the toggle 28 and the second pin member 1138 can be disposed beneath the toggle 28. The first pin member 1136 and the second pin member 1138 can both be in a position that can partially obstruct the movement of the toggle mover member 1130. The fail-safe functionality can be shown to prevent the toggle mover member 1130 from leaving the toggle 28 in any position except at or near the on position or at or near the off position even when the automatic switch control 10 loses operability and the electric motor 1118 is unable to complete movement of the yoke member 1102 to the top position or to the bottom position.

The toggle mover member 1130 can ultimately push the toggle 28 into the on position or the off position and then the toggle mover member 1130 can skip over the toggle 28 as the yoke member 1102 can complete its longitudinal motion to the top position or the bottom position, respectively. At that point, the yoke member 1102 can move into the neutral position (FIG. 54) that is disengaged from the toggle 28 and permits manual movement of the toggle 28 by the switch 26 or the user 30 (FIG. 1). As shown in FIG. 52, when the toggle 28 is in the on position, the yoke member 1102 can move toward the bottom position. The toggle mover member 1130 can come into contact with the first pin member 1136. As the yoke member 1102 continues to slide downward, the toggle mover member 1130 can deflect (i.e., wind up) the spring member 1124. When the yoke member 1102 arrives at (or near) the bottom position, the toggle mover member 1130 can skip past the first pin member 1136 and can return to the neutral condition but in doing so can contact the toggle 28 to move the toggle 28 to the off position as the spring member 1124 unwinds (i.e., unloads) from being deflected against the first pin member 1136.

With reference to FIG. 53, the electric motor 1118 can rotate the drive member 1114 to move the yoke member 1102 to the top position. By sliding the yoke member 1102 upward, the toggle mover member 1130 can be deflected against the second pin member 1138 to once again wind up the spring member 1124. As the toggle mover member 1130 continues to move with the yoke member 1102, the toggle mover member 1130 can move past the second pin member 1138 and can contact a bottom portion of the toggle 28 to move the toggle 28 to (or near) the top position, as shown in FIG. 54. It will be appreciated in light of the disclosure that the toggle mover member 1130 can be in the deflected condition as the spring member 1124 unwinds and moves to the neutral condition, while moving the toggle 28 to (or near) the top position or to the bottom position With reference to FIG. 54, once the yoke member 1102 has moved to (or near) the top position, the toggle mover member 1130 can skip past the toggle 28 to a position just above the toggle 28. The worm drive 1116 can hold the yoke member 1102 in the top position or in the bottom position. When the toggle mover member 1130 skips past the toggle 28 and returns to the neutral condition that is aligned with the axis 1134, the toggle mover member 1130 is no longer in contact with the toggle 28 and the yoke member 1102 can move to the top position. As such, the yoke member 1102 can be in the neutral position that is disengaged from the toggle 28 and permits manual movement of the toggle 28 by the switch 26 or the user 30 (FIG. 1). Once the yoke member 1102 reaches the neutral position, the electric motor 1118 can be deactivated. With the yoke member 1102 in the neutral position, the user 30 (FIG. 1) can manually move the toggle 28 between the on position and the off position and the yoke member 1102 is not pulled with the toggle 28 but can remain in the neutral position. The toggle 28 can move between the on position and the off position because the toggle mover member 1130 and the yoke member 1102 can remain outside of the range of motion 60 (FIG. 6) of the toggle 28 and therefore do not obstruct the motion of the toggle 28.

With reference to FIG. 55, FIG. 56, and FIG. 57, an automatic switch control 1150 in accordance with another example of the present teachings can be placed over the toggle 28 of the switch 26 and can move the toggle 28 between the on position and the off position in a similar fashion to the automatic switch control 1100, as shown in FIG. 55. The automatic switch control 1150 can also permit the user 30 (FIG. 1)

to manually move the toggle 28 and permit the switch 26 to move the toggle 28 under its own power between the on position and the off position.

The automatic switch control 1150 can include a yoke member 1152 that can be slidably supported on a housing 1154 of the automatic switch control 1150. The yoke member 1152 can have gear teeth 1156 on one side of the yoke member 1152 that can be engaged to move the yoke member 1152 longitudinally with the toggle 28 and in a direction generally parallel to a longitudinal axis 1158 of the automatic switch control 1150. The yoke member 1152 can define a first aperture 1160 that can be completely internal within the yoke member 1152 and thus can form an inner periphery 1162 that can be sized to surround the toggle 28. The gear teeth 1156 on the yoke member 1152 can engage a drive member 1164 of a worm drive 1166. Cooperation between the gear teeth 1156 on the yoke member 1152 and the worm drive 1166 can transfer the rotational motion of the worm drive 1166 to longitudinal motion of the yoke member 1152. The worm drive 1166 can rotate the drive member 1164 with an electric motor 1168. Gear teeth 1170 on the drive member 1164 can engage the gear teeth 1156 so that rotation of the drive member 1164 can cause the longitudinal motion of the yoke member 1152. The worm drive 1166 and the electric motor 1168 can be connected to a rear shell member 1172 of the housing 1154.

The electric motor 1168 of the worm drive 1166 can rotate the drive member 1164 to move the yoke member 1152 to the bottom position, as shown in FIG. 55; the top position, as shown in FIG. 56; or to the neutral position, as shown in FIG. 57. As such, the user 30 (FIG. 1) can rely on the automatic switch control 1150 to move the toggle 28 to the on position or the off position in response to one or more signals and/or circumstances similar to the automatic switch control 10 discussed herein.

The first aperture 1160 formed in the yoke member 1152 can be sized to encircle the toggle 28, where no portion of the yoke member 1152 is present in the area defined by the range of motion 60 (FIG. 6) of the toggle 28 when the yoke member 1152 is in the neutral position. In this regard, the user 30 (FIG. 1) remains able to manually move the toggle 28 between the on position and the off position and the switch 26 remains able to move the toggle 28 under its own power while in the neutral position. As such, the first aperture 1160 is large enough where the toggle 28 can move between the on position and the off position while not coming into contact with the yoke member 1152, when the yoke member 1152 is in the neutral position.

With reference to FIG. 55, when the toggle 28 is in the off position, the yoke member 1152 can be in the corresponding bottom position. The worm drive 1166 can hold the yoke member 1152 in the bottom position. The electric motor 1168 can then rotate the drive member 1164 to pivot the yoke member 1152 in an upward direction. By pivoting the yoke member 1152 in the upward direction, the yoke member 1152 can move toward the top position and can, in turn, move the toggle 28 from the off position to the on position, as shown in FIG. 56.

With reference to FIG. 57, once the yoke member 1152 has moved to the top position (FIG. 56), the electric motor 1168 can rotate the drive member 1164 to move the yoke member 1152 to a neutral position (FIG. 60). Once the drive member 1164 reaches the neutral position, the electric motor 1168 can be deactivated. With the drive member 1164 in the neutral position, the user 30 (FIG. 1) can manually move the toggle 28 from the on position to the off position and the yoke member 1152 is not pulled with the toggle 28 but can remain in the neutral position. Because the first aperture 1160 can be large enough so that the inner periphery 1162 of the first aperture 1160 can be outside of the range of motion 60 (FIG. 6) of the toggle 28, the first aperture 1160 of the yoke member 1152 can be shown to not obstruct the movement of the toggle 28 to the off position or to the on position when the yoke member 1152 is in the neutral position.

With reference to FIG. 58, FIG. 59, and FIG. 60, an automatic switch control 1200 in accordance with another example of the present teachings can be placed over the toggle 28 of the switch 26 and can move the toggle 28 between the on position and the off position in a similar fashion to the automatic switch control 1150, as shown in FIG. 55. The automatic switch control 1200 can also permit the user 30 (FIG. 1) to manually move the toggle 28 and permit the switch 26 to move the toggle 28 under its own power between the on position and the off position.

The automatic switch control 1200 can include a yoke member 1202 that can be slidably supported on a housing 1204. The yoke member 1202 can have gear teeth 1206 on one side of the yoke member 1202 that can permit the yoke member 1202 to travel longitudinally with the toggle 28 and in a direction generally parallel to a longitudinal axis 1208 of the automatic switch control 1200. The yoke member 1202 can define a first aperture 1210 that can be sized to accept the toggle 28 and thus can form an inner periphery 1212.

The gear teeth 1206 on the yoke member 1202 can engage a drive member 1214 of a worm drive 1216. When engaged, cooperation between the gear teeth 1206 on the yoke member 1202 and the worm drive 1216 can transfer the rotational motion of the worm drive 1216 to a longitudinal motion of the yoke member 1202. An electric motor 1218 on the worm drive 1216 can rotate the drive member 1214, so gear teeth 1220 on the drive member 1214 can engage the gear teeth 1206 and rotation of the drive member 1214 can cause the longitudinal motion of the yoke member 1202. The worm drive 1216 and the electric motor 1218 can be connected to a rear shell member 1222 of the housing 1204.

When the worm drive 1216 rotates the drive member 1214 in the first direction and in the second, opposite direction, the yoke member 1202 can move in a longitudinal direction. For example, the electric motor 1218 can rotate the worm drive 1216 to move the yoke member 1202 to the bottom position, as shown in FIG. 58 and to the top position, as shown in FIG. 59. As such, the user 30 (FIG. 1) can rely on the automatic switch control 1200 to move the toggle 28 to the on position or the off position, respectively, in response to one or more signals and/or circumstances similar to the automatic switch control 700 discussed herein.

The first aperture 1210 formed in the yoke member 1202 can be sized to encircle the toggle 28, where no portion of the yoke member 1202 is present in the area defined by the range of motion 60 (FIG. 6) of the toggle 28 when the yoke member 1202 is in a neutral position. To move the yoke member 1202 to the neutral position, the yoke member 1202 can be moved away from the drive member 1214. In moving away from the drive member 1214, the yoke member 1202 compresses a spring member 1224 fixed between the yoke member 1202 and the housing 1204. The yoke member 1202 can also be moved away from the drive member 1214 when the yoke member 1202 is in the top or the bottom position so the yoke member 1202 can be manually moved to the neutral position without assistance from the worm drive 1216. The yoke member 1202 can be held away from the drive member 1214 by a latch or a catch to which the user 30 can manually move the yoke member 1202. Additional mechanisms can also be employed to automatically move the yoke member 1202 away from the drive member 1214 without intervention from the user 30. The spring member 1224 typically urges the gear teeth 1206 into engagement with the drive member 1214. For example, the spring member 1224 can be a leaf spring that can be compressed when moving the yoke member 1202 away from the drive member 1214. The user 30 (FIG. 1) remains able to manually move the toggle 28 between the on and the off positions while the yoke member 1202 is in the neutral position.

With reference to FIG. 58, when the toggle 28 is in the off position, the yoke member 1202 can be in the corresponding bottom position. The worm drive 1216 can hold the yoke member 1202 in the bottom position. The electric motor 1218 may then rotate the drive member 1214 to pivot the yoke member 1202 in an upward direction. By pivoting the yoke member 1202 in the upward direction, the yoke member 1202 can move toward the top position and can, in turn, move the toggle 28 from the off position to the on position, as shown in FIG. 59.

With reference to FIG. 60, once the yoke member 1202 has moved to the top position (FIG. 59), the worm drive 1216 can move the yoke member 1202 to the neutral position. The user 30 (FIG. 1) can also manually disengage the yoke member 1202 from the drive member 1214 and the user 30 can move the toggle 28 from the on position to the off position and the yoke member 1202 can be moved to the neutral position. Once in the neutral position, the first aperture 1210 can be large enough so that the inner periphery 1212 of the first aperture 1210 can be outside of the range of motion 60 (FIG. 6) of the toggle 28, so the yoke member 1202 can be shown to not obstruct the movement of the toggle 28 to the off position or to the on position.

With reference to FIG. 61, FIG. 62, and FIG. 63, an automatic switch control 1250 in accordance with another example of the present teachings can be placed over the toggle 28 of the switch 26 and can move the toggle 28 between the on position and the off position in a similar fashion to the automatic switch control 950, as shown in FIG. 43. The automatic switch control 1250 can also permit the user 30 (FIG. 1) to manually move the toggle 28 and permit the switch 26 to move the toggle 28 under its own power between the on position and the off position.

The automatic switch control 1250 can include a yoke member 1252 that can be pivotally supported on a housing 1254 of the automatic switch control 1250. The yoke member 1252 can include a top member 1256 and a bottom member 1258. A first plunger mechanism 1260 can move the bottom member 1258 toward the on position of the toggle 28 and a second plunger mechanism 1262 can move the top member 1256 toward the off position of the toggle 28. The top and the bottom members 1256, 1258 can pivot about the housing 1254 and can contact the toggle 28 to move the toggle 28 in a direction generally parallel to a longitudinal axis 1264 of the automatic switch control 1250.

The first plunger mechanism 1260 can pivot the bottom member 1258 about a pin member 1266. The first plunger mechanism 1260 can include a drive member 1268 that can be extended and retracted by an electric motor 1270. The drive member 1268 can connect to a groove 1272 in the bottom member 1258 with a pin member 1274 that permits the drive member 1268 to move in the direction parallel to the longitudinal axis 1264, while the bottom member 1258 can travel in a curved path. The second plunger mechanism 1262 can connect to the top member 1256 that can pivot about a pin member 1276. The second plunger mechanism 1262 can include a drive member 1278 that can be extended and retracted by an electric motor 1280. The drive member 1278 can connect to a groove 1282 in the top member 1256 with a pin member 1284 to permit motion similar to the bottom member 1256.

The first plunger mechanism 1260 can include a spring member 1286 that can urge the drive member 1268 to an extended condition and move the bottom member 1258 out of the range of motion 60 (FIG. 6) of the toggle 28. For example, the first plunger mechanism 1260 can include a solenoid that can pull the drive member 1268 into a retracted condition against the spring member 1286 and can move the toggle 28 to the on position. The first plunger mechanism 1260 could also rotate the drive member 1268 between the retracted condition and the extended condition. In this example, the drive member 1268 can include a joint to permit rotation of one portion but then also connect to the bottom member 1258 with a portion of the drive member 1268 that does not rotate. Similarly, the second plunger mechanism 1262 can include a spring member 1288 that can urge the drive member 1278 to an extended condition and move the top member 1256 out of the range of motion 60 of the toggle 28. For example, the second plunger mechanism 1262 can include a solenoid that can similarly pull the drive member 1278 into a retracted condition against the spring member 1288 and can move the toggle 28 to the off position. The second plunger mechanism 1262 could also rotate the drive member 1278 in a similar configuration to the drive member 1268 discussed herein.

With reference to FIG. 61, the toggle 28 is in the off position and the yoke member 1252 is in the bottom position. With reference to FIG. 62, the toggle 28 is in the on position and the yoke member 1252 is in the top position. With reference to FIG. 63, the yoke member 1252 is in a neutral position and the toggle 28 can be in the on position (as illustrated) or in the off position. When the yoke member 1252 is in the neutral position, the top and bottom members 1256, 1258 are kept outside of the range of motion 60 (FIG. 6) of the toggle 28 so that the toggle 28 can be moved manually or by the switch 26 under its own power.

With reference to FIG. 64, an automatic switch control 1300 in accordance with another example of the present teachings can be placed over the toggle 28 of the switch 26 and can move the toggle 28 between the on position and the off position in a similar fashion to the automatic switch control 600, as shown in FIG. 22. The automatic switch control 1300 can also permit the user 30 (FIG. 1) to manually move the toggle 28 and permit the switch 26 to move the toggle 28 under its own power between the on position and the off position. The automatic switch control 1300 can include a yoke member 1302 that can be slidably supported on a housing 1304 of the automatic switch control 1300. The yoke member 1302 can include a cam member 1306 that can connect to a worm drive 1308 that can be connected to the housing 1304. The yoke member 1302 can further include four grooves 1310 that are formed in the yoke member 1302. Each of the grooves 1310 accept a post member 1312 that can extend from the housing 1304. Each of the four grooves 1310 are configured so that the yoke member 1302 can travel in a partially arcuate path around the toggle 28. In addition, the yoke member 1302 can define an aperture 1314 that can serve as a toggle mover member 1316 that can receive the toggle 28 for movement between the on position and the off position.

The worm drive 1308 can have a drive member 1320 that can connect to the cam member 1306 on the yoke member 1302. An electric motor 1322 can rotate the drive member 1320 so that the cam member 1306 can rotate about the drive member 1320 thus moving the yoke member 1302 between a top position, a bottom position, and a neutral position. When the worm drive 1308 moves the yoke member 1302 to the top position, the toggle 28 can be moved to the on position. When the worm drive 1308 moves the toggle mover member 1316 to the bottom position, the yoke member 1302 can move the toggle 28 to the off position.

To move to the neutral position, the yoke member 1302 can deviate from longitudinal motion that can be parallel to a longitudinal axis 1324 and therefore can move in a partially lateral direction that can be perpendicular to the longitudinal axis 1324. To make this possible, the grooves 1310 and the aperture 1314 that forms the toggle mover member 1316 can be elongated to permit such movement. With the yoke member 1302 in the neutral position, the user 30 (FIG. 1) can manually move the toggle 28 from the on position to the off position and in doing so the yoke member 1302 is not pulled with the toggle 28 but can remain in the neutral position.

With reference to FIG. 65, an automatic switch control 1350 in accordance with another example of the present teachings can be placed over the toggle 28 of the switch 26 and can move the toggle 28 between the on position and the off position in a similar fashion to the automatic switch control 650 as shown in FIG. 24. The automatic switch control 1350 can also permit the user 30 (FIG. 1) to manually move the toggle 28 and permit the switch 26 to move the toggle 28 under its own power between the on position and the off position.

The automatic switch control 1350 can include a yoke member 1352 that can be pivotally supported on a housing 1354 of the automatic switch control 1350. The yoke member 1352 can have a pivot portion 1356 on one side of the yoke member 1352 that can be pivotally attached to the housing 1354 with a pin member 1358. The pin member 1358 can allow the yoke member 1352 to pivot in a curved path relative to the toggle 28 that can move in a direction generally parallel to a longitudinal axis 1360 of the automatic switch control 1350.

The yoke member 1352 can define a first aperture 1362 that can be completely internal within the yoke member 1352 and thus can form an inner periphery 1364. The first aperture 1362 can be sized to accept the toggle 28. The yoke member 1352 can also define gear teeth 1366 on an end portion 1368 of the yoke member 1352 that can be opposite the pivot portion 1356. The gear teeth 1366 can extend from the end portion 1368 and can be engaged by a drive member 1370 of a gear assembly 1372. Cooperation between the gear teeth 1366 on the yoke member 1352 and the gear assembly 1372 can transfer the rotational motion of an electric motor 1374 and the gear assembly 1372 to the pivotal motion of the yoke member 1352. The electric motor 1374 can rotate the drive member 1370 through the gear assembly 1372 that can include multiple gears that can place the electric motor 1374 at a location in the housing 1354 that is distal from the drive member 1370. For example, the gear assembly 1372 can employ three reduction gear sets 1376 that can permit the electric motor 1374 to be disposed below the toggle 28.

Once the yoke member 1352 has moved to the top position or the bottom position, the electric motor 1374 can move the yoke member 1352 to a neutral position as is shown in FIG. 65. Once the yoke member 1352 reaches the neutral position, the electric motor 1374 can be deactivated. With the yoke member 1352 in the neutral position, the user 30 (FIG. 1) can manually move the toggle 28 from the on position to the off position and in doing so, the yoke member 1352 is not pulled with the toggle 28 but can remain in the neutral position.

With reference to FIG. 66, an automatic switch control 1400 in accordance with another example of the present teachings can be placed over the toggle 28 of the switch 26 and can move the toggle 28 between the on position and the off position in a similar fashion to the automatic switch control 1100, as shown in FIG. 52. The automatic switch control 1400 can also permit the user 30 (FIG. 1) to manually move the toggle and have the switch 26 move the toggle 28 under its own power between the on position and the off position.

The automatic switch control 1400 can include a yoke member 1402 that can be mounted for longitudinal movement on a housing 1404 of the automatic switch control 1400. The yoke member 1402 can include a toggle mover member 1406 that can be attached to a follower member 1408. The follower member 1408 can include an aperture 1410 that can receive a drive member 1412 of a worm drive 1414 that can move the follower member 1408 longitudinally to a top position and a bottom position. An electric motor 1416 can drive the drive member 1412 of the worm drive 1414 so the follower member 1408 translates longitudinally and generally parallel to a longitudinal axis 1418. The toggle mover member 1406 can include a torsional spring 1420 that can connect to the follower member 1408 and maintain the toggle mover member 1406 in a neutral condition. A pin member 1426 and a pin member 1428 can extend from the housing 1404 generally perpendicular to the longitudinal axis 1418.

The yoke member 1402 can be moved to the top position to move the toggle 28 to the on position. The toggle mover member 1406 can begin movement upward with the yoke member 1402 and the toggle mover member 1406 can contact the pin member 1128. In this regard, the yoke member 1402 deflects (i.e., winds up) the torsional spring 1420. With continuing movement of the yoke member 1402 upward, the toggle mover member 1406 can skip past the pin member 1428 and can contact the toggle 28 to push the toggle 28 to the on position. The toggle mover member 1406 can skip past the toggle 28 and come to a rest position above the toggle 28. In this position, the yoke member 1402 can be in a neutral position. The yoke member 1402 can also be moved by the worm drive 1414 to the bottom position. In doing so, the toggle mover member 1406 can wind up (i.e., load) against the pin member 1126 and then skip past it to move the toggle 28 to the off position. When the toggle mover member 1406 can move the toggle 28 to the off position, the toggle mover member 1406 can skip past the toggle 28 and come to a rest in a position beneath the toggle 28. In this position, the yoke member 1402 is in a neutral position.

With reference to FIG. 67, an automatic switch control 1450 that can be similar to the automatic switch control 10 (FIG. 1) can include an adapter 1452. The adapter 1452 can permit the housing 1454 of the automatic switch control 1450 to mount to the switch 26 on the wall 20 that does not include the switch plate 24 (FIG. 2). For example, the adapter 1452 can connect to a rear surface 1456 of a rear shell member 1458 of the housing 1454. In doing so, the adapter 1452 can serve to visually extend the housing 1454 to fit securely around the switch 26 and to the wall 20. The adapter 1454 can cover up the area between the rear surface 1456 of the automatic switch control 1450 and the wall 20 such that nothing is visible between the wall 20 and the housing 1454 but would have otherwise been open due to the omission of the switch plate 24 (FIG. 2). The adapter 1452 can connect to the housing 1454 of the automatic switch control 1450 using fasteners and/or adhesives. The adapter 1452 can also be held between the housing 1454 of the automatic switch control 1450 and the switch 26 by sandwiching the adapter 1452 against the housing 1454 and the wall 20.

With reference to FIG. 1, FIG. 68 and FIG. 69, the user 30 can install the automatic switch control 10 over an existing switch 26 with existing switch plate 24. The user 30 can remove the conventional fasteners 1500 from the switch plate 24 and the switch 26 but can keep the switch plate 24 secured to the wall 20 with a piece of adhesive material such as tape or other fasteners. The user 30 can also hold the switch plate 24 to the wall 20 during the process. As shown in FIG. 69, the user 30 can secure the mounting plate member 118 over the switch plate 24 using a first fastener 1512 and a second fastener 1514. This can permit the user 30 to attach the mounting plate member 118 to the already in place the switch plate 24 and connect to the already existing receptacles on the switch 26 where the previous fasteners 1500 were connected. Once the fasteners 1512, 1514 are secured, the automatic switch control 10 can be secured to the mounting plate member 118 by pushing the automatic switch control 10 firmly onto the switch 26, as shown in FIG. 2.

While specific aspects have been described in the specification and illustrated in the drawings, it will be understood by those skilled in the art that various changes can be made and equivalents can be substituted for elements and components thereof without departing from the scope of the present teachings, as defined in the claims. Furthermore, the mixing and matching of features, elements, components and/or functions between various aspects of the present teachings are expressly contemplated herein so that one skilled in the art will appreciate from the present teachings that features, elements, components and/or functions of one aspect of the present teachings can be incorporated into another aspect, as appropriate, unless described otherwise above. Moreover, many modifications may be made to adapt a particular situation, configuration, or material to the present teachings without departing from the essential scope thereof. Therefore, it is intended that the present teachings not be limited to the particular aspects illustrated by the drawings and described in the specification as the best mode presently contemplated for carrying out the present teachings, but that the scope of the present teachings include many aspects and examples following within the foregoing description and the appended claims.

What is claimed is:

1. An automatic switch control that fits over a switch on a wall to move a toggle of the switch between an on position and an off position, the automatic switch control comprising:

a housing;

a wheel member rotatably supported by said housing, said wheel member having a cam member with a ramp surface;

an electric motor that is operable to rotate said wheel member about an axis of rotation that is generally perpendicular to the wall;

a first plunger mechanism having a first spring member that is operable to urge a first cam follower into sliding engagement with said ramp surface; and a second plunger mechanism having a second spring member that is operable to urge a second cam follower into sliding engagement with said ramp surface, said second plunger mechanism disposed on an opposite side of the toggle from said first plunger mechanism when the automatic switch control is installed over the switch;

said electric motor operable to rotate said cam member to position said first plunger mechanism in a retracted condition and to position said second plunger mechanism in an extended condition that is operable to move the toggle to the on position.

2. The automatic switch control of claim 1 wherein said electric motor is operable to move said cam member to position each of said first and second plunger mechanisms into said retracted condition.

3. The automatic switch control of claim 1 wherein said electric motor is operable to move said cam member to position said second plunger mechanism in said retracted condition and to position said first plunger mechanism in an extended condition, said first cam follower operable to disconnect from said ramp surface when traveling toward said axis of rotation and re-connect to said ramp surface when moving from said retracted condition to said extended condition.

4. The automatic switch control of claim 1 wherein said second spring member of said second plunger mechanism is connected between a second post member and a second stop member, said second stop member connected to said housing, said second post member includes said second cam follower and a second head member, said second spring member is operable to urge said second cam follower into sliding engagement with said ramp surface, said ramp surface on said cam member includes a round portion and a flat portion, said electric motor operable to position said round portion of said ramp surface in contact with said first cam follower to hold said first plunger mechanism in said retracted condition and to position said flat portion of said ramp surface out of an obstructing position with said second cam follower to permit said second plunger mechanism to move to said extended condition.

5. The automatic switch control of claim 1 wherein said cam member having said ramp surface on said wheel member is disposed on a rear surface of said wheel member and faces the toggle of the switch with said wheel member disposed in front of the toggle.

6. The automatic switch control of claim 1 wherein said cam member having said ramp surface on said wheel member is disposed on a front surface of said wheel member opposite a rear surface that faces the toggle of the switch with the wheel member disposed above the toggle.

7. The automatic switch control of claim 1 wherein the toggle of the switch remains manually movable to the off position and the on position without having to remove the automatic switch control from the switch on the wall.

8. The automatic switch control of claim 7 further comprising: a manual actuator member having a handle member that extends from a front surface of said manual actuator member and through an aperture defined in said housing, said handle member operable to be grasped to move the toggle of the switch with said manual actuator member.

9. The automatic switch control of claim 8 wherein said manual actuator member includes a toggle mover member that extends from a rear surface of said manual actuator member, said toggle mover member operable to engage the toggle of the switch.

10. The automatic switch control of claim 9 wherein said second plunger mechanism includes a post member with a slot portion through which said toggle holder can be disposed when connected to the toggle of the switch, said toggle mover member is movable in said slot portion to move the toggle of the switch to the on position and to the off position when said second post member is in said retracted condition.

11. An automatic switch control that fits over a switch on a wall to move a toggle of the switch between an on position and an off position, the automatic switch control comprising:

a housing;

a yoke member having a first aperture that receives the toggle, said yoke member movably supported by said housing between a first yoke position and a second yoke position;

a drive member rotatably supported by said housing, said drive member connected to said yoke member;

an electric motor connected to said housing and operable to move said yoke member between the first and second yoke positions by moving said drive member; and a centrifugal clutch that connects said drive member to said electric motor;

wherein placement of said yoke member in said first yoke position is configured to position the toggle in an on position, wherein placement of said yoke member is said second yoke position is configured to position the toggle in an off position, wherein said first aperture in said yoke member is sized to permit manual movement of the toggle from the on position to the off position when said yoke member is in said first yoke position, and wherein said first aperture in said yoke member is sized to permit manual movement of the toggle from the off position to the on position when said yoke member is in said second yoke position; and wherein said centrifugal clutch permits the toggle to be moved manually and by the switch when the yoke member is not moving the toggle to the on position or the off position with said electric motor by opening said centrifugal clutch to disconnect said electric motor from said drive member so that motion imparted on said yoke member by manual movement of the toggle is prevented from back driving said electric motor.

12. The automatic switch control of claim 11 wherein said yoke member is pivotally connected to said housing and rotates between said first yoke position and said second yoke position.

13. The automatic switch control of claim 11 wherein said yoke member is slidably connected to said housing and moves longitudinally between said first yoke position and said second yoke position.

14. The automatic switch control of claim 11 wherein said electric motor is operable to position said yoke member in a neutral position where said aperture defined by said yoke member is disposed over the toggle so that no portion of said yoke member contacts the toggle to permit the toggle to be moved manually and by the switch when the automatic switch control is not moving the toggle to the on position or the off position with said electric motor.

15. An automatic switch control that fits over a switch on a wall to move a toggle of the switch between an on position and an off position, the automatic switch control comprising:

a housing;

a spring member connected to said housing;

an electric motor connected to said housing and operable to load said spring member;

a toggle mover member connected to said housing and operable to move the toggle to the on position or the off position;

a control module that rotates said electric motor to load said spring member and that permits said spring member to unload and move said toggle mover member to move the toggle from the on position to the off position; and a plunger mechanism and a wheel member, said wheel member having a cam member with a ramp surface, said plunger mechanism having a post member connected to a stop member with said spring member, said stop member connected to said housing, said post member includes a cam follower and a head member, said spring member is operable to urge said cam follower into sliding engagement with said ramp surface, said head member is operable to move said toggle mover member.

16. The automatic switch control of claim 15 wherein said ramp surface includes a round portion and a flat portion and said electric motor is operable to position said round portion of said ramp surface in contact with said cam follower to load said spring member and hold said head member in a retracted condition and is also operable to further rotate said wheel member and position said flat portion of said ramp surface out of an obstructing position with said cam follower to permit said head member to move to an extended condition and move said toggle mover member.

17. The automatic switch control of claim 16 wherein the toggle of the switch remains manually movable to the off position and the on position when the automatic switch control is installed over the switch on the wall without having to remove the automatic switch control from the switch on the wall.

18. An automatic switch control that fits over a switch on a wall to move a toggle of the switch between an on position and an off position, the automatic switch control comprising:

a housing;

a spring member connected to said housing;

an electric motor connected to said housing and operable to load said spring member;

a toggle mover member connected to said housing and operable to move the toggle to the on position or the off position;

a control module that rotates said electric motor to load said spring member and that permits said spring member to unload and move said toggle mover member to move the toggle from the on position to the off position; and a yoke member supported by said housing and movable by said electric motor, said toggle mover member is pivotally supported by said yoke member and connected to said yoke member with said spring member, said control module moves said yoke member to move said toggle mover member into contact with a pin member to deflect said toggle mover member and load said spring member and permits said toggle mover member to skip past said pin member and unload by contacting and moving the toggle of the switch.

* * * * *